US009624567B2

(12) United States Patent
Bryan et al.

(10) Patent No.: US 9,624,567 B2
(45) Date of Patent: Apr. 18, 2017

(54) METHODS FOR PROCESSING TITANIUM ALLOYS

(71) Applicant: ATI Properties, Inc., Albany, OR (US)

(72) Inventors: David J. Bryan, Indian Trail, NC (US); John V. Mantione, Indian Trail, NC (US); Jean-Philippe Thomas, Charlotte, NC (US)

(73) Assignee: ATI PROPERTIES LLC, Albany, OR (US)

( * ) Notice: Subject to any disclaimer, the term of this patent is extended or adjusted under 35 U.S.C. 154(b) by 0 days.

(21) Appl. No.: 14/922,750

(22) Filed: Oct. 26, 2015

(65) Prior Publication Data

US 2016/0047024 A1 Feb. 18, 2016

Related U.S. Application Data

(63) Continuation of application No. 13/714,465, filed on Dec. 14, 2012, now Pat. No. 9,206,497, which is a (Continued)

(51) Int. Cl.

| | |
|---|---|
| ***C22F 1/18*** | (2006.01) |
| ***C22C 14/00*** | (2006.01) |
| ***B21K 29/00*** | (2006.01) |
| ***B21J 1/02*** | (2006.01) |
| ***B21J 1/06*** | (2006.01) |
| ***B21J 5/00*** | (2006.01) |

(52) U.S. Cl.

CPC ..... *C22F 1/183* (2013.01); *B21J 1/025* (2013.01); *B21J 1/06* (2013.01); *B21J 5/00* (2013.01); *B21K 29/00* (2013.01); *C22C 14/00* (2013.01)

(58) Field of Classification Search

CPC ..... C22F 1/183
USPC ..... 148/670
See application file for complete search history.

(56) References Cited

U.S. PATENT DOCUMENTS

| | | | |
|---|---|---|---|
| 2,857,269 | A | 10/1958 | Vordahl |
| 2,932,886 | A | 4/1960 | Althouse |

(Continued)

FOREIGN PATENT DOCUMENTS

| | | | |
|---|---|---|---|
| CN | 1070230 | A | 3/1993 |
| CN | 1194671 | A | 9/1998 |

(Continued)

OTHER PUBLICATIONS

"Allvac TiOsteum and TiOstalloy Beat Titanium Alloys", printed from www.allvac.com/allvac/pages/Titanium/TiOsteum.htm on Nov. 7, 2005.

(Continued)

*Primary Examiner* — Brian Walck
(74) *Attorney, Agent, or Firm* — K&L Gates LLP

(57) ABSTRACT

Methods of refining the grain size of a titanium alloy workpiece include beta annealing the workpiece, cooling the beta annealed workpiece to a temperature below the beta transus temperature of the titanium alloy, and high strain rate multi-axis forging the workpiece. High strain rate multi-axis forging is employed until a total strain of at least 1 is achieved in the titanium alloy workpiece, or until a total strain of at least 1 and up to 3.5 is achieved in the titanium alloy workpiece. The titanium alloy of the workpiece may comprise at least one of grain pinning alloying additions and beta stabilizing content effective to decrease alpha phase precipitation and growth kinetics.

34 Claims, 18 Drawing Sheets

Related U.S. Application Data continuation-in-part of application No. 12/882,538, filed on Sep. 15, 2010, now Pat. No. 8,613,818.

(56) References Cited

U.S. PATENT DOCUMENTS

| | | | |
|---|---|---|---|
| 2,974,076 | A | 3/1961 | Vordahl |
| 3,015,292 | A | 1/1962 | Bridwell |
| 3,025,905 | A | 3/1962 | Haerr |
| 3,060,564 | A | 10/1962 | Corral |
| 3,082,083 | A | 3/1963 | Levy et al. |
| 3,117,471 | A | 1/1964 | O'Connell et al. |
| 3,313,138 | A | 4/1967 | Spring et al. |
| 3,379,522 | A | 4/1968 | Vordahl |
| 3,489,617 | A | 1/1970 | Wuerfel |
| 3,584,487 | A | 6/1971 | Carlson |
| 3,605,477 | A | 9/1971 | Carlson |
| 3,615,378 | A | 10/1971 | Bomberger, Jr. et al. |
| 3,635,068 | A | 1/1972 | Watmough et al. |
| 3,649,259 | A | 3/1972 | Heitman |
| 3,676,225 | A | 7/1972 | Owczarski et al. |
| 3,686,041 | A | 8/1972 | Lee |
| 3,802,877 | A | 4/1974 | Parris et al. |
| 3,815,395 | A | 6/1974 | Sass |
| 3,835,282 | A | 9/1974 | Sass et al. |
| 3,922,899 | A | 12/1975 | Fremont et al. |
| 3,979,815 | A | 9/1976 | Nakanose et al. |
| 4,053,330 | A | 10/1977 | Henricks et al. |
| 4,067,734 | A | 1/1978 | Curtis et al. |
| 4,094,708 | A | 6/1978 | Hubbard et al. |
| 4,098,623 | A | 7/1978 | Ibaraki et al. |
| 4,120,187 | A | 10/1978 | Mullen |
| 4,138,141 | A | 2/1979 | Andersen |
| 4,147,639 | A | 4/1979 | Lee et al. |
| 4,150,279 | A | 4/1979 | Metcalfe et al. |
| 4,163,380 | A | 8/1979 | Masoner |
| 4,197,643 | A | 4/1980 | Burstone et al. |
| 4,229,216 | A | 10/1980 | Paton et al. |
| 4,309,226 | A | 1/1982 | Chen |
| 4,472,207 | A | 9/1984 | Kinoshita et al. |
| 4,482,398 | A | 11/1984 | Eylon et al. |
| 4,510,788 | A | 4/1985 | Ferguson et al. |
| 4,543,132 | A | 9/1985 | Berczik et al. |
| 4,614,550 | A | 9/1986 | Leonard et al. |
| 4,631,092 | A | 12/1986 | Ruckle et al. |
| 4,639,281 | A | 1/1987 | Sastry et al. |
| 4,668,290 | A | 5/1987 | Wang et al. |
| 4,687,290 | A | 8/1987 | Prussas |
| 4,688,290 | A | 8/1987 | Hogg |
| 4,690,716 | A | 9/1987 | Sabol et al. |
| 4,714,468 | A | 12/1987 | Wang et al. |
| 4,799,975 | A | 1/1989 | Ouchi et al. |
| 4,808,249 | A | 2/1989 | Eylon et al. |
| 4,842,653 | A | 6/1989 | Wirth et al. |
| 4,851,055 | A | 7/1989 | Eylon et al. |
| 4,854,977 | A | 8/1989 | Alheritiere et al. |
| 4,857,269 | A | 8/1989 | Wang et al. |
| 4,878,966 | A | 11/1989 | Alheritiere et al. |
| 4,888,973 | A | 12/1989 | Comley |
| 4,889,170 | A | 12/1989 | Mae et al. |
| 4,919,728 | A | 4/1990 | Kohl et al. |
| 4,943,412 | A | 7/1990 | Bania et al. |
| 4,957,567 | A | 9/1990 | Krueger et al. |
| 4,975,125 | A | 12/1990 | Chakrabarti et al. |
| 4,980,127 | A | 12/1990 | Parris et al. |
| 5,026,520 | A | 6/1991 | Bhowal et al. |
| 5,032,189 | A | 7/1991 | Eylon et al. |
| 5,041,262 | A | 8/1991 | Gigliotti, Jr. |
| 5,074,907 | A | 12/1991 | Amato et al. |
| 5,080,727 | A | 1/1992 | Aihara et al. |
| 5,094,812 | A | 3/1992 | Dulmaine et al. |
| 5,141,566 | A | 8/1992 | Kitayama et al. |
| 5,156,807 | A | 10/1992 | Nagata et al. |
| 5,162,159 | A | 11/1992 | Tenhover et al. |
| 5,169,597 | A | 12/1992 | Davidson et al. |
| 5,173,134 | A | 12/1992 | Chakrabarti et al. |
| 5,201,457 | A | 4/1993 | Kitayama et al. |
| 5,244,517 | A | 9/1993 | Kimura et al. |
| 5,256,369 | A | 10/1993 | Ogawa et al. |
| 5,264,055 | A | 11/1993 | Champin et al. |
| 5,277,718 | A | 1/1994 | Paxson et al. |
| 5,310,522 | A | 5/1994 | Culling |
| 5,332,454 | A | 7/1994 | Meredith et al. |
| 5,332,545 | A | 7/1994 | Love |
| 5,342,458 | A | 8/1994 | Adams et al. |
| 5,358,586 | A | 10/1994 | Schutz |
| 5,359,872 | A | 11/1994 | Nashiki |
| 5,360,496 | A | 11/1994 | Kuhlman et al. |
| 5,374,323 | A | 12/1994 | Kuhlman et al. |
| 5,399,212 | A | 3/1995 | Chakrabarti et al. |
| 5,442,847 | A | 8/1995 | Semiatin et al. |
| 5,472,526 | A | 12/1995 | Gigliotti, Jr. |
| 5,494,636 | A | 2/1996 | Dupioron et al. |
| 5,509,979 | A | 4/1996 | Kimura |
| 5,516,375 | A | 5/1996 | Ogawa et al. |
| 5,520,879 | A | 5/1996 | Saito et al. |
| 5,527,403 | A | 6/1996 | Schirra et al. |
| 5,545,262 | A | 8/1996 | Hardee et al. |
| 5,545,268 | A | 8/1996 | Yashiki et al. |
| 5,547,523 | A | 8/1996 | Blankenship et al. |
| 5,558,728 | A | 9/1996 | Kobayashi et al. |
| 5,580,665 | A | 12/1996 | Taguchi et al. |
| 5,600,989 | A | 2/1997 | Segal et al. |
| 5,649,280 | A | 7/1997 | Blankenship et al. |
| 5,658,403 | A | 8/1997 | Kimura |
| 5,662,745 | A | 9/1997 | Takayama et al. |
| 5,679,183 | A | 10/1997 | Takagi et al. |
| 5,698,050 | A | 12/1997 | El-Soudani |
| 5,758,420 | A | 6/1998 | Schmidt et al. |
| 5,759,305 | A | 6/1998 | Benz et al. |
| 5,759,484 | A | 6/1998 | Kashii et al. |
| 5,795,413 | A | 8/1998 | Gorman |
| 5,871,595 | A | 2/1999 | Ahmed et al. |
| 5,896,643 | A | 4/1999 | Tanaka |
| 5,897,830 | A | 4/1999 | Abkowitz et al. |
| 5,954,724 | A | 9/1999 | Davidson |
| 5,980,655 | A | 11/1999 | Kosaka |
| 6,002,118 | A | 12/1999 | Kawano et al. |
| 6,032,508 | A | 3/2000 | Ashworth et al. |
| 6,044,685 | A | 4/2000 | Delgado et al. |
| 6,053,993 | A | 4/2000 | Reichman et al. |
| 6,059,904 | A | 5/2000 | Benz et al. |
| 6,071,360 | A | 6/2000 | Gillespie |
| 6,077,369 | A | 6/2000 | Kusano et al. |
| 6,127,044 | A | 10/2000 | Yamamoto et al. |
| 6,132,526 | A | 10/2000 | Carisey et al. |
| 6,139,659 | A | 10/2000 | Takahashi et al. |
| 6,143,241 | A | 11/2000 | Hajaligol et al. |
| 6,187,045 | B1 | 2/2001 | Fehring et al. |
| 6,197,129 | B1 | 3/2001 | Zhu et al. |
| 6,200,685 | B1 | 3/2001 | Davidson |
| 6,209,379 | B1 | 4/2001 | Nishida et al. |
| 6,216,508 | B1 | 4/2001 | Matsubara et al. |
| 6,228,189 | B1 | 5/2001 | Oyama et al. |
| 6,250,812 | B1 | 6/2001 | Ueda et al. |
| 6,258,182 | B1 | 7/2001 | Schetky et al. |
| 6,284,071 | B1 | 9/2001 | Suzuki et al. |
| 6,332,935 | B1 | 12/2001 | Gorman et al. |
| 6,334,350 | B1 | 1/2002 | Shin et al. |
| 6,334,912 | B1 | 1/2002 | Ganin et al. |
| 6,384,388 | B1 | 5/2002 | Anderson et al. |
| 6,387,197 | B1 | 5/2002 | Bewlay et al. |
| 6,391,128 | B2 | 5/2002 | Ueda et al. |
| 6,399,215 | B1 | 6/2002 | Zhu et al. |
| 6,402,859 | B1 | 6/2002 | Ishii et al. |
| 6,409,852 | B1 | 6/2002 | Lin et al. |
| 6,532,786 | B1 | 3/2003 | Luttgeharm |
| 6,536,110 | B2 | 3/2003 | Smith et al. |
| 6,539,607 | B1 | 4/2003 | Fehring et al. |
| 6,539,765 | B2 | 4/2003 | Gates |
| 6,558,273 | B2 | 5/2003 | Kobayashi et al. |
| 6,561,002 | B2 | 5/2003 | Okada et al. |
| 6,569,270 | B2 | 5/2003 | Segal |
| 6,632,304 | B2 | 10/2003 | Oyama et al. |
| 6,632,396 | B1 | 10/2003 | Tetjukhin et al. |

(56) References Cited

U.S. PATENT DOCUMENTS

| | | | |
|---|---|---|---|
| 6,663,501 | B2 | 12/2003 | Chen |
| 6,726,784 | B2 | 4/2004 | Oyama et al. |
| 6,742,239 | B2 | 6/2004 | Lee et al. |
| 6,764,647 | B2 | 7/2004 | Aigner et al. |
| 6,773,520 | B1 | 8/2004 | Fehring et al. |
| 6,786,985 | B2 | 9/2004 | Kosaka et al. |
| 6,800,153 | B2 | 10/2004 | Ishii et al. |
| 6,823,705 | B2 | 11/2004 | Fukuda et al. |
| 6,908,517 | B2 | 6/2005 | Segal et al. |
| 6,918,971 | B2 | 7/2005 | Fujii et al. |
| 6,932,877 | B2 | 8/2005 | Raymond et al. |
| 6,971,256 | B2 | 12/2005 | Okada et al. |
| 7,008,491 | B2 | 3/2006 | Woodfield |
| 7,010,950 | B2 | 3/2006 | Cai et al. |
| 7,032,426 | B2 | 4/2006 | Durney et al. |
| 7,037,389 | B2 | 5/2006 | Barbier et al. |
| 7,038,426 | B2 | 5/2006 | Hall |
| 7,096,596 | B2 | 8/2006 | Hernandez, Jr. et al. |
| 7,132,021 | B2 | 11/2006 | Kuroda et al. |
| 7,152,449 | B2 | 12/2006 | Durney et al. |
| 7,264,682 | B2 | 9/2007 | Chandran et al. |
| 7,269,986 | B2 | 9/2007 | Pfaffmann et al. |
| 7,332,043 | B2 | 2/2008 | Tetyukhin et al. |
| 7,410,610 | B2 | 8/2008 | Woodfield et al. |
| 7,438,849 | B2 | 10/2008 | Kuramoto et al. |
| 7,449,075 | B2 | 11/2008 | Woodfield et al. |
| 7,536,892 | B2 | 5/2009 | Amino et al. |
| 7,559,221 | B2 | 7/2009 | Horita et al. |
| 7,601,232 | B2 | 10/2009 | Fonte |
| 7,611,592 | B2 | 11/2009 | Davis et al. |
| 7,708,841 | B2 | 5/2010 | Saller et al. |
| 7,837,812 | B2 | 11/2010 | Marquardt et al. |
| 7,879,286 | B2 | 2/2011 | Miracle et al. |
| 7,947,136 | B2 | 5/2011 | Saller |
| 7,984,635 | B2 | 7/2011 | Callebaut et al. |
| 8,037,730 | B2 | 10/2011 | Polen et al. |
| 8,048,240 | B2 | 11/2011 | Hebda et al. |
| 8,128,764 | B2 | 3/2012 | Miracle et al. |
| 8,211,548 | B2 | 7/2012 | Chun et al. |
| 8,316,687 | B2 | 11/2012 | Slattery |
| 8,336,359 | B2 | 12/2012 | Werz |
| 8,408,039 | B2 | 4/2013 | Cao et al. |
| 8,454,765 | B2 | 6/2013 | Saller et al. |
| 8,499,605 | B2 | 8/2013 | Bryan |
| 8,568,540 | B2 | 10/2013 | Marquardt et al. |
| 8,578,748 | B2 | 11/2013 | Huskamp et al. |
| 8,597,442 | B2 | 12/2013 | Hebda et al. |
| 8,597,443 | B2 | 12/2013 | Hebda et al. |
| 8,608,913 | B2 | 12/2013 | Shim et al. |
| 8,613,818 | B2 | 12/2013 | Forbes Jones et al. |
| 8,623,155 | B2 | 1/2014 | Marquardt et al. |
| 8,652,400 | B2 | 2/2014 | Forbes Jones et al. |
| 8,679,269 | B2 | 3/2014 | Goller et al. |
| 8,834,653 | B2 | 9/2014 | Bryan |
| 9,034,247 | B2 | 5/2015 | Suzuki et al. |
| 9,050,647 | B2 | 6/2015 | Thomas et al. |
| 9,192,981 | B2 | 11/2015 | Forbes Jones et al. |
| 9,206,497 | B2 | 12/2015 | Bryan et al. |
| 9,255,316 | B2 | 2/2016 | Bryan |
| 2003/0168138 | A1 | 9/2003 | Marquardt |
| 2004/0099350 | A1 | 5/2004 | Manitone et al. |
| 2004/0148997 | A1 | 8/2004 | Amino et al. |
| 2004/0221929 | A1 | 11/2004 | Hebda et al. |
| 2004/0250932 | A1 | 12/2004 | Briggs |
| 2005/0145310 | A1 | 7/2005 | Bewlay et al. |
| 2006/0045789 | A1 | 3/2006 | Nasserrafi et al. |
| 2006/0110614 | A1 | 5/2006 | Liimatainen |
| 2006/0243356 | A1 | 11/2006 | Oikawa et al. |
| 2007/0017273 | A1 | 1/2007 | Haug et al. |
| 2007/0193662 | A1 | 8/2007 | Jablokov et al. |
| 2008/0000554 | A1 | 1/2008 | Yaguchi et al. |
| 2008/0103543 | A1 | 5/2008 | Li et al. |
| 2008/0107559 | A1 | 5/2008 | Nishiyama et al. |
| 2008/0202189 | A1 | 8/2008 | Otaki |
| 2008/0210345 | A1 | 9/2008 | Tetyukhin et al. |
| 2008/0264932 | A1 | 10/2008 | Hirota |
| 2009/0000706 | A1 | 1/2009 | Huron et al. |
| 2009/0183804 | A1 | 7/2009 | Zhao et al. |
| 2009/0234385 | A1 | 9/2009 | Cichocki et al. |
| 2011/0180188 | A1 | 7/2011 | Bryan et al. |
| 2012/0067100 | A1 | 3/2012 | Stefansson et al. |
| 2012/0076611 | A1 | 3/2012 | Bryan |
| 2012/0076612 | A1 | 3/2012 | Bryan |
| 2012/0076686 | A1 | 3/2012 | Bryan |
| 2012/0279351 | A1 | 11/2012 | Gu et al. |
| 2013/0062003 | A1 | 3/2013 | Shulkin et al. |
| 2013/0156628 | A1 | 6/2013 | Forbes Jones et al. |
| 2014/0060138 | A1 | 3/2014 | Hebda et al. |
| 2014/0076468 | A1 | 3/2014 | Marquardt et al. |
| 2014/0076471 | A1 | 3/2014 | Forbes Jones et al. |
| 2014/0116582 | A1 | 5/2014 | Forbes Jones et al. |
| 2014/0238552 | A1 | 8/2014 | Forbes Jones et al. |
| 2014/0261922 | A1 | 9/2014 | Thomas et al. |
| 2015/0129093 | A1 | 5/2015 | Forbes Jones et al. |
| 2016/0122851 | A1 | 5/2016 | Jones et al. |
| 2016/0138149 | A1 | 5/2016 | Bryan |
| 2016/0201165 | A1 | 7/2016 | Foltz, IV |

FOREIGN PATENT DOCUMENTS

| | | | |
|---|---|---|---|
| CN | 1403622 | | 3/2003 |
| CN | 1816641 | A | 8/2006 |
| CN | 101104898 | A | 1/2008 |
| CN | 101205593 | A | 6/2008 |
| CN | 101294264 | A | 10/2008 |
| CN | 101684530 | A | 3/2010 |
| CN | 101637789 | B | 6/2011 |
| CN | 102212716 | A | 10/2011 |
| CN | 102816953 | A | 12/2012 |
| DE | 19743802 | A1 | 3/1999 |
| DE | 10128199 | A1 | 12/2002 |
| DE | 102010009185 | A1 | 11/2011 |
| EP | 0066361 | A2 | 12/1982 |
| EP | 0109350 | A2 | 5/1984 |
| EP | 0320820 | A1 | 6/1989 |
| EP | 0535817 | B1 | 4/1995 |
| EP | 0611831 | B1 | 1/1997 |
| EP | 0834580 | A1 | 4/1998 |
| EP | 0870845 | A1 | 10/1998 |
| EP | 0707085 | B1 | 1/1999 |
| EP | 0683242 | B1 | 5/1999 |
| EP | 0969109 | A1 | 1/2000 |
| EP | 1083243 | A2 | 3/2001 |
| EP | 1136582 | A1 | 9/2001 |
| EP | 1302554 | A1 | 4/2003 |
| EP | 1302555 | A1 | 4/2003 |
| EP | 1471158 | A1 | 10/2004 |
| EP | 1605073 | A1 | 12/2005 |
| EP | 1612289 | A2 | 1/2006 |
| EP | 1717330 | A1 | 11/2006 |
| EP | 1882752 | A2 | 1/2008 |
| EP | 2028435 | A1 | 2/2009 |
| EP | 2281908 | A1 | 2/2011 |
| EP | 1546429 | B1 | 6/2012 |
| FR | 2545104 | A1 | 11/1984 |
| GB | 847103 | | 9/1960 |
| GB | 1170997 | A | 11/1969 |
| GB | 1433306 | | 4/1976 |
| GB | 2151260 | A | 7/1985 |
| GB | 2337762 | A | 12/1999 |
| JP | 55-113865 | A | 9/1980 |
| JP | 57-62820 | A | 4/1982 |
| JP | 57-62846 | A | 4/1982 |
| JP | 60-046358 | | 3/1985 |
| JP | 60-100655 | A | 6/1985 |
| JP | S61-217564 | A | 9/1986 |
| JP | 62-109956 | A | 5/1987 |
| JP | 62-127074 | A | 6/1987 |
| JP | 62-149859 | A | 7/1987 |
| JP | S63-49302 | A | 3/1988 |
| JP | S63-188426 | A | 8/1988 |
| JP | 1-279736 | A | 11/1989 |
| JP | 2-205661 | A | 8/1990 |
| JP | 3-134124 | A | 6/1991 |

(56) References Cited

FOREIGN PATENT DOCUMENTS

| | | | |
|---|---|---|---|
| JP | H03-264618 | A | 11/1991 |
| JP | 4-74856 | A | 3/1992 |
| JP | 4-103737 | A | 4/1992 |
| JP | 4-168227 | A | 6/1992 |
| JP | 5-59510 | A | 3/1993 |
| JP | 5-117791 | A | 5/1993 |
| JP | 5-195175 | A | 8/1993 |
| JP | H05-293555 | A | 11/1993 |
| JP | 8-300044 | A | 11/1996 |
| JP | 9-143650 | | 6/1997 |
| JP | 9-194969 | A | 7/1997 |
| JP | 9-215786 | A | 8/1997 |
| JP | H10-128459 | A | 5/1998 |
| JP | H10-306335 | A | 11/1998 |
| JP | H11-319958 | A | 11/1999 |
| JP | 11-343528 | A | 12/1999 |
| JP | 11-343548 | A | 12/1999 |
| JP | 2000-153372 | A | 6/2000 |
| JP | 2000-234887 | A | 8/2000 |
| JP | 2001-71037 | A | 3/2001 |
| JP | 2001-081537 | A | 3/2001 |
| JP | 2001-343472 | A | 12/2001 |
| JP | 2002-146497 | A | 5/2002 |
| JP | 2003-55749 | A | 2/2003 |
| JP | 2003-74566 | A | 3/2003 |
| JP | 2003-285126 | A | 10/2003 |
| JP | 2003-334633 | A | 11/2003 |
| JP | 2009-299110 | A | 12/2009 |
| JP | 2009-299120 | A | 12/2009 |
| JP | 2010-70833 | A | 4/2010 |
| JP | 2012-140690 | A | 7/2012 |
| KR | 920004946 | | 6/1992 |
| KR | 10-2005-0087765 | A | 8/2005 |
| RU | 1131234 | C | 10/1994 |
| RU | 2156828 | C1 | 9/2000 |
| RU | 2197555 | C1 | 7/2001 |
| RU | 2172359 | C1 | 8/2001 |
| RU | 2269584 | C1 | 2/2006 |
| RU | 2364660 | C1 | 8/2009 |
| RU | 2368695 | C1 | 9/2009 |
| RU | 2393936 | C1 | 7/2010 |
| SU | 534518 | A1 | 1/1977 |
| SU | 631234 | A | 11/1978 |
| SU | 1077328 | A | 5/1982 |
| SU | 1088397 | A1 | 2/1991 |
| UA | 38805 | A | 5/2001 |
| UA | 40862 | A | 8/2001 |
| UA | a200613448 | | 6/2008 |
| WO | WO 98/17836 | A1 | 4/1998 |
| WO | WO 98/22629 | A | 5/1998 |
| WO | WO 02/36847 | A2 | 5/2002 |
| WO | WO 02/070763 | A1 | 9/2002 |
| WO | WO 02/086172 | A1 | 10/2002 |
| WO | WO 02/090607 | A1 | 11/2002 |
| WO | WO 2004/101838 | A1 | 11/2004 |
| WO | WO 2007/084178 | A2 | 7/2007 |
| WO | WO 2007/114439 | A1 | 10/2007 |
| WO | WO 2008/017257 | A1 | 2/2008 |
| WO | WO 2010/084883 | A1 | 7/2010 |
| WO | WO 2012/063504 | A1 | 5/2012 |
| WO | WO 2012/147742 | A1 | 11/2012 |
| WO | WO 2013/081770 | A1 | 6/2013 |
| WO | WO 2013/130139 | A2 | 9/2013 |

OTHER PUBLICATIONS

"Datasheet: Timetal 21S", Alloy Digest, Advanced Materials and Processes (Sep. 1998), pp. 38-39.

"Heat Treating of Nonferrous Alloys: Heat Treating of Titanium and Titanium Alloys," Metals Handbook, ASM Handbooks Online (2002).

"Stryker Orthopaedics TMZF® Alloy (UNS R58120)", printed from www.allvac.com/allvac/pages/Titanium/UNSR58120.htm on Nov. 7, 2005.

"Technical Data Sheet: Allvac® Ti-15Mo Beta Titanium Alloy" (dated Jun. 16, 2004).

ASM Materials Engineering Dictionary, "Blasting or Blast Cleaning," J.R. Davis Ed., ASM International, Materials Park, OH (1992) p. 42.

"ASTM Designation F1801-97 Standard Practice for Corrosion Fatigue Testing of Metallic Implant Materials" ASTM International (1997) pp. 876-880.

"ASTM Designation F2066-01 Standard Specification for Wrought Titanium-15 Molybdenum Alloy for Surgical Implant Applications (UNS R58150)," ASTM International (2000) pp. 1-4.

AL-6XN® Alloy (UNS N08367) Allegheny Ludlum Corporation, 2002, 56 pages.

Allegheny Ludlum, "High Performance Metals for Industry, High Strength, High Temperature, and Corrosion-Resistant Alloys", (2000) pp. 1-8.

Allvac, Product Specification for "Allvac Ti-15 Mo," available at http://www.allvac.com/allvac/pages/Titanium/Ti15MO.htm, last visited Jun. 9, 2003 p. 1 of 1.

Altemp® A286 Iron-Base Superalloy (UNS Designation S66286) Allegheny Ludlum Technical Data Sheet Blue Sheet, 1998, 8 pages.

ASM Materials Engineering Dictionary, J.R. Davis Ed., ASM International, Materials Park, OH (1992) p. 39.

ATI Datalloy 2 Alloy, Technical Data Sheet, ATI Allvac, Monroe, NC, SS-844, Version1, Sep. 17, 2010, 8 pages.

ATI 38-644™ Beta Titanium Alloy Technical Data Sheet, UNS R58640, Version 1, Dec. 21, 2011, 4 pages.

ATI 690 (UNS N06690) Nickel-Base, ATI Allvac, Oct. 5, 2010, 1 page.

Isothermal forging definition, ASM Materials Engineering Dictionary, J.R. Davis ed., Fifth Printing, Jan. 2006, ASM International, p. 238.

Isothermal forging, printed from http://thelibraryofmanufacturing.com/isothermal_forging.html, accessed Jun. 5, 2013, 3 pages.

Adiabatic definition, ASM Materials Engineering Dictionary, J.R. Davis ed., Fifth Printing, Jan. 2006, ASM International, p. 9.

Adiabatic process—Wikipedia, the free encyclopedia, printed from http://en.wikipedia.org/wiki/Adiabatic_process, accessed May 21, 2013, 10 pages.

ASTM Designation F 2066-01, "Standard Specification for Wrought Titanium-15 Molybdenum Alloy for Surgical Implant Applications (UNS R58150)", May 2001, 7 pages.

ASTM Designation F 2066/F2066M-13, "Standard Specification for Wrought Titanium-15 Molybdenum Alloy for Surgical Implant Applications (UNS R58150)", Nov. 2013, 6 pages.

ATI 6-2-4-2™ Alloy Technical Data Sheet, Version 1, Feb. 26, 2012, 4 pages.

ATI 6-2-4-6™ Titanium Alloy Data Sheet, accessed Jun. 26, 2012.

ATI 425, High-Strength Titanium Alloy, Alloy Digest, ASM International, Jul. 2004, 2 pages.

ATI 425® Alloy Applications, retrieved from http://web.archive.org/web/20100704044024/http://www.alleghenytechnologies.com/ATI425/applications/default.asp#other, Jul. 4, 2010, Way Back Machine, 2 pages.

ATI 425® Alloy, Technical Data Sheet, retrieved from http://web.archive.org/web/20100703120218/http://www.alleghenytechnologies.com/ATI425/specifications/datasheet.asp, Jul. 3, 2010, Way Back Machine, 5 pages.

ATI 425®-MIL Alloy, Technical Data Sheet, Version 1, May 28, 2010, pp. 1-5.

ATI 425®-MIL Alloy, Technical Data Sheet, Version 2, Aug. 16, 2010, 5 pages.

ATI 425®-MIL Titanium Alloy, Mission Critical Metallics®, Version 3, Sep. 10, 2009, pp. 1-4.

ATI 425® Titanium Alloy, Grade 38 Technical Data Sheet, Version 1, Feb. 1, 2012, pp. 1-6.

ATI 425® Alloy, Grade 38, Titanium Alloy, UNS R54250, Technical Data Sheet, Version 1, Nov. 25, 2013, pp. 1-6.

ATI 500-MIL™, Mission Critical Metallics®, High Hard Specialty Steel Armor, Version 4, Sep. 10, 2009, pp. 1-4.

ATI 600-MIL®, Preliminary Draft Data Sheet, Ultra High Hard Specialty Steel Armor, Version 4, Aug. 10, 2010, pp. 1-3.

(56) References Cited

OTHER PUBLICATIONS

ATI 600-MIL™, Preliminary Draft Data Sheet, Ultra High Hard Specialty Steel Armor, Version 3, Sep. 10, 2009, pp. 1-3.
ATI Aerospace Materials Development, Mission Critical Metallics, Apr. 30, 2008, 17 pages.
ATI Ti—15Mo Beta Titanium Alloy Technical Data Sheet, ATI Allvac, Monroe, NC, Mar. 21, 2008, 3 pages.
ATI Titanium 6Al—2Sn—4Zr—2Mo Alloy, Technical Data Sheet, Version 1, Sep. 17, 2010, pp. 1-3.
ATI Titanium 6Al—4V Alloy, Mission Critical Metallics®, Technical Data Sheet, Version 1, Apr. 22, 2010, pp. 1-3.
ATI Wah Chang, ATI™ 425 Titanium Alloy (Ti—4Al—2.5V—1.5Fe—0.2502), Technical Data Sheet, 2004, pp. 1-5.
ATI Wah Chang, Titanium and Titanium Alloys, Technical Data Sheet, 2003, pp. 1-16.
Beal et al., "Forming of Titanium and Titanium Alloys-Cold Forming", ASM Handbook, 2006, ASM International, vol. 14B, 2 pages.
Beal et al., "Forming of Titanium and Titanium Alloys-Cold Forming", ASM Handbook, 2006, ASM International, Revised by ASM Committee on Forming Titanium Alloys, vol. 14B, 2 pages.
Beal et al., "Forming of Titanium and Titanium Alloys-Cold Forming", ASM Handbook, 2006, vol. 14B, pp. 656-669.
Bewlay, et al., "Superplastic roll forming of Ti alloys", Materials and Design, 21, 2000, pp. 287-295.
Bowen, A. W., "Omega Phase Embrittlement in Aged Ti-15%Mo," Scripta Metallurgica, vol. 5, No. 8 (1971) pp. 709-715.
Bowen, A. W., "On the Strengthening of A Metastable b-Titanium Alloy by w- and a-Precipitation" Royal Aircraft Establishment Technical Memorandum Mat 338, (1980) pp. 1-15 and Figs 1-5.
Boyer, Rodney R., "Introduction and Overview of Titanium and Titanium Alloys: Applications," Metals Handbook, ASM Handbooks Online (2002).
Boyko et al., "Modeling of the Open-Die and Radial Forging Processes for Alloy 718", Superalloys 718, 625 and Various Derivatives: Proceedings of the International Symposium on the Metallurgy and Applications of Superalloys 718, 625 and Various Derivatives, held Jun. 23, 1992, pp. 107-124.
Cain, Patrick, "Warm forming aluminum magnesium components; How it can optimize formability, reduce springback", Aug. 1, 2009, from http://www.thefabricator.com/article/presstechnology/warm-forming-aluminum-magnesium-components, 3 pages.
Callister, Jr., William D., Materials Science and Engineering, An Introduction, Sixth Edition, John Wiley & Sons, pp. 180-184 (2003).
Craighead et al., "Ternary Alloys of Titanium", Journal of Metals, Mar. 1950, Transactions AIME, vol. 188, pp. 514-538.
Craighead et al., "Titanium Binary Alloys", Journal of Metals, Mar. 1950, Transactions AIME, vol. 188, pp. 485-513.
Desrayaud et al., "A novel high straining process for bulk materials—The development of a multipass forging system by compression along three axes", Journal of Materials Processing Technology, 172, 2006, pp. 152-158.
Diderrich et al., "Addition of Cobalt to the Ti—6Al—4V Alloy", Journal of Metals, May 1968, pp. 29-37.
DiDomizio, et al., "Evaluation of a Ni-20Cr Alloy Processed by Multi-axis Forging", Materials Science Forum vols. 503-504, 2006, pp. 793-798.
Disegi, J. A., "Titanium Alloys for Fracture Fixation Implants," Injury International Journal of the Care of the Injured, vol. 31 (2000) pp. S-D14-17.
Disegi, John, Wrought Titanium-15% Molybdenum Implant Material, Original Instruments and Implants of the Association for the Study of International Fixation—AO ASIF, Oct. 2003.
Donachie Jr., M.J., "Titanium a Technical Guide" 1988, ASM, pp. 39 and 46-50.
Donachie Jr., M.J., "Heat Treating Titanium and Its Alloys", Heat Treating Process, Jun./Jul. 2001, pp. 47-49, 52-53, and 56-57.
Duflou et al., "A method for force reduction in heavy duty bending", Int. J. Materials and Product Technology, vol. 32, No. 4, 2008, pp. 460-475.
Elements of Metallurgy and Engineering Alloys, Editor F. C. Campbell, ASM International, 2008, Chapter 8, p. 125.
Fedotov, S.G. et al., "Effect of Aluminum and Oxygen on the Formation of Metastable Phases in Alloys of Titanium with .beta.-Stabilizing Elements", Izvestiya Akademii Nauk SSSR, Metally (1974) pp. 121-126.
Froes, F.H. et al., "The Processing Window for Grain Size Control in Metastable Beta Titanium Alloys", Beta Titanium Alloys in the 80's, ed. by R. Boyer and H. Rosenberg, AIME, 1984, pp. 161-164.
Gigliotti et al., "Evaluation of Superplastically Roll Formed VT-25", Titamium'99, Science and Technology, 2000, pp. 1581-1588.
Gilbert et al., "Heat Treating of Titanium and Titanium Alloys—Solution Treating and Aging", ASM Handbook, 1991, ASM International, vol. 4, pp. 1-8.
Glazunov et al., Structural Titanium Alloys, Moscow, Metallurgy, 1974, pp. 264-283.
Greenfield, Dan L., News Release, ATI Aerospace Presents Results of Year-Long Characterization Program for New ATI 425 Alloy Titanium Products at Aeromat 2010, Jun. 21, 2010, Pittsburgh, Pennsylvania, 1 page.
Harper, Megan Lynn, "A Study of the Microstructural and Phase Evolutions in Timetal 555", Jan. 2004, retrieved from http://www.ohiolink.edu/etd/send-pdf.cgi/harper%20megan%20lynn.pdf?acc_num=osu1132165471 on Aug. 10, 2009, 92 pages.
Hawkins, M.J. et al., "Osseointegration of a New Beta Titanium Alloy as Compared to Standard Orthopaedic Implant Metals," Sixth World Biomaterials Congress Transactions, Society for Biomaterials, 2000, p. 1083.
Ho, W.F. et al., "Structure and Properties of Cast Binary Ti—Mo Alloys" Biomaterials, vol. 20 (1999) pp. 2115-2122.
Hsieh, Chih-Chun and Weite Wu, "Overview of Intermetallic Sigma Phase Precipitation in Stainless Steels", ISRN Metallurgy, vol. 2012, 2012, pp. 1-16.
Imatani et al., "Experiment and simulation for thick-plate bending by high frequency inductor", ACTA Metallurgica Sinica, vol. 11, No. 6, Dec. 1998, pp. 449-455.
Imayev et al., "Formation of submicrocrystalline structure in TiAl intermetallic compound", Journal of Materials Science, 27, 1992, pp. 4465-4471.
Imayev et al., "Principles of Fabrication of Bulk Ultrafine-Grained and Nanostructured Materials by Multiple Isothermal Forging", Materials Science Forum, vols. 638-642, 2010, pp. 1702-1707.
Imperial Metal Industries Limited, Product Specification for "IMI Titanium 205", The Kynoch Press (England) pp. 1-5. (1965).
Jablokov et al., "Influence of Oxygen Content on the Mechanical Properties of Titanium-35Niobium-7Zirconium-5Tantalum Beta Titanium Alloy," Journal of ASTM International, Sep. 2005, vol. 2, No. 8, 2002, pp. 1-12.
Jablokov et al., "The Application of Ti-15 Mo Beta Titanium Alloy in High Strength Orthopaedic Applications", Journal of ASTM International, vol. 2, Issue 8 (Sep. 2005) (published online Jun. 22, 2005).
Kovtun, et al., "Method of calculating induction heating of steel sheets during thermomechanical bending", Kiev, Nikolaev, translated from Problemy Prochnosti, No. 5, pp. 105-110, May 1978, original article submitted Nov. 27, 1977, pp. 600-606.
Lampman, S., "Wrought and Titanium Alloys," ASM Handbooks Online, ASM International, 2002.
Lee et al., "An electromagnetic and thermo-mechanical analysis of high frequency induction heating for steel plate bending", Key Engineering Materials, vols. 326-328, 2006, pp. 1283-1286.
Lemons, Jack et al., "Metallic Biomaterials for Surgical Implant Devices," BONEZone, Fall (2002) p. 5-9 and Table.
Long, M. et al., "Friction and Surface Behavior of Selected Titanium Alloys During Reciprocating-Sliding Motion", WEAR, 249(1-2), Jan. 17, 2001, 158-168.
Lütjering, G. and J.C. Williams, Titanium, Springer, New York (2nd ed. 2007) p. 24.
Lutjering, G. and Williams, J.C., Titanium, Springer-Verlag, 2003, Ch. 5: Alpha+Beta Alloys, p. 177-201.

(56) References Cited

OTHER PUBLICATIONS

Marquardt et al., "Beta Titanium Alloy Processed for High Strength Orthopaedic Applications,"Journal of ASTM International, vol. 2, Issue 9 (Oct. 2005) (published online Aug. 17, 2005).
Marquardt, Brian, "Characterization of Ti—15Mo for Orthopaedic Applications,"TMS 2005 Annual Meeting: Technical Program, San Francisco, CA, Feb. 13-17, 2005 Abstract, p. 239.
Marquardt, Brian, "Ti—15Mo Beta Titanium Alloy Processed for High Strength Orthopaedic Applications," Program and Abstracts for the Symposium on Titanium, Niobium, Zirconium, and Tantalum for Medical and Surgical Applications, Washington, D.C., Nov. 9-10, 2004 Abstract, p. 11.
Marte et al., "Structure and Properties of Ni-20CR Produced by Severe Plastic Deformation", Ultrafine Grained Materials IV, 2006, pp. 419-424.
Materials Properties Handbook: Titanium Alloys, Eds. Boyer et al, ASM International, Materials Park, OH, 1994, pp. 524-525.
Martinelli, Gianni and Roberto Peroni, "Isothermal forging of Ti-alloys for medical applications", Presented at the 11th World Conference on Titanium, Kyoto, Japan, Jun. 4-7, 2007, accessed Jun. 5, 2013, 5 pages.
McDevitt, et al., Characterization of the Mechanical Properties of ATI 425 Alloy According to the Guidelines of the Metallic Materials Properties Development & Standardization Handbook, Aeromat 2010 Conference and Exposition: Jun. 20-24, 2010, Bellevue, WA, 23 pages.
Metals Handbook, Desk Edition, 2nd ed., J. R. Davis ed., ASM International, Materials Park, Ohio (1998), pp. 575-588.
Military Standard, Fastener Test Methods, Method 13, Double Shear Test, MIL-STD-1312-13, Jul. 26, 1985, superseding MIL-STD-1312 (in part) May 31, 1967, 8 pages.
Military Standard, Fastener Test Methods, Method 13, Double Shear Test, MIL-STD-1312-13A, Aug. 23, 1991, superseding MIL-STD-13, Jul. 26, 1985, 10 pages.
Murray, J.L., et al., Binary Alloy Phase Diagrams, Second Edition, vol. 1, Ed. Massalski, Materials Park, OH; ASM International; 1990, p. 547.
Murray, J.L., The Mn—Ti (Manganese-Titanium) System, Bulletin of Alloy Phase Diagrams, vol. 2, No. 3 (1981) p. 334-343.
Myers, J., "Primary Working, a lesson from Titanium and its Alloys," ASM Course Book 27 Lesson, Test 9, Aug. 1994, pp. 3-4.
Naik, Uma M. et al., "Omega and Alpha Precipitation in Ti—15Mo Alloy,"Titanium '80 Science and Technology—Proceedings of the 4th International Conference on Titanium, H. Kimura & O. Izumi Eds. May 19-22, 1980 pp. 1335-1341.
Nguyen et al., "Analysis of bending deformation in triangle heating of steel plates with induction heating process using laminated plate theory", Mechanics Based Design of Structures and Machines, 37, 2009, pp. 228-246.
Nishimura, T. "Ti—15Mo—5Zr—3Al", Materials Properties Handbook: Titanium Alloys, eds. R. Boyer et al., ASM International, Materials Park, OH, 1994, p. 949.
Novikov et al., 17.2.2 Deformable ($\alpha+\beta$) alloys, Chapter 17, Titanium and its Alloys, Metal Science, vol. II Thermal Treatment of the Alloy, Physical Matallurgy, 2009, pp. 357-360.
Nutt, Michael J. et al., The Application of Ti-15 Beta Titanium Alloy in High Strength Structural Orthopaedic Applications, Program and Abstracts for the Symposium on Titanium Niobium, Zirconium, and Tantalum for Medical and Surgical Applications, Washington, D.C., Nov. 9-10, 2004 Abstract, p. 12.
Nyakana, et al., "Quick Reference Guide for β Titanium Alloys in the 00s", Journal of Materials Engineering and Performance, vol. 14, No. 6, Dec. 1, 2005, pp. 799-811.
Pennock, G.M. et al., "The Control of a Precipitation by Two Step Ageing in β Ti—15Mo," Titanium '80 Science and Technology—Proceedings of the 4th International Conference on Titanium, H. Kimura & O. Izumi Eds. May 19-22, 1980 pp. 1344-1350.
Prasad, Y.V.R.K. et al. "Hot Deformation Mechanism in Ti—6Al—4V with Transformed B Starting Microstructure: Commercial v. Extra Low Interstitial Grade", Materials Science and Technology, Sep. 2000, vol. 16, pp. 1029-1036.
Qazi, J.I. et al., "High-Strength Metastable Beta-Titanium Alloys for Biomedical Applications," JOM, Nov. 2004 pp. 49-51.
Roach, M.D., et al., "Comparison of the Corrosion Fatigue Characteristics of CPTi-Grade 4, Ti—6A1—4V ELI, Ti—6A1-7 Nb, and Ti-15 Mo", Journal of Testing and Evaluation, vol. 2, Issue 7, (Jul./Aug. 2005) (published online Jun. 8, 2005).
Roach, M.D., et al., "Physical, Metallurgical, and Mechanical Comparison of a Low-Nickel Stainless Steel," Transactions on the 27th Meeting of the Society for Biomaterials, Apr. 24-29, 2001, p. 343.
Roach, M.D., et al., "Stress Corrosion Cracking of a Low-Nickel Stainless Steel," Transactions of the 27th Annual Meeting of the Society for Biomaterials, 2001, p. 469.
Rudnev et at., "Longitudinal flux indication heating of slabs, bars and strips is no longer "Black Magic:" II", Industrial Heating, Feb. 1995, pp. 46-48 and 50-51.
Russo, P.A., "Influence of Ni and Fe on the Creep of Beta Annealed Ti-6242S", Titanium '95: Science and Technology, pp. 1075-1082.
SAE Aerospace Material Specification 4897A (issued Jan. 1997, revised Jan. 2003).
SAE Aerospace, Aerospace Material Specification, Titanium Alloy Bars, Forgings and Forging Stock, 6.0Al—4.0V Annealed, AMS 6931A, Issued Jan. 2004, Revised Feb. 2007, pp. 1-7.
SAE Aerospace, Aerospace Material Specification, Titanium Alloy Bars, Forgings and Forging Stock, 6.0Al—4.0V, Solution Heat Treated and Aged, AMS 6930A, Issued Jan. 2004, Revised Feb. 2006, pp. 1-9.
SAE Aerospace, Aerospace Material Specification, Titanium Alloy, Sheet, Strip, and Plate, 4Al—2.5V—1.5Fe, Annealed, AMS 6946A, Issued Oct. 2006, Revised Jun. 2007, pp. 1-7.
Salishchev et al., "Characterization of Submicron-grained Ti—6Al—4V Sheets with Enhanced Superplastic Properties", Materials Science Forum, Trans Tech Publications, Switzerland, vols. 447-448, 2004, pp. 441-446.
Salishchev et al., "Mechanical Properties of Ti—6Al—4V Titanium Alloy with Submicrocrystalline Structure Produced by Multiaxial Forging", Materials Science Forum, vols. 584-586, 2008, pp. 783-788.
Salishchev, et al., "Effect of Deformation Conditions on Grain Size and Microstructure Homogeneity of β-Rich Titanium Alloys", Journal of Materials Engineering and Performance, vol. 14(6), Dec. 2005, pp. 709-716.
Salishchev, G.A., "Formation of submicrocrystalline structure in large size billets and sheets out of titanium alloys", Institute for Metals Superplasticity Problems,Ufa, Russia, presented at 2003 NATO Advanced Research Workshop, Kyiv, Ukraine, Sep. 9-13, 2003, 50 pages.
Semiatin, S.L. et al., "The Thermomechanical Processing of Alpha/Beta Titanium Alloys," Journal of Metals, Jun. 1997, pp. 33-39.
Semiatin et al., "Equal Channel Angular Extrusion of Difficult-to-Work Alloys", Materials & Design, Elsevier Science Ltd., 21, 2000, pp. 311-322.
Semiatin et al., "Alpha/Beta Heat Treatment of a Titanium Alloy with a Nonuniform Microstructure", Metallurgical and Materials Transactions A, vol. 38A, Apr. 2007, pp. 910-921.
Shahan et al., "Adiabatic shear bands in titanium and titanium alloys: a critical review", Materials & Design, vol. 14, No. 4, 1993, pp. 243-250.
SPS Titanium™ Titanium Fasteners, SPS Technologies Aerospace Fasteners, 2003, 4 pages.
Standard Specification for Wrought Titanium-6Aluminum-4Vanadium Alloy for Surgical Implant Applications (UNS R56400), Designation: F 1472-99, ASTM 1999, pp. 1-4.
Swann, P.R. and J. G. Parr, "Phase Transformations in Titanium-Rich Alloys of Titanium and Cobalt", Transactions of the Metallurgical Society of AIME, Apr. 1958, pp. 276-279.
Takemoto Yet al., "Tensile Behavior and Cold Workability of Ti—Mo Alloys", Materials Transactions Japan Inst. Metals Japan, vol. 45, No. 5, May 2004, pp. 1571-1576.

(56) References Cited

OTHER PUBLICATIONS

Tamarisakandala, S. et al., "Strain-induced Porosity During Cogging of Extra-Low Interstitial Grade Ti—6Al—4V", Journal of Materials Engineering and Performance, vol. 10(2), Apr. 2001, pp. 125-130.
Tamirisakandala et al., "Effect of boron on the beta transus of Ti—6Al—4V alloy", Scripta Materialia, 53, 2005, pp. 217-222.
Tamirisakandala et al., "Powder Metallurgy Ti—6Al—4V-xB Alloys: Processing, Microstructure, and Properties", JOM, May 2004, pp. 60-63.
Tebbe, Patrick A. and Ghassan T. Kridli, "Warm forming aluminum alloys: an overview and future directions", Int. J. Materials and Product Technology, vol. 21, Nos. 1-3, 2004, pp. 24-40.
Technical Presentation: Overview of MMPDS Characterization of ATI 425 Alloy, 2012, 1 page.
Ti—6Al—4V, Ti64, 6Al—4V, 6-4, UNS R56400, 1 page.
TIMET 6-6-2 Titanium Alloy (Ti—6Al—6V—2Sn), Annealed, accessed Jun. 27, 2012.
TIMET TIMETAL® 6-2-4-2 (Ti—6Al—2Sn—4Zr—2Mo—0.08Si) Titanium Alloy datasheet, accessed Jun. 26, 2012.
TIMET TIMETAL® 6-2-4-6 Titanium Alloy (Ti—6Al—25n—4Zr—6Mo), Typical, accessed Jun. 26, 2012.
Titanium 3Al—8V—6Cr—4Mo—4Zr Beta-C/Grade 19 UNS R58640, 2 pages.
Tokaji, Keiro et al., "The Microstructure Dependence of Fatigue Behavior in Ti—15Mo—5Zr—3Al Alloy," Materials Science and Engineering A., vol. 213 (1996) pp. 86-92.
Two new α-βtitanium alloys, KS Ti-9 for sheet and KS EL-F for forging, with mechanical properties comparable to Ti—6Al—4V, Oct. 8, 2002, ITA 2002 Conference in Orlando, Hideto Oyama, Titanium Technology Dept., Kobe Steel, Ltd., 16 pages.
Veeck, S., et al., "The Castability of Ti-5553 Alloy," Advanced Materials and Processes, Oct. 2004, pp. 47-49.
Weiss, I. et al., "The Processing Window Concept of Beta Titanium Alloys", Recrystallization '90, ed. by T. Chandra, The Minerals, Metals & Materials Society, 1990, pp. 609-616.
Weiss, I. et al., "Thermomechanical Processing of Beta Titanium Alloys—An Overview," Material Science and Engineering, A243, 1998, pp. 46-65.
Williams, J., Thermo-mechanical processing of high-performance Ti alloys: recent progress and future needs, Journal of Material Processing Technology, 117 (2001), p. 370-373.
Yakymyshyn et al., "The Relationship between the Constitution and Mechanical Properties of Titanium-Rich Alloys of Titanium and Cobalt", 1961, vol. 53, pp. 283-294.
Zardiackas, L.D. et al., "Stress Corrosion Cracking Resistance of Titanium Implant Materials," Transactions of the 27th Annual Meeting of the Society for Biomaterials, (2001).
Zeng et al., Evaluation of Newly Developed Ti-555 High Strength Titanium Fasteners, 17th AeroMat Conference & Exposition, May 18, 2006, 2 pages.
Zhang et al., "Simulation of slip band evolution in duplex Ti—6Al—4V", Acta Materialia, vol. 58, (2010), Nov. 26, 2009, pp. 1087-1096.
Zherebtsov et al., "Production of submicrocrystalline structure in large-scale Ti—6Al—4V billet by warm severe deformation processing", Scripta Materialia, 51, 2004, pp. 1147-1151.
Titanium Alloy, Sheet, Strip, and Plate 4Al—2.5V—1.5Fe, Annealed, AMS6946 Rev. B, Aug. 2010, SAE Aerospace, Aerospace Material Specification, 7 pages.
Titanium Alloy, Sheet, Strip, and Plate 6Al—4V, Annealed, AMS 4911L, Jun. 2007, SAE Aerospace, Aerospace Material Specification, 7 pages.
E112-12 Standard Test Methods for Determining Average Grain Size, ASTM International, Jan. 2013, 27 pages.
ATI Datalloy 2 Alloy, Technical Data Sheet, ATI Properties, Inc., Version 1, Jan. 24, 2013, 6 pages.
ATI AL-6XN® Alloy (UNS N08367), ATI Allegheny Ludlum, 2010, 59 pages.
ATI 800™4/ATI 800H™/ATI 800AT™ ATI Technical Data Sheet, Nickel-base Alloys (UNS N08800/N08810/N08811), 2012 Allegheny Technologies Incorporated, Version 1, Mar. 9, 2012, 7 pages.
ATI 825™ Technical Data Sheet, Nickel-base Alloy (UNS N08825), 2013 Allegheny Technologies Incorporated, Version 2, Mar. 8, 2013, 5 pages.
ATI 625™ Alloy Technical Data Sheet, High Strength Nickel-base Alloy (UNS N06625), Allegheny Technologies Incorporated, Version 1, Mar. 4, 2012, 3 pages.
ATI 600™ Technical Data Sheet, Nickel-base Alloy (UNS N06600), 2012 Allegheny Technologies Incorporated, Version 1, Mar. 19, 2012, 5 pages.
Bar definition, ASM Materials Engineering Dictionary, J.R. Davis Ed., ASM International, Materials Park, OH (1992) p. 32.
Billet definition, ASM Materials Engineering Dictionary, J.R. Davis Ed., ASM International, Materials Park, OH (1992) p. 40.
Cogging definition, ASM Materials Engineering Dictionary, J.R. Davis Ed., ASM International, Materials Park, OH (1992) p. 79.
Open die press forging definition, ASM Materials Engineering Dictionary, J.R. Davis Ed., ASM International, Materials Park, OH (1992) pp. 298 and 343.
Thermomechanical working definition, ASM Materials Engineering Dictionary, J.R. Davis Ed., ASM International, Materials Park, OH (1992) p. 480.
Ductility definition, ASM Materials Engineering Dictionary, J.R. Davis Ed., ASM International, Materials Park, OH (1992) p. 131.
AFML-TR-76-80 Development of Titanium Alloy Casting Technology, Aug. 1976, 5 pages.
Valiev et al., "Nanostructured materials produced by sever plastic deformation", Moscow, LOGOS, 2000.
Li et al., "The optimal determination of forging process parameters for Ti—6.5Al—3.5Mo—1.5Zr—0.3Si alloy with thick lamellar microstructure in two phase field based on P-map", Journal of Materials Processing Technology, vol. 210, Issue 2, Jan. 19, 2010, pp. 370-377.
Buijk, A., "Open-Die Forging Simulation", Forge Magazine, Dec. 1, 2013, 5 pages.
Herring, D., "Grain Size and Its Influence on Materials Properties", IndustrialHeating.com, Aug. 2005, pp. 20 and 22.
INCONEL® alloy 600, Special Metals Corporation, www.specialmetals.com, Sep. 2008, 16 pages.
Yaylaci et al., "Cold Working & Hot Working & Annealing", http://yunus.hacettepe.edu.tr/~selis/teaching/WEBkmu479/Ppt/kmu479Presentations2010/Cold_Hot_Working_Annealing.pdf, 2010, 41 pages.
Superaustenitic, http://www.atimetals.com/products/Pages/superaustenitic.aspx, Nov. 9, 2015, 3 pages.
French, D., "Austenitic Stainless Steel", The National Board of Boiler and Pressure Vessel Inspectors Bulletin, 1992, 3 pages.
Acom Magazine, outokumpu, NACE International, Feb. 2013, 16 pages.
ATI A286™ Iron Based Superalloy (UNS S66286) Technical Data Sheet, Allegheny Technologies Incorporated, Version 1, Apr. 17, 2012, 9 pages.
ATI A286™ (UNS S66286) Technical Data Sheet, Allegheny Technologies Incorporated, Version 1, Mar. 14, 2012, 3 pages.
Corrosion-Resistant Titanium, Technical Data Sheet, Allegheny Technologies Incorporated, Version 1, Feb. 29, 2012, 5 pages.
ATI 3-2.5™ Titanium (Ti Grade 9) Technical Data Sheet, ATI Wah Chang, 2010, 4 pages.
Grade 9 Ti 3Al 2.5V Alloy (UNS R56320), Jul. 30, 2013, http://www.azom.com/article.aspx?ArticleID=9337, 3 pages.
ATI Ti—6Al—4V, Grade 5, Titanium Alloy (UNS R56400) Technical Data Sheet, Allegheny Technologies Incorporated, Version 1, Jan. 31, 2012, 4 pages.
Panin et al., "Low-cost Titanium Alloys for Titanium-Polymer Layered Composites", 29th Congress of the International Council of the Aeronautical Sciences, St. Petersburg, Russia, Sep. 7, 2014, 4 pages.
Grade Ti—4.5Al—3V—2Mo—2Fe Alloy, Jul. 9, 2013, http://www.azom.com/article.aspx?ArticleID=9448, 2 pages.

(56) References Cited

OTHER PUBLICATIONS

Garside et al., "Mission Critical Metallics® Recent Developments in High-Strength Titanium Fasteners for Aerospace Applications", ATI, 2013, 21 pages.
Foltz et al., "Recent Developments in High-Strength Titanium Fasteners for Aerospace Applications", ATI, Oct. 22, 2014, 17 pages.
Kosaka et al., "Superplastic Forming Properties of TIMETAL ® 54M", Henderson Technical Laboratory, Titanium Metals Corporation, ITA, Oct. 2010, Orlando, Florida, 18 pages.
ATI Datalloy HP™ Alloy, UNS N08830, Technical Data Sheet Version 1, Apr. 14, 2015, 6 pages.
ATI Datalloy 2® Alloy, Technical Data Sheet, Version 1, Feb. 20, 2014, 6 pages.
Handa, Sukhdeep Singh, "Precipitation of Carbides in a Ni-based Superalloy", Degree Project for Master of Science with Specialization in Manufacturing Department of Engineering Science, University West, Jun. 30, 2014, 42 pages.
Office Action mailed Oct. 19, 2011 in U.S. Appl. No. 12/691,952.
Office Action mailed Feb. 2, 2012 in U.S. Appl. No. 12/691,952.
Office Action mailed Dec. 23, 2014 in U.S. Appl. No. 12/691,952.
Office Action mailed Apr. 23, 2015 in U.S. Appl. No. 12/691,952.
Office Action mailed Jul. 28, 2015 in U.S. Appl. No. 12/691,952.
Office Action mailed Feb. 17, 2016 in U.S. Appl. No. 12/691,952.
Office Action mailed Jun. 28, 2016 in U.S. Appl. No. 12/691,952.
Office Action mailed Feb. 20, 2004 in U.S. Appl. No. 10/165,348.
Office Action mailed Oct. 26, 2004 in U.S. Appl. No. 10/165,348.
Office Action mailed Feb. 16, 2005 in U.S. Appl. No. 10/165,348.
Office Action mailed Jul. 25, 2005 in U.S. Appl. No. 10/165,348.
Office Action mailed Jan. 3, 2006 in U.S. Appl. No. 10/165,348.
Office Action mailed Dec. 16, 2004 in U.S. Appl. No. 10/434,598.
Office Action mailed Aug. 17, 2005 in U.S. Appl. No. 10/434,598.
Office Action mailed Dec. 19, 2005 in U.S. Appl. No. 10/434,598.
Office Action mailed Sep. 6, 2006 in U.S. Appl. No. 10/434,598.
Office Action mailed Aug. 6, 2008 in U.S. Appl. No. 11/448,160.
Office Action mailed Jan. 13, 2009 in U.S. Appl. No. 11/448,160.
Notice of Allowance mailed Apr. 13, 2010 in U.S. Appl. No. 11/448,160.
Notice of Allowance mailed Sep. 20, 2010 in U.S. Appl. No. 11/448,160.
Office Action mailed Sep. 26, 2007 in U.S. Appl. No. 11/057,614.
Office Action mailed Jan. 10, 2008 in U.S. Appl. No. 11/057,614.
Office Action mailed Aug. 29, 2008 in U.S. Appl. No. 11/057,614.
Office Action mailed Aug. 11, 2009 in U.S. Appl. No. 11/057,614.
Office Action mailed Jan. 14, 2010 in U.S. Appl. No. 11/057,614.
Interview summary mailed Apr. 14, 2010 in U.S. Appl. No. 11/057,614.
Office Action mailed Jun. 21, 2010 in U.S. Appl. No. 11/057,614.
Notice of Allowance mailed Sep. 3, 2010 in U.S. Appl. No. 11/057,614.
Office Action mailed Apr. 1, 2010 in U.S. Appl. No. 11/745,189.
Interview summary mailed Jun. 3, 2010 in U.S. Appl. No. 11/745,189.
Interview summary mailed Jun. 15, 2010 in U.S. Appl. No. 11/745,189.
Office Action mailed Nov. 24, 2010 in U.S. Appl. No. 11/745,189.
Interview summary mailed Jan. 6, 2011 in U.S. Appl. No. 11/745,189.
Notice of Allowance mailed Jun. 27, 2011 in U.S. Appl. No. 11/745,189.
Office Action mailed Jan. 11, 2011 in U.S. Appl. No. 12/911,947.
Office Action mailed Aug. 4, 2011 in U.S. Appl. No. 12/911,947.
Office Action mailed Nov. 16, 2011 in U.S. Appl. No. 12/911,947.
Advisory Action mailed Jan. 25, 2012 in U.S. Appl. No. 12/911,947.
Notice of Panel Decision from Pre-Appeal Brief Review mailed Mar. 28, 2012 in U.S. Appl. No. 12/911,947.
Office Action mailed Apr. 5, 2012 in U.S. Appl. No. 12/911,947.
Office Action mailed Sep. 19, 2012 in U.S. Appl. No. 12/911,947.
Advisory Action mailed Nov. 29, 2012 in U.S. Appl. No. 12/911,947.
Office Action mailed May 31, 2013 in U.S. Appl. No. 12/911,947.
Notice of Allowance mailed Oct. 4, 2013 in U.S. Appl. No. 12/911,947.
Office Action mailed Jan. 3, 2011 in U.S. Appl. No. 12/857,789.
Office Action mailed Jul. 27, 2011 in U.S. Appl. No. 12/857,789.
Advisory Action mailed Oct. 7, 2011 in U.S. Appl. No. 12/857,789.
Notice of Allowance mailed Jul. 1, 2013 in U.S. Appl. No. 12/857,789.
Office Action mailed Nov. 14, 2012 in U.S. Appl. No. 12/885,620.
Office Action mailed Jun. 13, 2013 in U.S. Appl. No. 12/885,620.
Office Action mailed Nov. 19, 2013 in U.S. Appl. No. 12/885,620.
Advisory Action Before the Filing of an Appeal Brief mailed Jan. 30, 2014 in U.S. Appl. No. 12/885,620.
Office Action mailed Jun. 18, 2014 in U.S. Appl. No. 12/885,620.
Office Action mailed Nov. 28, 2014 in U.S. Appl. No. 12/885,620.
Advisory Action mailed May 18, 2015 in U.S. Appl. No. 12/885,620.
Office Action mailed Jun. 30, 2015 in U.S. Appl. No. 12/885,620.
Notice of Abandonment mailed Jan. 29, 2016 in U.S. Appl. No. 12/885,620.
Office Action mailed Nov. 14, 2012 in U.S. Appl. No. 12/888,699.
Office Action mailed Oct. 3, 2012 in U.S. Appl. No. 12/838,674.
Office Action mailed Jul. 18, 2013 in U.S. Appl. No. 12/838,674.
Office Action mailed May 27, 2015 in U.S. Appl. No. 12/838,674.
Applicant Initiated Interview Summary mailed Sep. 1, 2015 in U.S. Appl. No. 12/838,674.
Notice of Allowance mailed Sep. 25, 2015 in U.S. Appl. No. 12/838,674.
Office Action mailed Sep. 26, 2012 in U.S. Appl. No. 12/845,122.
Notice of Allowance mailed Apr. 17, 2013 in U.S. Appl. No. 12/845,122.
Office Action mailed Dec. 24, 2012 in U.S. Appl. No. 13/230,046.
Notice of Allowance mailed Jul. 31, 2013 in U.S. Appl. No. 13/230,046.
Office Action mailed Dec. 26, 2012 in U.S. Appl. No. 13/230,143.
Notice of Allowance mailed Aug. 2, 2013 in U.S. Appl. No. 13/230,143.
Office Action mailed Mar. 1, 2013 in U.S. Appl. No. 12/903,851.
Office Action mailed Jan. 16, 2014 in U.S. Appl. No. 12/903,851.
Office Action mailed Oct. 6, 2014 in U.S. Appl. No. 12/903,851.
Office Action mailed Jul. 15, 2015 in U.S. Appl. No. 12/903,851.
Office Action mailed Mar. 25, 2013 in U.S. Appl. No. 13/108,045.
Office Action mailed Jan. 17, 2014 in U.S. Appl. No. 13/108,045.
Office Action mailed Mar. 30, 2016 in U.S. Appl. No. 13/108,045.
Office Action mailed Apr. 16, 2013 in U.S. Appl. No. 13/150,494.
Office Action mailed Jun. 14, 2013 in U.S. Appl. No. 13/150,494.
Notice of Allowance mailed Nov. 5, 2013 in U.S. Appl. No. 13/150,494.
Supplemental Notice of Allowability mailed Jan. 17, 2014 in U.S. Appl. No. 13/150,494.
U.S. Appl. No. 13/331,135, filed Dec. 20, 2011.
Office Action mailed Jan. 21, 2015 in U.S. Appl. No. 13/792,285.
Office Action mailed Jun. 4, 2015 in U.S. Appl. No. 13/792,285.
Notice of Allowance mailed Sep. 16, 2015 in U.S. Appl. No. 13/792,285.
Response to Rule 312 Communication mailed Oct. 20, 2015 in U.S. Appl. No. 13/792,285.
Notice of Allowance mailed Oct. 24, 2014 in U.S. Appl. No. 13/844,545.
Notice of Allowance mailed Feb. 6, 2015 in U.S. Appl. No. 13/844,545.
Office Action mailed Jan. 23, 2013 in U.S. Appl. No. 12/882,538.
Office Action mailed Feb. 8, 2013 in U.S. Appl. No. 12/882,538.
Notice of Allowance mailed Jun. 24, 2013 in U.S. Appl. No. 12/882,538.
Office Action mailed Sep. 6, 2013 in U.S. Appl. No. 13/933,222.
Notice of Allowance mailed Oct. 1, 2013 in U.S. Appl. No. 13/933,222.
Notice of Allowance mailed May 6, 2014 in U.S. Appl. No. 13/933,222.
Office Action mailed Jun. 3, 2015 in U.S. Appl. No. 13/714,465.
Office Action mailed Jul. 8, 2015 in U.S. Appl. No. 13/714,465.

(56) References Cited

OTHER PUBLICATIONS

Notice of Allowance mailed Sep. 2, 2015 in U.S. Appl. No. 13/714,465.
Response to Rule 312 Communication mailed Sep. 29, 2015 in U.S. Appl. No. 13/714,465.
Response to Rule 312 Communication mailed Oct. 8, 2015 in U.S. Appl. No. 13/714,465.
Office Action mailed Jun. 26, 2015 in U.S. Appl. No. 13/777,066.
Office Action mailed Oct. 5, 2015 in U.S. Appl. No. 13/777,066.
Advisory Action Before the Filing of an Appeal Brief mailed Mar. 17, 2016 in U.S. Appl. No. 13/777,066.
Office Action mailed Jul. 22, 2016 in U.S. Appl. No. 13/777,066.
Office Action mailed Aug. 19, 2015 in U.S. Appl. No. 13/844,196.
Office Action mailed Oct. 15, 2015 in U.S. Appl. No. 13/844,196.
Office Action mailed Feb. 12, 2016 in U.S. Appl. No. 13/844,196.
Advisory Action Before the Filing of an Appeal Brief mailed Jun. 15, 2016 in U.S. Appl. No. 13/844,196.
Office Action mailed Oct. 2, 2015 in U.S. Appl. No. 14/073,029.
Office Action mailed Oct. 28, 2015 in U.S. Appl. No. 14/093,707.
Office Action mailed Mar. 17, 2016 in U.S. Appl. No. 14/093,707.
Advisory Action Before the Filing of an Appeal Brief mailed Jun. 10, 2016 in U.S. Appl. No. 14/093,707.
Notice of Third-Party Submission mailed Dec. 16, 2015 in U.S. Appl. No. 14/077,699.
Office Action mailed Jul. 25, 2016 in U.S. Appl. No. 14/077,699.
Office Action mailed Mar. 16, 2016 in U.S. Appl. No. 15/005,281.
U.S. Appl. No. 14/948,941, filed Nov. 23, 2015.
Office Action mailed Apr. 5, 2016 in U.S. Appl. No. 14/028,588.
Office Action mailed Apr. 13, 2016 in U.S. Appl. No. 14/083,759.
Office Action mailed May 6, 2016 in U.S. Appl. No. 14/083,759.
Titanium Alloy Guide, RMI Titanium Company, Jan. 2000, 45 pages.
Wanhill et al, "Chapter 2, Metallurgy and Microstructure", Fatigue of Beta Processed and Beta Heat-treated Titanium Alloys, SpringerBriefs in Applied Sciences and Technology, 2012, pp. 5-10.
Heat Treating of Titanium and Titanium Alloys, http://www.totalmateria.com/Article97.htm, Apr. 2004, 5 pages.
Grade 6Al 2Sn 4Zr 6Mo Titanium Alloy (UNS R56260), AZoM, http://www.azom.com/article.aspx?ArticleID=9305, Jun. 20, 2013, 4 pages.
Gammon et al., "Metallography and Microstructures of Titanium and Its Alloys", ASM Handbook, vol. 9: Metallography and Microstructures, ASM International, 2004, pp. 899-917.
Rui-gang Deng, et al. "Effects of Forging Process and Following Heat Treatment on Microstructure and Mechanical Properties of TC11 Titanium Alloy," Materials for Mechanical Engineering, vol. 35. No. 11, Nov. 2011, 5 pages. (English abstract included).
Applicant-Initiated Interview Summary mailed Aug. 22, 2016 in U.S. Appl. No. 12/691,952.
Advisory Action Before the Filing of an Appeal Brief mailed Aug. 30, 2016 in U.S. Appl. No. 12/691,952.
Examiner's Answer to Appeal Brief mailed Oct. 27, 2016 in U.S. Appl. No. 12/903,851.
Office Action mailed Sep. 9, 2016 in U.S. Appl. No. 13/108,045.
Office Action mailed Aug. 22, 2016 in U.S. Appl. No. 13/844,196.
Office Action mailed Dec. 29, 2016 in U.S. Appl. No. 13/844,196.
Office Action mailed Aug. 12, 2016 in U.S. Appl. No. 14/073,029.
Office Action mailed Sep. 30, 2016 in U.S. Appl. No. 14/093,707.
Notice of Allowance mailed Jan. 13, 2017 in U.S. Appl. No. 14/093,707.
Supplemental Notice of Allowance mailed Jan. 27, 2017 in U.S. Appl. No. 14/093,707.
Office Action mailed Aug. 16, 2016 in U.S. Appl. No. 14/077,699.
Office Action mailed Oct. 25, 2016 in U.S. Appl. No. 14/077,699.
Advisory Action mailed Nov. 30, 2016 in U.S. Appl. No. 14/077,699.
Office Action mailed Aug. 26, 2016 in U.S. Appl. No. 15/005,281.
Action mailed Aug. 8, 2016 in U.S. Appl. No. 14/028,588.
Advisory Action mailed Oct. 14, 2016 in U.S. Appl. No. 14/028,588.
Applicant Initiated Interview Summary mailed Oct. 27, 2016 in U.S. Appl. No. 14/028,588.
Notice of Allowance mailed Oct. 13, 2016 in U.S. Appl. No. 14/083,759.
U.S. Appl. No. 15/348,140 filed on Nov. 10, 2016.

METHODS FOR PROCESSING TITANIUM ALLOYS

CROSS-REFERENCE TO RELATED APPLICATIONS

This application claims priority under 35 U.S.C. §120 as a continuation of co-pending U.S. patent application Ser. No. 13/714,465, filed on Dec. 14, 2012, which in turn is a continuation-in-part of U.S. patent application Ser. No. 12/882,538, filed Sep. 15, 2010, now issued as U.S. Pat. No. 8,613,818, the entire contents of each of which are incorporated herein by reference.

STATEMENT REGARDING FEDERALLY SPONSORED RESEARCH OR DEVELOPMENT

This invention was made with United States government support under NIST Contract Number 70NANB7H7038, awarded by the National Institute of Standards and Technology (NIST), United States Department of Commerce. The United States government may have certain rights in the invention.

BACKGROUND OF THE TECHNOLOGY

Field of the Technology

The present disclosure relates to methods for processing titanium alloys.

Description of the Background of the Technology

Methods for producing titanium and titanium alloys having coarse grain (CG), fine grain (FG), very fine grain (VFG), or ultrafine grain (UFG) microstructure involve the use of multiple reheats and forging steps. Forging steps may include one or more upset forging steps in addition to draw forging on an open die press.

As used herein, when referring to the microstructure of titanium alloys: the term "coarse grain" refers to alpha grain sizes of 400 μm down to greater than about 14 μm; the term "fine grain" refers to alpha grain sizes in the range of 14 μm down to greater than 10 μm; the term "very fine grain" refers to alpha grain sizes of 10 μm down to greater than 4.0 μm; and the term "ultrafine grain" refers to alpha grain sizes of 4.0 μm or less.

Known commercial methods of forging titanium and titanium alloys to produce coarse grain or fine grain microstructures employ strain rates of 0.03 $s^{-1}$ to 0.10 $s^{-1}$ using multiple reheats and forging steps.

Known methods intended for the manufacture of fine grain, very fine grain, or ultrafine grain microstructures apply a multi-axis forging (MAF) process at an ultra-slow strain rate of 0.001 $s^{-1}$ or slower (see, for example, G. Salishchev, et. al., *Materials Science Forum*, Vol. 584-586, pp. 783-788 (2008)). The generic MAF process is described in, for example, C. Desrayaud, et. al, *Journal of Materials Processing Technology,* 172, pp. 152-156 (2006).

The key to grain refinement in the ultra-slow strain rate MAF process is the ability to continually operate in a regime of dynamic recrystallization that is a result of the ultra-slow strain rates used, i.e., 0.001 $s^{-1}$ or slower. During dynamic recrystallization, grains simultaneously nucleate, grow, and accumulate dislocations. The generation of dislocations within the newly nucleated grains continually reduces the driving force for grain growth, and grain nucleation is energetically favorable. The ultra-slow strain rate MAF process uses dynamic recrystallization to continually recrystallize grains during the forging process.

Relatively uniform cubes of ultrafine grain Ti-6-4 alloy (UNS R56400) can be produced using the ultra-slow strain rate MAF process, but the cumulative time taken to perform the MAF steps can be excessive in a commercial setting. In addition, conventional large scale, commercially available open die press forging equipment may not have the capability to achieve the ultra-slow strain rates required in such embodiments and, therefore, custom forging equipment may be required for carrying out production-scale ultra-slow strain rate MAF.

Accordingly, it would be advantageous to develop a process for producing titanium alloys having coarse, fine, very fine, or ultrafine grain microstructure that does not require multiple reheats, accommodates higher strain rates, reduces the time necessary for processing, and/or eliminates the need for custom forging equipment.

SUMMARY

According to a non-limiting aspect of the present disclosure, a method of refining the grain size of a workpiece comprising a titanium alloy comprises beta annealing the workpiece. After beta annealing, the workpiece is cooled to a temperature below the beta transus temperature of the titanium alloy. The workpiece is then multi-axis forged. Multi-axis forging comprises: press forging the workpiece at a workpiece forging temperature in a workpiece forging temperature range in the direction of a first orthogonal axis of the workpiece with a strain rate sufficient to adiabatically heat an internal region of the workpiece; press forging the workpiece at a workpiece forging temperature in the workpiece forging temperature range in the direction of a second orthogonal axis of the workpiece with a strain rate that is sufficient to adiabatically heat the internal region of the workpiece; and press forging the workpiece at a workpiece forging temperature in the workpiece forging temperature range in the direction of a third orthogonal axis of the workpiece with a strain rate that is sufficient to adiabatically heat the internal region of the workpiece. Optionally, intermediate to successive press forging steps, the adiabatically heated internal region of the workpiece is allowed to cool to a temperature at or near the workpiece forging temperature in the workpiece forging temperature range, and an outer surface region of the workpiece is heated to a temperature at or near the workpiece forging temperature in the workpiece forging temperature range. At least one of the press forging steps is repeated until a total strain of at least 1.0 is achieved in at least a region of the workpiece. In another non-limiting embodiment, at least one of the press forging steps is repeated until a total strain of at least 1.0 up to less than 3.5 is achieved in at least a region of the workpiece. In a non-limiting embodiment, a strain rate used during press forging is in the range of 0.2 $s^{-1}$ to 0.8 $s^{-1}$.

According to another non-limiting aspect of the present disclosure, a non-limiting embodiment of a method of refining the grain size of a workpiece comprising a titanium alloy includes beta annealing the workpiece. After beta annealing, the workpiece is cooled to a temperature below the beta transus temperature of the titanium alloy. The workpiece is then multi-axis forged using a sequence comprising the following forging steps.

The workpiece is press forged at a workpiece forging temperature in a workpiece forging temperature range in the direction of a first orthogonal A-axis of the workpiece to a major reduction spacer height with a strain rate that is sufficient to adiabatically heat an internal region of the workpiece. As used herein, a major reduction spacer height is a distance equivalent to the final forged dimension desired for each orthogonal axis of the workpiece.

The workpiece is press forged at the workpiece forging temperature in the workpiece forging temperature range in the direction of a second orthogonal B-axis of the workpiece in a first blocking reduction to a first blocking reduction spacer height. The first blocking reduction is applied to bring the workpiece back to substantially the pre-forging shape of the workpiece. While the strain rate of the first blocking reduction may be sufficient to adiabatically heat an internal region of the workpiece, in a non-limiting embodiment, adiabatic heating during the first blocking reduction may not occur because the total strain incurred in the first blocking reduction may not be sufficient to significantly adiabatically heat the workpiece. The first blocking reduction spacer height is larger than the major reduction spacer height.

The workpiece is press forged at the workpiece forging temperature in the workpiece forging temperature range in the direction of a third orthogonal C-axis of the workpiece in a second blocking reduction to a second blocking reduction spacer height. The second blocking reduction is applied to bring the workpiece back to substantially the pre-forging shape of the workpiece. While the strain rate of the second blocking reduction may be sufficient to adiabatically heat an internal region of the workpiece, in a non-limiting embodiment, adiabatic heating during the second blocking reduction may not occur because the total strain incurred in the second blocking reduction may not be sufficient to significantly adiabatically heat the workpiece. The second blocking reduction spacer height is greater than the major reduction spacer height.

The workpiece is press forged at a workpiece forging temperature in the workpiece forging temperature range in the direction of the second orthogonal B-axis of the workpiece to the major reduction spacer height with a strain rate that is sufficient to adiabatically heat an internal region of the workpiece.

The workpiece is press forged at the workpiece forging temperature in the workpiece forging temperature range in the direction of the third orthogonal C-axis of the workpiece in a first blocking reduction to the first blocking reduction spacer height. The first blocking reduction is applied to bring the workpiece back to substantially the pre-forging shape of the workpiece. While the strain rate of the first blocking reduction may be sufficient to adiabatically heat an internal region of the workpiece, in a non-limiting embodiment, adiabatic heating during the first blocking reduction may not occur because the total strain incurred in the first blocking reduction may not be sufficient to significantly adiabatically heat the workpiece. The first blocking reduction spacer height is larger than the major reduction spacer height.

The workpiece is press forged at the workpiece forging temperature in the workpiece forging temperature range in the direction of the first orthogonal A-axis of the workpiece in a second blocking reduction to the second blocking reduction spacer height. The second blocking reduction is applied to bring the workpiece back to substantially the pre-forging shape of the workpiece. While the strain rate of the second blocking reduction may be sufficient to adiabatically heat an internal region of the workpiece, in a non-limiting embodiment, adiabatic heating during the second blocking reduction may not occur because the total strain incurred in the second blocking reduction may not be sufficient to significantly adiabatically heat the workpiece. The second blocking reduction spacer height is larger than the major reduction spacer height.

The workpiece is press forged at the workpiece forging temperature in the workpiece forging temperature range in the direction of the third orthogonal C-axis of the workpiece in a major reduction to the major reduction spacer height with a strain rate that is sufficient to adiabatically heat an internal region of the workpiece.

The workpiece is press forged at the workpiece forging temperature in the workpiece forging temperature range in the direction of the first orthogonal A-axis of the workpiece in a first blocking reduction to the first blocking reduction spacer height. The first blocking reduction is applied to bring the workpiece back to substantially the pre-forging shape of the workpiece. While the strain rate of the first blocking reduction may be sufficient to adiabatically heat an internal region of the workpiece, in a non-limiting embodiment, adiabatic heating during the first blocking reduction may not occur because the total strain incurred in the first blocking reduction may not be sufficient to significantly adiabatically heat the workpiece. The first blocking reduction spacer height is larger than the major reduction spacer height.

The workpiece is press forged at the workpiece forging temperature in the workpiece forging temperature range in the direction of the second orthogonal B-axis of the workpiece in a second blocking reduction to the second blocking reduction spacer height. The second blocking reduction is applied to bring the workpiece back to substantially the pre-forging shape of the workpiece. While the strain rate of the second blocking reduction may be sufficient to adiabatically heat an internal region of the workpiece, in a non-limiting embodiment, adiabatic heating during the second blocking reduction may not occur because the total strain incurred in the second blocking reduction may not be sufficient to significantly adiabatically heat the workpiece. The second blocking reduction spacer height is larger than the major reduction spacer height.

Optionally, intermediate successive press forging steps of the foregoing method embodiment, the adiabatically heated internal region of the workpiece is allowed to cool to about the workpiece forging temperature in the workpiece forging temperature range, and the outer surface region of the workpiece is heated to about the workpiece forging temperature in the workpiece forging temperature range. At least one of the foregoing press forging steps of the method embodiment is repeated until a total strain of at least 1.0 is achieved in at least a region of the workpiece. In a non-limiting embodiment of the method, at least one of the press forging steps is repeated until a total strain of at least 1.0 and up to less than 3.5 is achieved in at least a region of the workpiece. In a non-limiting embodiment, a strain rate used during press forging is in the range of 0.2 $s^{-1}$ to 0.8 $s^{-1}$.

BRIEF DESCRIPTION OF THE DRAWINGS

The features and advantages of apparatus and methods described herein may be better understood by reference to the accompanying drawings in which:

FIG. 11(*b*) is a micrograph of the microstructure of a Ti-6-2-4-2 alloy processed by the thermally managed high strain MAF embodiment described in Example 1 of the present disclosure;

FIG. 12(*b*) is a micrograph of the microstructure of a Ti-6-2-4-6 alloy processed by the thermally managed high strain MAF embodiment described in Example 2 of the present disclosure;

FIG. 16(*b*) is a micrograph of the microstructure of the surface region of a Ti-6-2-4-2 alloy processed by the thermally managed high strain MAF embodiment utilizing through beta transus MAF that is described in Example 6 of the present disclosure.

Figure 1:
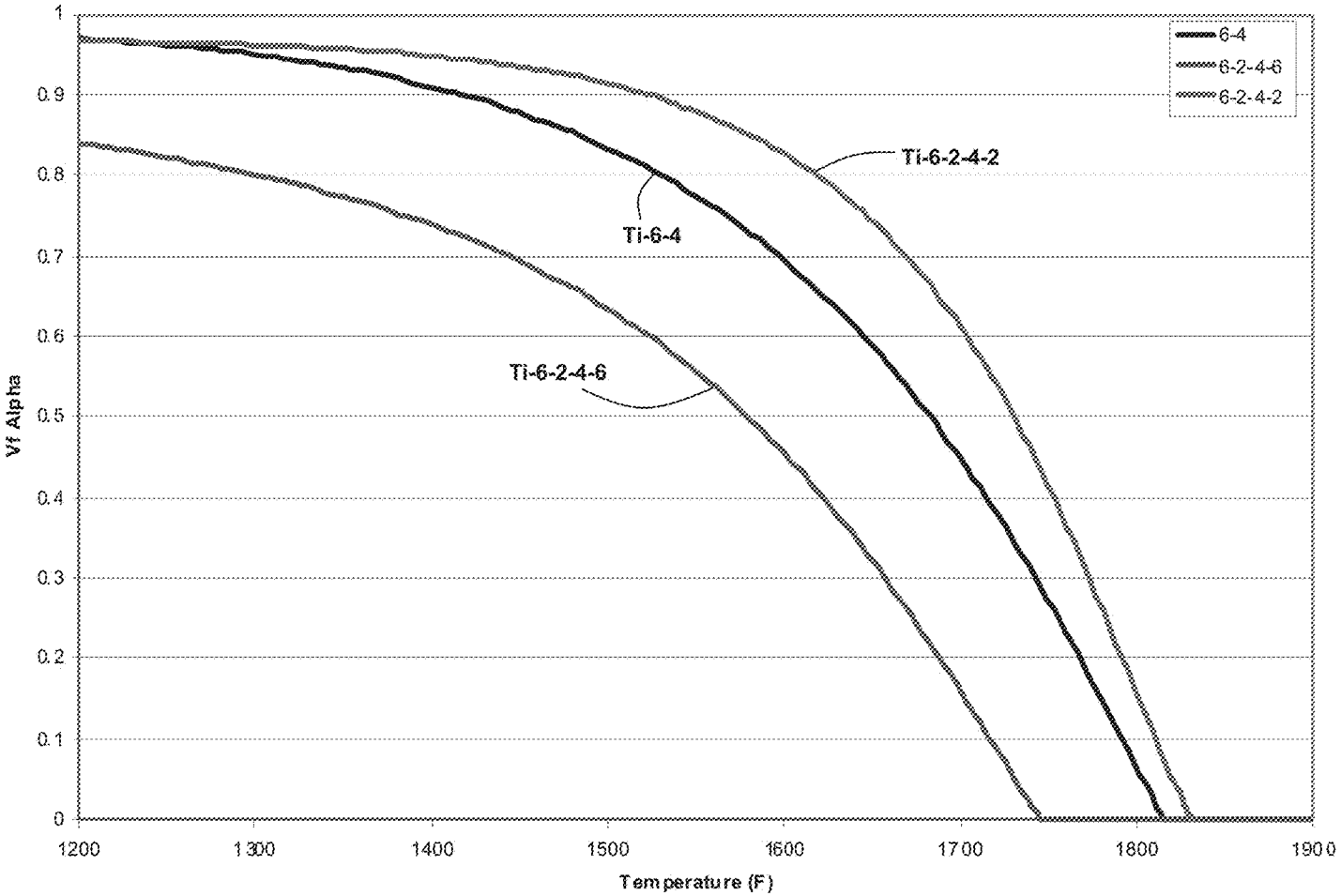
FIG. 1 is graph plotting a calculated prediction of the volume fraction of equilibrium alpha phase present in Ti-6-4, Ti-6-2-4-6, and Ti-6-2-4-2 alloys as a function of temperature.

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

In the present description of non-limiting embodiments, other than in the operating examples or where otherwise indicated, all numbers expressing quantities or characteristics are to be understood as being modified in all instances by the term "about". Accordingly, unless indicated to the contrary, any numerical parameters set forth in the following description are approximations that may vary depending on the desired properties one seeks to obtain by way of the methods according to the present disclosure. At the very least, and not as an attempt to limit the application of the doctrine of equivalents to the scope of the claims, each numerical parameter should at least be construed in light of the number of reported significant digits and by applying ordinary rounding techniques.

Also, any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10. Any maximum numerical limitation recited herein is intended to include all lower numerical limitations subsumed therein and any minimum numerical limitation recited herein is intended to include all higher numerical limitations subsumed therein. Accordingly, Applicants reserve the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. §112, first paragraph, and 35 U.S.C. §132(a).

The grammatical articles "one", "a", "an", and "the", as used herein, are intended to include "at least one" or "one or more", unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

The present disclosure includes descriptions of various embodiments. It is to be understood that all embodiments described herein are exemplary, illustrative, and non-limiting. Thus, the invention is not limited by the description of the various exemplary, illustrative, and non-limiting embodiments. Rather, the invention is defined solely by the claims, which may be amended to recite any features expressly or inherently described in or otherwise expressly or inherently supported by the present disclosure.

Any patent, publication, or other disclosure material, in whole or in part, that is said to be incorporated by reference herein is incorporated herein only to the extent that the incorporated material does not conflict with existing definitions, statements, or other disclosure material set forth in the present disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

An aspect of the present disclosure is directed to non-limiting embodiments of a multi-axis forging process for titanium alloys that includes the application of high strain rates during the forging steps to refine grain size. These method embodiments are generally referred to in the present disclosure as "high strain rate multi-axis forging" or "high strain rate MAF". As used herein, the terms "reduction" and "hit" interchangeably refer to an individual press forging step, wherein a workpiece is forged between die surfaces. As used herein, the phrase "spacer height" refers to the dimension or thickness of a workpiece measured along one orthogonal axis after a reduction along that axis. For example, after a press forging reduction along a particular axis to a spacer height of 4.0 inches, the thickness of the press forged workpiece measured along that axis will be about 4.0 inches. The concept and use of spacer heights are well known to those having ordinary skill in the field of press forging and need not be further discussed herein.

It was previously determined that for alloys such as Ti-6Al-4V alloy (ASTM Grade 5; UNS R56400), which also may be referred to as "Ti-6-4" alloy, high strain rate multi-axis forging, wherein the workpiece was forged at least to a total strain of 3.5, could be used to prepare ultrafine grain billets. This process is disclosed in U.S. patent application Ser. No. 12/882,538, filed Sep. 15, 2010, entitled "Processing Routes for Titanium and Titanium Alloys" ("the '538 Application"), which is incorporated herein by reference in its entirety. Imparting strain of at least 3.5 may require significant processing time and complexity, which adds cost and increases the opportunity for unanticipated problems. The present disclosure discloses a high strain rate multi-axis forging process that can provide ultrafine grain structures using total strain in the range of from at least 1.0 up to less than 3.5.

Methods according to the present disclosure involve the application of multi-axis forging and its derivatives, such as the multiple upset and draw (MUD) process disclosed in the '538 Application, to titanium alloys exhibiting slower effective alpha precipitation and growth kinetics than Ti-6-4 alloy. In particular, Ti-6Al-2Sn-4Zr-2Mo-0.08Si alloy (UNS R54620), which also may be referred to as "Ti-6-2-4-2" alloy, has slower effective alpha kinetics than Ti-6-4 alloy as a result of additional grain pinning elements such as Si. Also, Ti-6Al-2Sn-4Zr-6Mo alloy (UNS R56260), which also may be referred to as "Ti-6-2-4-6" alloy, has slower effective alpha kinetics than T-6-4 alloy as a result of increased beta stabilizing content. It is recognized that in terms of alloying elements, the growth and precipitation of the alpha phase is a function of the diffusion rate of the alloying element in the titanium-base alloy. Molybdenum is known to have one of the slower diffusion rates of all titanium alloying additions. In addition, beta stabilizers, such as molybdenum, lower the beta transus temperature ($T_\beta$) of the alloy, wherein the lower $T_\beta$ results in general slower diffusion of atoms in the alloy at the processing temperature for the alloy. A result of the relatively slow effective alpha precipitation and growth kinetics of the Ti-6-2-4-2 and Ti-6-2-4-6 alloys is that the beta heat treatment that is used prior to MAF according to embodiments of the present disclosure produces a fine and stable alpha lath size when compared to the effect of such processing on Ti-6-4 alloy. In addition, after beta heat treating and cooling, the Ti-6-2-4-2 and Ti-6-2-4-6 alloys possess a fine beta grain structure that limits the kinetics of alpha grain growth.

The effective kinetics of alpha growth can be evaluated by identifying the slowest diffusing species at a temperature immediately below the beta transus. This approach has been theoretically outlined and experimentally verified in literature (see Semiatin et al., *Metallurgical and Materials Transactions A: Physical Metallurgy and Materials Science* 38 (4), 2007, pp. 910-921). In titanium and titanium alloys, diffusivity data for all of the potential alloying elements is not readily available; however, literature surveys such as that in Titanium (Second Edition, 2007), by Lutjering and Williams, generally agree to the following relative ranking for some common alloying elements:

$$D_{Mo}<D_{Nb}<D_{Al}\sim D_{V}\sim D_{Sn}\sim D_{Zr}\sim D_{Hf}<D_{O}\sim D_{N}\sim D_{Cr}\sim D_{Co}\sim D_{Mn}\sim D_{Fe}$$

Therefore, alloys such as Ti-6-2-4-6 alloy and Ti-6-2-4-2 alloy, which contain molybdenum, show the desirable, slow alpha kinetics required to achieve ultrafine grain microstructures at comparatively lower strain than Ti-6-4 alloy where the kinetics are controlled by the diffusion of aluminum. Based on periodic table group relationships, one could also reasonably postulate that tantalum and tungsten belong to the group of slow diffusers.

In addition to the inclusion of slow diffusing elements to reduce the effective kinetics of the alpha phase, reducing the beta transus temperature in alloys controlled by aluminum diffusion will have a similar effect. A beta transus temperature reduction of 100° C. will reduce the diffusivity of aluminum in the beta phase by approximately an order of magnitude at the beta transus temperature. The alpha kinetics in alloys such as ATI 425® alloy (Ti-4Al-2.5V; UNS 54250) and Ti-6-6-2 alloy (Ti-6Al-6V-2SN; UNS 56620) are likely controlled by aluminum diffusion; however, the lower beta transus temperatures of these alloys relative to Ti-6Al-4V alloy also result in the desirable, slower effective alpha kinetics. Ti-6Al-7Nb alloy (UNS R56700), normally a biomedical version of Ti-6Al-4V alloy, may also exhibit slower effective alpha kinetics because of the niobium content.

It was initially expected that alpha+beta alloys other than Ti-6-4 alloy could be processed under conditions similar to those disclosed in the '538 Application at temperatures that would result in similar volume fractions of the alpha phase. For example, according to predictions using PANDAT software, a commercially available computational tool available from Computherm, LLC, Madison, Wis., USA, it was predicted that Ti-6-4 alloy at 1500° F. (815.6° C.) should have approximately the same volume fraction of the alpha phase as both Ti-6-2-4-2 alloy at 1600° F. (871.1° C.) and Ti-6-2-4-6 alloy at 1200° F. (648.9° C.) See FIG. 1. However, both Ti-6-2-4-2 and Ti-6-2-4-6 alloys cracked severely when processed in the manner in which Ti-6-4 alloy was processed in the '538 Application using temperatures that it was predicted would produce a similar volume fraction of the alpha phase. Much higher temperatures, resulting in lower equilibrium volume fractions of alpha, and/or significantly reduced strain per pass were required to successfully process the Ti-6-2-4-2 and Ti-6-2-4-6 alloys.

Variations to the high strain rate MAF process, including alpha/beta forging temperature(s), strain rate, strain per hit, hold time between hits, number and duration of reheats, and intermediate heat treatments can each affect the resultant microstructure and the presence and extent of cracking. Lower total strains were initially attempted in order to inhibit cracking, without any expectation that ultrafine grain structures would result. However, when examined, the samples processed using lower total strains showed significant promise for producing ultrafine grain structures. This result was entirely unanticipated.

In certain non-limiting embodiments according to the present disclosure, a method for producing ultrafine grain sizes includes the following steps: 1) selecting a titanium alloy exhibiting effective alpha-phase growth kinetics slower than Ti-6-4 alloy; 2) beta annealing the titanium alloy to produce a fine, stable alpha lath size; and 3) high strain rate MAF (or a similar derivative process, such as the multiple upset and draw (MUD) process disclosed in the '538 Application) to a total strain of at least 1.0, or in another embodiment, to a total strain of at least 1.0 up to less than 3.5. The word "fine" for describing the grain and lath sizes, as used herein, refers to the smallest grain and lath size that can be achieved, which in non-limiting embodiments is on the order of 1 μm. The word "stable" is used herein to mean that the multi-axis forging steps do not significantly coarsen the alpha grain size, and do not increase the alpha grain size by more than about 100%.

Figure 2:
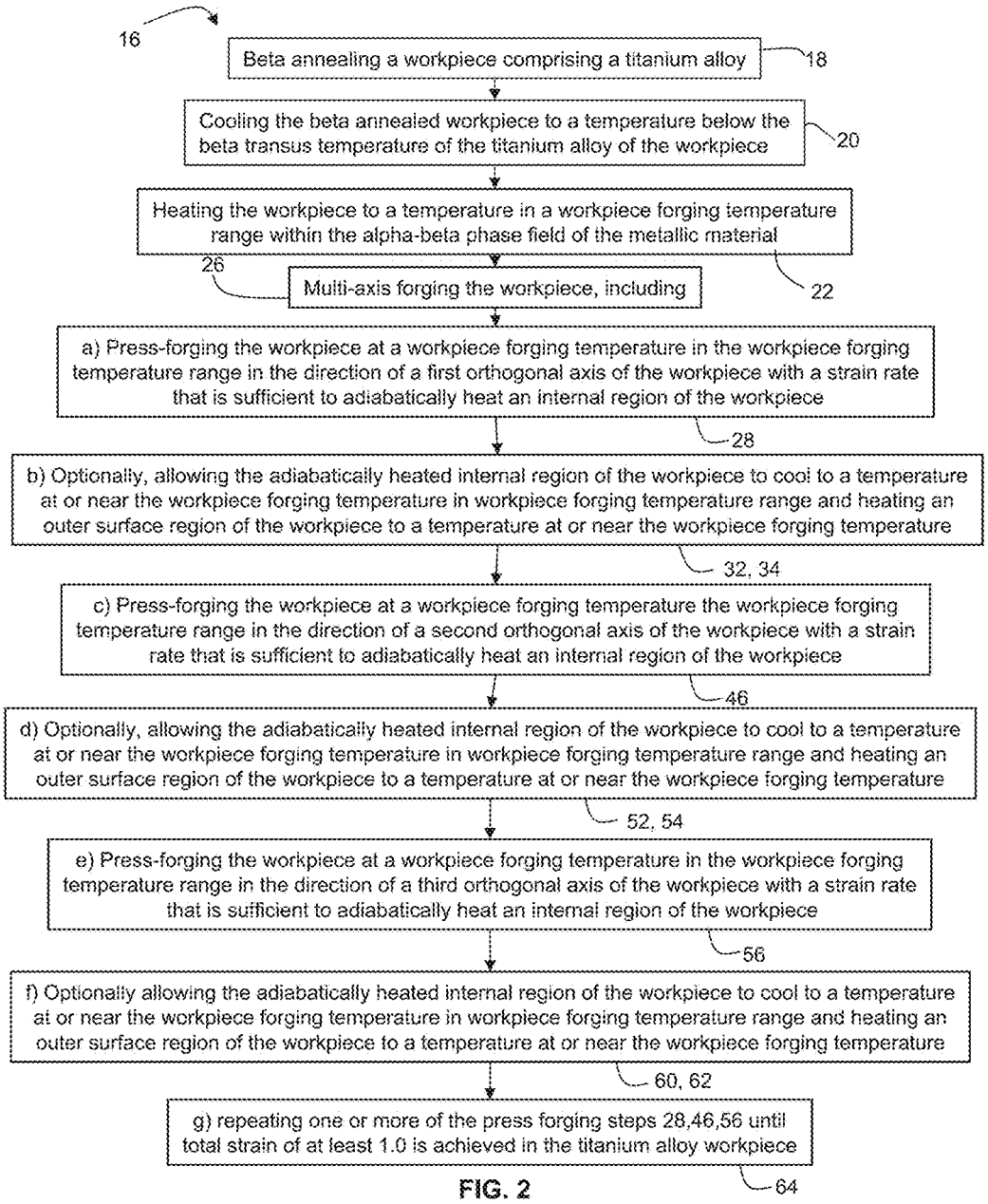
FIG. 2 is a flow chart listing steps of a non-limiting embodiment of a method for processing titanium alloys according to the present disclosure.
Figure 3:
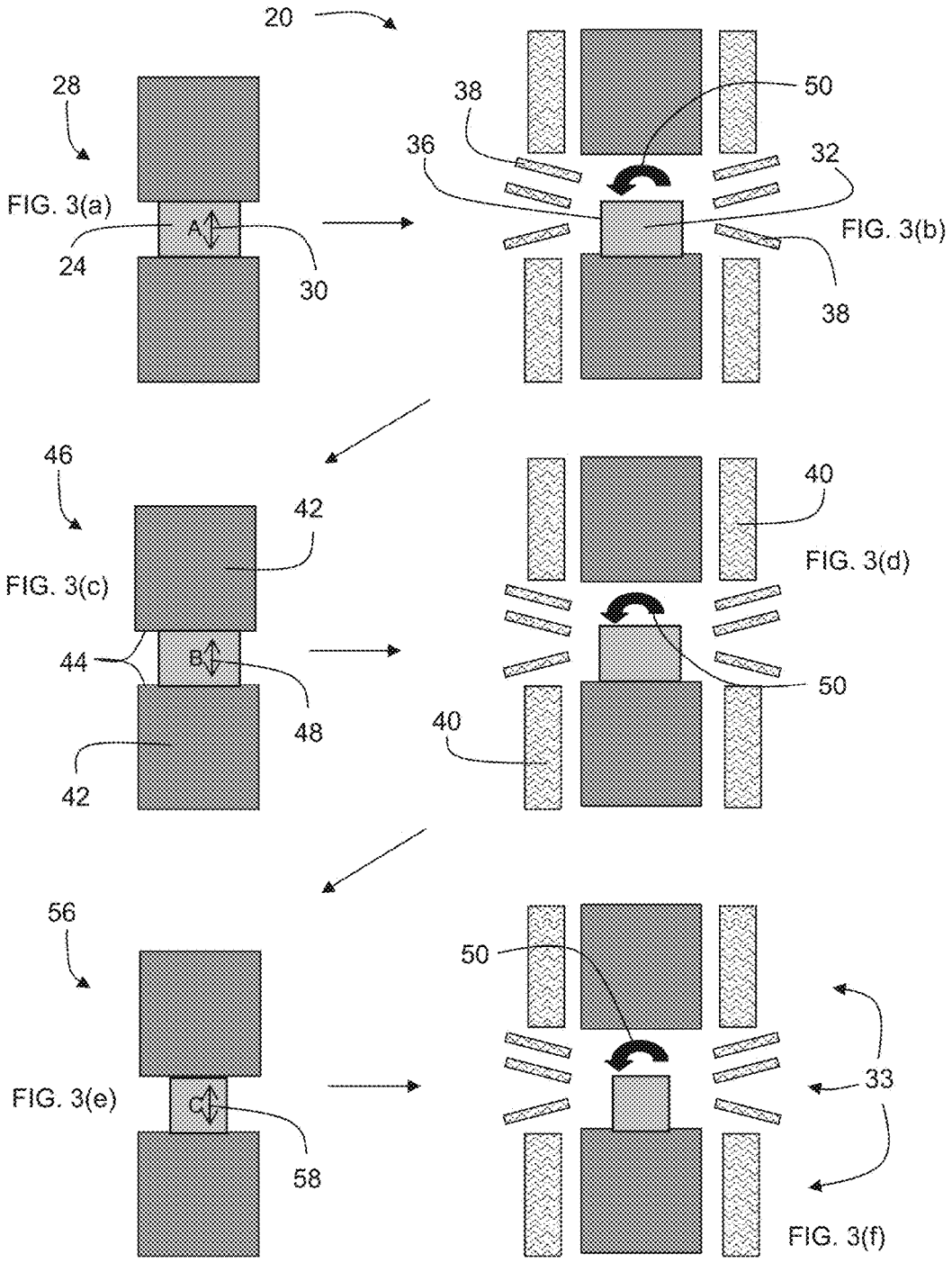
FIG. 3 is a schematic representation of aspects of a non-limiting embodiment of a high strain rate multi-axis forging method using thermal management for processing titanium alloys for the refinement of grain sizes, wherein FIGS. 2(*a*), 2(*c*), and 2(*e*) represent non-limiting press forging steps, and FIGS. 2(*b*), 2(*d*), and 2(*f*) represent optional non-limiting cooling and heating steps according to non-limiting aspects of the present disclosure.

The flow chart in FIG. 2 and the schematic representation in FIG. 3 illustrate aspects of a non-limiting embodiment according to the present disclosure of a method (16) of using a high strain rate multi-axis forging (MAF) to refine grain size of titanium alloys. Prior to multi-axis forging (26), a titanium alloy workpiece 24 is beta annealed (18) and cooled (20). Air cooling is possible with smaller workpieces, such as, for example, 4 inch cubes; however, water or liquid cooling also can be used. Faster cooling rates result in finer lath and alpha grain sizes. Beta annealing (18) comprises heating the workpiece 24 above the beta transus temperature of the titanium alloy of the workpiece 24 and holding for a time sufficient to form all beta phase in the workpiece 24. Beta annealing (18) is a process well-known to a person of ordinary skill and, therefore, is not described in detail herein. A non-limiting embodiment of beta annealing may include heating the workpiece 24 to a beta annealing temperature that is about 50° F. (27.8° C.) above the beta transus temperature of the titanium alloy and holding the workpiece 24 at the temperature for about 1 hour.

After beta annealing (18), the workpiece 24 is cooled (20) to a temperature below the beta transus temperature of the titanium alloy of the workpiece 24. In a non-limiting embodiment of the present disclosure, the workpiece is cooled to ambient temperature. As used herein, "ambient temperature" refers to the temperature of the surroundings. For example, in a non-limiting commercial production scenario, "ambient temperature" refers to the temperature of the factory surroundings. In a non-limiting embodiment, cooling (20) can include quenching. Quenching includes immersing the workpiece 24 in water, oil, or another suitable liquid and is a process understood by a person skilled in the metallurgical arts. In other non-limiting embodiments, particularly for smaller sized workpieces, cooling (20) may comprise air cooling. Any method of cooling a titanium alloy workpiece 24 known to a person skilled in the art now or hereafter is within the scope of the present disclosure. In addition, in a certain non-limiting embodiments, cooling (20) comprises cooling directly to a workpiece forging temperature in the workpiece forging temperature range for subsequent high strain rate multi-axis forging.

After cooling (20) the workpiece, the workpiece is subjected to high strain rate multi-axis forging (26). As is understood to those having ordinary skill in the art, multi-axis forging ("MAF"), which also may be referred to as "A-B-C" forging, is a form of severe plastic deformation. High strain rate multi-axis forging (26), according to a non-limiting embodiment of the present disclosure, includes heating (step 22 in FIG. 2) a workpiece 24 comprising a titanium alloy to a workpiece forging temperature in a workpiece forging temperature range that is within the alpha+beta phase field of the titanium alloy, followed by MAF (26) using a high strain rate. It is apparent that in an embodiment in which the cooling step (20) comprises cooling to a temperature in the workpiece forging temperature range, the heating step (22) is not necessary.

A high strain rate is used in the high strain rate MAF to adiabatically heat an internal region of the workpiece. However, in non-limiting embodiments according to the present disclosure, in at least the last cycle of A-B-C hits of high strain rate MAF in the cycle, the temperature of the internal region of the titanium alloy workpiece 24 should not exceed the beta transus temperature ($T_\beta$) of the titanium alloy workpiece. Therefore, in such non-limiting embodiments the workpiece forging temperature for at least the final cycle of A-B-C hits, or at least the last hit of the cycle, of high strain rate MAF should be chosen to ensure that during the high strain rate MAF the temperature of the internal region of the workpiece does not equal or exceed the beta transus temperature of the alloy. For example, in a non-limiting embodiment according to the present disclosure, the temperature of the internal region of the workpiece does not exceed 20° F. (11.1° C.) below the beta transus temperature of the alloy, i.e., $T_\beta$—20° F. ($T_\beta$—11.1° C.), during at least the final high strain rate cycle of A-B-C hits in the MAF or during at least the last press forging hit when a total strain of at least 1.0, or in a range of at least 1.0 up to less than 3.5, is achieved in at least a region of the workpiece.

In a non-limiting embodiment of high strain rate MAF according to the present disclosure, a workpiece forging temperature comprises a temperature within a workpiece forging temperature range. In a non-limiting embodiment, the workpiece forging temperature range is 100° F. (55.6° C.) below the beta transus temperature ($T_\beta$) of the titanium alloy of the workpiece to 700° F. (388.9° C.) below the beta transus temperature of the titanium alloy. In still another non-limiting embodiment, the workpiece forging temperature range is 300° F. (166.7° C.) below the beta transus temperature of the titanium alloy to 625° F. (347° C.) below the beta transus temperature of the titanium alloy. In a non-limiting embodiment, the low end of a workpiece forging temperature range is a temperature in the alpha+beta phase field wherein damage, such as, for example, crack formation and gouging, does not occur to the surface of the workpiece during the forging hit.

In a non-limiting method embodiment shown in FIG. 2 applied to a Ti-6-2-4-2 alloy, which has a beta transus temperature ($T_\beta$) of about 1820° F. (996° C.), the workpiece forging temperature range may be from 1120° F. (604.4° C.) to 1720° F. (937.8° C.), or in another embodiment may be from 1195° F. (646.1° C.) to 1520° F. (826.7° C.). In a non-limiting method embodiment shown in FIG. 2 applied to a Ti-6-2-4-6 alloy, which has a beta transus temperature ($T_\beta$) of about 1720° F. (940° C.), the workpiece forging temperature range may be from 1020° F. (548.9° C.) to 1620° F. (882.2° C.), or in another embodiment may be from 1095° F. (590.6° C.) to 1420° F. (771.1° C.). In still another non-limiting embodiment, when applying the embodiment shown in FIG. 2 to ATI 425® alloy (UNS R54250), which also may be referred to as "Ti-4Al-2.5V" alloy, and which has a beta transus temperature ($T_\alpha$) of about 1780° F. (971.1° C.), the workpiece forging temperature range may be from 1080° F. (582.2° C.) to 1680° F. (915.6° C.), or in another embodiment may be from 1155° F. (623.9° C.) to 1480° F. (804.4° C.). In still another non-limiting embodiment, when applying the embodiment of the present disclosure of FIG. 2 to a Ti-6Al-6V-2Sn alloy (UNS 56620), which also may be referred to as "Ti-6-6-2" alloy, and which has a beta transus temperature ($T_\beta$) of about 1735° F. (946.1° C.), the workpiece forging temperature range may be from 1035° F. (527.2° C.) to 1635° F. (890.6° C.), or in another embodiment may be from 1115° F. (601.7° C.) to 1435° F. (779.4° C.). The present disclosure involves the application of high strain rate multi-axis forging and its derivatives, such as the MUD method disclosed in the '538 Application, to titanium alloys that posses slower effective alpha precipitation and growth kinetics than Ti-6-4 alloy.

Referring again to FIGS. 2 and 3, when the titanium alloy workpiece 24 is at the workpiece forging temperature, the workpiece 24 is subjected to high strain rate MAF (26). In a non-limiting embodiment according to the present disclosure, MAF (26) comprises press forging (step 28, shown in FIG. 3(*a*)) the workpiece 24 at the workpiece forging temperature in the direction (A) of a first orthogonal axis 30 of the workpiece using a strain rate that is sufficient to adiabatically heat the workpiece, or at least adiabatically heat an internal region of the workpiece, and plastically deform the workpiece 24.

High strain rates and fast ram speeds are used to adiabatically heat the internal region of the workpiece in non-limiting embodiments of high strain rate MAF according to the present disclosure. In a non-limiting embodiment according to the present disclosure, the term "high strain rate" refers to a strain rate in the range of about 0.2 $s^{-1}$ to about 0.8 $s^{-1}$. In another non-limiting embodiment according to the present disclosure, the term "high strain rate" refers to a strain rate in the range of about 0.2 $s^{-1}$ to about 0.4 $s^{-1}$.

In a non-limiting embodiment according to the present disclosure using a high strain rate as defined hereinabove, an internal region of the titanium alloy workpiece may be adiabatically heated to about 200° F. (111.1° C.) above the workpiece forging temperature. In another non-limiting embodiment, during press forging an internal region is adiabatically heated to a temperature in the range of about 100° F. (55.6° C.) to about 300° F. (166.7° C.) above the workpiece forging temperature. In still another non-limiting embodiment, during press forging an internal region is adiabatically heated to a temperature in the range of about 150° F. (83.3° C.) to about 250° F. (138.9° C.) above the workpiece forging temperature. As noted above, in non-limiting embodiments, no portion of the workpiece should be heated above the beta transus temperature of the titanium alloy during the last cycle of high strain rate A-B-C MAF hits, or during the last hit on an orthogonal axis.

In a non-limiting embodiment, during press forging (28), the workpiece 24 is plastically deformed to a reduction in height or another dimension that is in the range of 20% to 50%, i.e., the dimension is reduced by a percentage within that range. In another non-limiting embodiment, during press forging (28), the workpiece 24 is plastically deformed to a reduction in height or another dimension in the range of 30% to 40%.

Figure 4:
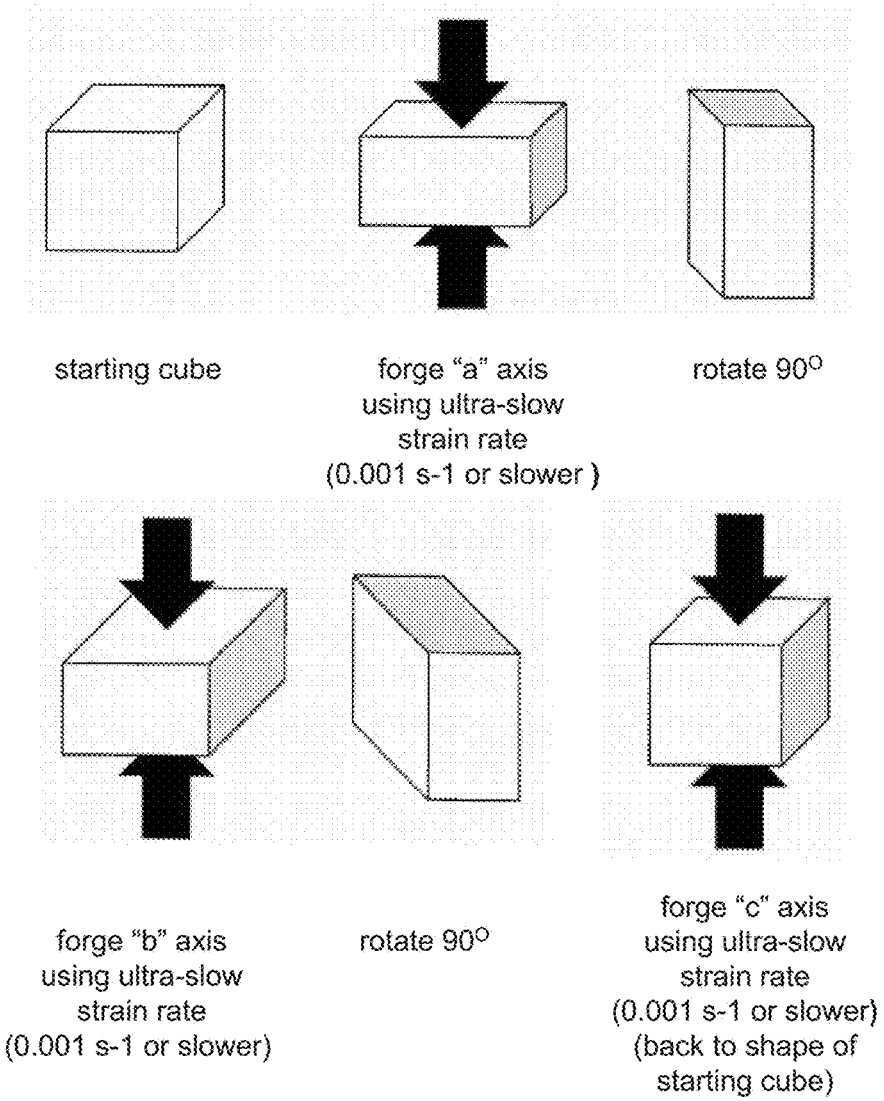
FIG. 4 PRIOR ART
FIG. 4 is a schematic representation of aspects of a prior art slow strain rate multi-axis forging technique known to be used to refine grain size of small scale samples.

A known ultra-slow strain rate (0.001 $s^{-1}$ or slower) multi-axis forging process is depicted schematically in FIG. 4. Generally, an aspect of multi-axis forging is that after every three-stroke, (i.e., "three-hit") cycle by the forging apparatus (which may be, for example, an open die forge), the shape and size of the workpiece approaches that of the workpiece just prior to the first hit of that three-hit cycle. For example, after a 5-inch sided cube-shaped workpiece is initially forged with a first "hit" in the direction of the "a" axis, rotated 90° and forged with a second hit in the direction of the orthogonal "b" axis, and then rotated 90° and forged with a third hit in the direction of the orthogonal "c" axis, the workpiece will resemble the starting cube and include approximately 5-inch sides. In other words, although the three-hit cycle has deformed the cube in three steps along the cube's three orthogonal axes, as a result of the repositioning of the workpiece between individual hits and selection of the reduction during each hit, the overall result of the three forging deformations is to return the cube to approximately its original shape and size.

In another non-limiting embodiment according to the present disclosure, a first press forging step (28), shown in FIG. 2(*a*), also referred to herein as the "first hit", may include press forging the workpiece on a top face down to a predetermined spacer height while the workpiece is at a temperature in the workpiece forging temperature range. As used herein the term "spacer height" refers to the dimension of the workpiece on the completion of a particular press forging reduction. For example, for a spacer height of 5 inches, the workpiece is forged to a dimension of about 5 inches. In a specific non-limiting embodiment of the method of the present disclosure, a spacer height is, for example, 5 inches. In another non-limiting embodiment, a spacer height is 3.25 inches. Other spacer heights, such as, for example, less than 5 inches, about 4 inches, about 3 inches, greater than 5 inches, or 5 inches up to 30 inches are within the scope of embodiments herein, but should not be considered as limiting the scope of the present disclosure. Spacer heights are only limited by the capabilities of the forge and optionally, as will be seen herein, the capabilities of the thermal management system according to non-limiting embodiments of the present disclosure to maintain the workpiece at the workpiece forging temperature. Spacer heights of less than 3 inches are also within the scope of embodiments disclosed herein, and such relatively small spacer heights are only limited by the desired characteristics of a finished product. The use of spacer heights of about 30 inches, for example, in methods according to the present disclosure allows for the production of billet-sized (e.g., 30-inch sided) cube-shaped titanium alloy forms having fine grain size, very fine grain size, or ultrafine grain size. Billet-sized cube-shaped forms of conventional alloys have been employed as workpieces that are forged into disk, ring, and case parts for aeronautical or land-based turbines, for example.

The predetermined spacer heights that should be employed in various non-limiting embodiments of methods according to the present disclosure may be determined by a person having ordinary skill in the art without undue experimentation on considering the present disclosure. Specific spacer heights may be determined by a person having ordinary skill without undue experimentation. Specific spacer heights are dependent upon a specific alloy's susceptibility to cracking during forging. Alloys that have a higher susceptibility to cracking will require larger spacer heights, i.e., less deformation per hit to prevent cracking. The adiabatic heating limit must also be considered when choosing a spacer height because, at least in the last cycle of hits, the workpiece temperature should not surpass the $T_\beta$ of the alloy. In addition, the forging press capability limit needs to be considered when selecting a spacer height. For example, during the pressing of a 4-inch sided cubic workpiece the cross-sectional area increases during the pressing step. As such, the total load that is required to keep the workpiece deforming at the required strain rate increases. The load cannot increase beyond the capabilities of the forging press. Also, the workpiece geometry needs to be considered when selecting spacer heights. Large deformations may result in bulging of the workpiece. Too great a reduction could result in a relative flattening of the workpiece, so that the next forging hit in the direction of a different orthogonal axis could result in bending of the workpiece.

In certain non-limiting embodiments, the spacer heights used for each orthogonal axis hit are equivalent. In certain other non-limiting embodiments, the spacer heights used for each orthogonal axis hits are not equivalent. Non-limiting embodiments of high strain rate MAF using non-equivalent spacer heights for each orthogonal axis are presented below.

After press forging (28) the workpiece 24 in the direction of the first orthogonal axis 30, i.e., in the A-direction shown in FIG. 2(*a*), a non-limiting embodiment of a method according to the present disclosure optionally further comprises a step of allowing (step 32) the temperature of the adiabatically heated internal region (not shown) of the workpiece to cool to a temperature at or near the workpiece forging temperature in the workpiece forging temperature range, which is shown in FIG. 3(*b*). In various non-limiting embodiments, internal region cooling times, or "waiting" times, may range, for example, from 5 seconds to 120 seconds, from 10 seconds to 60 seconds, or from 5 seconds to 5 minutes. In various non-limiting embodiments according to the present disclosure, an "adiabatically heated internal region" of a workpiece, as used herein, refers to a region extending outwardly from a center of the workpiece and having a volume of at least about 50%, or at least about 60%, or at least about 70%, or at least about 80% of the workpiece. It will be recognized by a person skilled in the art that the time required to cool the internal region of a workpiece to a temperature at or near the workpiece forging temperature will depend on the size, shape, and composition of the workpiece 24, as well as on conditions of the atmosphere surrounding the workpiece 24.

During the internal region cooling period, an aspect of a thermal management system 33 according to certain non-limiting embodiments disclosed herein optionally comprises heating (step 34) an outer surface region 36 of the workpiece 24 to a temperature at or near the workpiece forging temperature. In this manner, the temperature of the workpiece 24 is in a uniform or near uniform and substantially isothermal condition at or near the workpiece forging temperature prior to each high strain rate MAF hit. It is recognized that it is within the scope of the present disclosure to optionally heat (34) the outer surface region 36 of the workpiece 24 after each A-axis heat, after each B-axis hit, and/or after each C-axis hit. In non-limiting embodiments, the outer surface of the workpiece optionally is heated (34) after each cycle of A-B-C hits. In still other non-limiting embodiments, the outer surface region optionally is be heated after any hit or cycle of hits, as long as the overall temperature of the workpiece is maintained within the workpiece forging temperature range during the forging process. The times that a workpiece should be heated to maintain a temperature of the workpiece 24 in a uniform or near uniform and substantially isothermal condition at or near the workpiece forging temperature prior to each high strain rate MAF hit may depend on the size of the workpiece, and this may be determined by a person having ordinary skill without undue experimentation. In various non-limiting embodiments according to the present disclosure, an "outer surface region" of a workpiece, as used herein, refers to a region extending inwardly from an outer surface of the workpiece and having a volume of at least about 50%, or at least about 60%, or at least about 70%, or at least about 80% of the workpiece. It is recognized that at any time intermediate In non-limiting embodiments, heating (34) an outer surface region 36 of the workpiece 24 may be accomplished using one or more surface heating mechanisms 38 of the thermal management system 33. Examples of possible surface heating mechanisms successive press forging steps, the entire workpiece may be placed in a furnace or otherwise heated to a temperature with the workpiece forging temperature range.

In certain non-limiting embodiments, as an optional feature, between each of the A, B, and C forging hits the thermal management system 33 is used to heat the outer surface region 36 of the workpiece, and the adiabatically heated internal region is allowed to cool for an internal region cooling time so as to return the temperature of the workpiece to a substantially uniform temperature at or near the selected workpiece forging temperature. In certain other non-limiting embodiments according to the present disclosure, as an optional feature, between each of the A, B, and C forging hits the thermal management system 33 is used to heat the outer surface region 36 of the workpiece, and the adiabatically heated internal region is allowed to cool for an internal region cooling time so that the temperature of the workpiece returns to a substantially uniform temperature within the workpiece forging temperature range. Non-limiting embodiments of a method according to the present disclosure utilizing both (1) a thermal management system 33 to heat the outer surface region of the workpiece to a temperature within the workpiece forging temperature range and (2) a period during which the adiabatically heated internal region cools to a temperature within the workpiece forging temperature range may be referred to herein as "thermally managed, high strain rate multi-axis forging". 38 include, but are not limited to, flame heaters adapted for flame heating; induction heaters adapted for induction heating; and radiant heaters adapted for radiant heating of the outer surface of the workpiece 24. Other mechanisms and techniques for heating an outer surface region of the workpiece will be apparent to those having ordinary skill upon considering the present disclosure, and such mechanisms and techniques are within the scope of the present disclosure. A non-limiting embodiment of an outer surface region heating mechanism 38 may comprise a box furnace (not shown). A box furnace may be configured with various heating mechanisms to heat the outer surface region of the workpiece using one or more of flame heating mechanisms, radiant heating mechanisms, induction heating mechanisms, and any other suitable heating mechanism known now or hereafter to a person having ordinary skill in the art.

In another non-limiting embodiment, the temperature of the outer surface region 36 of the workpiece 24 optionally is heated (34) and maintained at or near the workpiece forging temperature and within the workpiece forging temperature range using one or more die heaters 40 of a thermal management system 33. Die heaters 40 may be used to maintain the dies 42 or the die press forging surfaces 44 of the dies at or near the workpiece forging temperature or at temperatures within the workpiece forging temperature range. In a non-limiting embodiment, the dies 42 of the thermal management system are heated to a temperature within a range that includes the workpiece forging temperature down to 100° F. (55.6° C.) below the workpiece forging temperature. Die heaters 40 may heat the dies 42 or the die press forging surface 44 by any suitable heating mechanism known now or hereafter by a person skilled in the art, including, but not limited to, flame heating mechanisms, radiant heating mechanisms, conduction heating mechanisms, and/or induction heating mechanisms. In a non-limiting embodiment, a die heater 40 may be a component of a box furnace (not shown). While the thermal management system 33 is shown in place and being used during the cooling steps (32),(52),(60) of the multi-axis forging process (26) shown in FIGS. 2(*b*), (*d*), and (*f*), it will be recognized that the thermal management system 33 may or may not be in place during the press forging steps (28),(46),(56) depicted in FIGS. 2(*a*), (*c*), and (*e*).

As shown in FIG. 3(*c*), an aspect of a non-limiting embodiment of a multi-axis forging method (26) according to the present disclosure comprises press forging (step 46) the workpiece 24 at a workpiece forging temperature in the workpiece forging temperature range in the direction (B) of a second orthogonal axis 48 of the workpiece 24 using a strain rate that is sufficient to adiabatically heat the workpiece 24, or at least an internal region of the workpiece 24, and plastically deform the workpiece 24. In a non-limiting embodiment, during press forging (46), the workpiece 24 is deformed to a plastic deformation of a 20% to 50% reduction in height or another dimension. In another non-limiting embodiment, during press forging (46), the workpiece 24 is plastically deformed to a plastic deformation of a 30% to 40% reduction in height or another dimension. In a non-limiting embodiment, the workpiece 24 may be press forged (46) in the direction of the second orthogonal axis 48 to the same spacer height used in the first press forging step (28). In another non-limiting embodiment, the workpiece 24 may be press forged in the direction of the second orthogonal axis 48 to a different spacer height than is used in the first press forging step (28). In another non-limiting embodiment, the internal region (not shown) of the workpiece 24 is adiabatically heated during the press forging step (46) to the same temperature as in the first press forging step (28). In other non-limiting embodiments, the high strain rates used for press forging (46) are in the same strain rate ranges as disclosed for the first press forging step (28).

In a non-limiting embodiment, as shown in FIGS. 2(*b*) and (*d*), the workpiece 24 may be rotated (50) between successive press forging steps (e.g., (28),(46),(56)) to present a different orthogonal axis to the forging surfaces. This rotation may be referred to as "A-B-C" rotation. It is understood that by using different forge configurations, it may be possible to rotate the ram on the forge instead of rotating the workpiece 24, or a forge may be equipped with multi-axis rams so that rotation of neither the workpiece nor the forge is required. Obviously, the important aspect is the relative change in position of the workpiece and the ram being used, and rotating (50) the workpiece 24 may be unnecessary or optional. In most current industrial equipment set-ups, however, rotating (50) the workpiece to a different orthogonal axis in between press forging steps will be required to complete the multi-axis forging process (26).

In non-limiting embodiments in which A-B-C rotation (50) is required, the workpiece 24 may be rotated manually by a forge operator or by an automatic rotation system (not shown) to provide A-B-C rotation (50). An automatic A-B-C rotation system may include, but is not limited to including, free-swinging clamp-style manipulator tooling or the like to enable a non-limiting thermally managed high strain rate multi-axis forging embodiment disclosed herein.

After press forging (46) the workpiece 24 in the direction of the second orthogonal axis 48, i.e., in the B-direction, and as shown in FIG. 3(*d*), process (20) optionally further comprises allowing (step 52) an adiabatically heated internal region (not shown) of the workpiece to cool to a temperature at or near the workpiece forging temperature, which is shown in FIG. 3(*d*). In certain non-limiting embodiments, internal region cooling times, or waiting times, may range, for example, from 5 seconds to 120 seconds, or from 10 seconds to 60 seconds, or from 5 seconds up to 5 minutes. It will be recognized by an ordinarily skilled person that the minimum cooling times are dependent upon the size, shape, and composition of the workpiece 24, as well as the characteristics of the environment surrounding the workpiece.

During the optional internal region cooling period, an optional aspect of a thermal management system 33 according to certain non-limiting embodiments disclosed herein comprises heating (step 54) an outer surface region 36 of the workpiece 24 to a temperature in the workpiece forging temperature range at or near the workpiece forging temperature. In this manner, the temperature of the workpiece 24 is maintained in a uniform or near uniform and substantially isothermal condition at or near the workpiece forging temperature prior to each high strain rate MAF hit. In non-limiting embodiments, when using the thermal management system 33 to heat the outer surface region 36, together with allowing the adiabatically heated internal region to cool for a specified internal region cooling time, the temperature of the workpiece returns to a substantially uniform temperature at or near the workpiece forging temperature between each A-B-C forging hit. In another non-limiting embodiment according to the present disclosure, when using the thermal management system 33 to heat the outer surface region 36, together with allowing the adiabatically heated internal region to cool for a specified internal region cooling time, the temperature of the workpiece returns to a substantially uniform temperature within the workpiece forging temperature range prior to each high strain rate MAF hit.

In a non-limiting embodiment, heating (54) an outer surface region 36 of the workpiece 24 may be accomplished using one or more outer surface heating mechanisms 38 of the thermal management system 33. Examples of possible heating mechanisms 38 may include, but are not limited to, flame heaters adapted for flame heating; induction heaters adapted for induction heating; and/or radiant heaters adapted for radiant heating of the workpiece 24. A non-limiting embodiment of a surface heating mechanism 38 may comprise a box furnace (not shown). Other mechanisms and techniques for heating an outer surface of the workpiece will be apparent to those having ordinary skill upon considering the present disclosure, and such mechanisms and techniques are within the scope of the present disclosure. A box furnace may be configured with various heating mechanisms to heat the outer surface of the workpiece, and such heating mechanisms may comprise one or more of flame heating mechanisms, radiant heating mechanisms, induction heating mechanisms, and/or any other heating mechanism known now or hereafter to a person having ordinary skill in the art.

In another non-limiting embodiment, the temperature of the outer surface region 36 of the workpiece 24 may be heated (54) and maintained at or near the workpiece forging temperature and within the workpiece forging temperature range using one or more die heaters 40 of a thermal management system 33. Die heaters 40 may be used to maintain the dies 42 or the die press forging surfaces 44 of the dies at or near the workpiece forging temperature or at temperatures within the workpiece forging temperature range. Die heaters 40 may heat the dies 42 or the die press forging surfaces 44 by any suitable heating mechanism known now or hereafter by a person skilled in the art, including, but not limited to, flame heating mechanisms, radiant heating mechanisms, conduction heating mechanisms, and/or induction heating mechanisms. In a non-limiting embodiment, a die heater 40 may be a component of a box furnace (not shown). While the thermal management system 33 is shown in place and being used during the equilibration and cooling steps (32),(52),(60) of the multi-axis forging process (26) shown in FIGS. 2(*b*), (*d*), and (*f*), it is recognized that the thermal management system 33 may or may not be in place during the press forging steps (28),(46),(56) depicted in FIGS. 2(*a*), (*c*), and (*e*).

As shown in FIG. 3(*e*), an aspect of an embodiment of multi-axis forging (26) according to the present disclosure comprises press forging (step 56) the workpiece 24 at a workpiece forging temperature in the workpiece forging temperature range in the direction (C) of a third orthogonal axis 58 of the workpiece 24 using a ram speed and strain rate that are sufficient to adiabatically heat the workpiece 24, or at least adiabatically heat an internal region of the workpiece, and plastically deform the workpiece 24. In a non-limiting embodiment, the workpiece 24 is deformed during press forging (56) to a plastic deformation of a 20% to 50% reduction in height or another dimension. In another non-limiting embodiment, during press forging (56) the workpiece is plastically deformed to a plastic deformation of a 30% to 40% reduction in height or another dimension. In a non-limiting embodiment, the workpiece 24 may be press forged (56) in the direction of the third orthogonal axis 58 to the same spacer height used in the first press forging step (28) and/or the second forging step (46). In another non-limiting embodiment, the workpiece 24 may be press forged in the direction of the third orthogonal axis 58 to a different spacer height than used in the first press forging step (28). In another non-limiting embodiment according to the disclosure, the internal region (not shown) of the workpiece 24 is adiabatically heated during the press forging step (56) to the same temperature as in the first press forging step (28). In other non-limiting embodiments, the high strain rates used for press forging (56) are in the same strain rate ranges as disclosed for the first press forging step (28).

In a non-limiting embodiment, as shown by arrow 50 in FIGS. 3(*b*), 3(*d*), and 3(*e*) the workpiece 24 may be rotated (50) to a different orthogonal axis between successive press forging steps (e.g., 46,56). As discussed above, this rotation may be referred to as A-B-C rotation. It is understood that by using different forge configurations, it may be possible to rotate the ram on the forge instead of rotating the workpiece 24, or a forge may be equipped with multi-axis rams so that rotation of neither the workpiece nor the forge is required. Therefore, rotating 50 the workpiece 24 may be unnecessary or an optional step. In most current industrial set-ups, however, rotating 50 the workpiece to a different orthogonal axis between press forging steps will be required to complete the multi-axis forging process (26).

After press forging 56 the workpiece 24 in the direction of the third orthogonal axis 58, i.e., in the C-direction, and as shown in FIG. 3(*e*), process 20 optionally further comprises allowing (step 60) an adiabatically heated internal region (not shown) of the workpiece to cool to a temperature at or near the workpiece forging temperature, which is indicated in FIG. 3(*f*). Internal region cooling times may range, for example, from 5 seconds to 120 seconds, from 10 seconds to 60 seconds, or from 5 seconds up to 5 minutes, and it is recognized by a person skilled in the art that the cooling times are dependent upon the size, shape, and composition of the workpiece 24, as well as on the characteristics of the environment surrounding the workpiece.

During the optional cooling period, an optional aspect of a thermal management system 33 according to non-limiting embodiments disclosed herein comprises heating (step 62) an outer surface region 36 of the workpiece 24 to a temperature at or near the workpiece forging temperature. In this manner, the temperature of the workpiece 24 is maintained in a uniform or near uniform and substantially isothermal condition at or near the workpiece forging temperature prior to each high strain rate MAF hit. In non-limiting embodiments, by using the thermal management system 33 to heat the outer surface region 36, together with allowing the adiabatically heated internal region to cool for a specified internal region cooling time, the temperature of the workpiece returns to a substantially uniform temperature at or near the workpiece forging temperature between each A-B-C forging hit. In another non-limiting embodiment according to the present disclosure, by using the thermal management system 33 to heat the outer surface region 36, together with allowing the adiabatically heated internal region to cool for a specified internal region cooling time, the temperature of the workpiece returns to a substantially isothermal condition within the workpiece forging temperature range between successive A-B-C forging hits.

In a non-limiting embodiment, heating (62) an outer surface region 36 of the workpiece 24 may be accomplished using one or more outer surface heating mechanisms 38 of the thermal management system 33. Examples of possible heating mechanisms 38 may include, but are not limited to, flame heaters for flame heating; induction heaters for induction heating; and/or radiant heaters for radiant heating of the workpiece 24. Other mechanisms and techniques for heating an outer surface of the workpiece will be apparent to those having ordinary skill upon considering the present disclosure, and such mechanisms and techniques are within the scope of the present disclosure. A non-limiting embodiment of a surface heating mechanism 38 may comprise a box furnace (not shown). A box furnace may be configured with various heating mechanisms to heat the outer surface of the workpiece using one or more of flame heating mechanisms, radiant heating mechanisms, induction heating mechanisms, and/or any other suitable heating mechanism known now or hereafter to a person having ordinary skill in the art.

In another non-limiting embodiment, the temperature of the outer surface region 36 of the workpiece 24 may be heated (62) and maintained at or near the workpiece forging temperature and within the workpiece forging temperature range using one or more die heaters 40 of a thermal management system 33. Die heaters 40 may be used to maintain the dies 42 or the die press forging surfaces 44 of the dies at or near the workpiece forging temperature or at temperatures within the temperature forging range. In a non-limiting embodiment, the dies 42 of the thermal management system are heated to a temperature within a range that includes the workpiece forging temperature to 100° F. (55.6° C.) below the workpiece forging temperature. Die heaters 40 may heat the dies 42 or the die press forging surface 44 by any suitable heating mechanism known now or hereafter by a person skilled in the art, including, but not limited to, flame heating mechanisms, radiant heating mechanisms, conduction heating mechanisms, and/or induction heating mechanisms. In a non-limiting embodiment, a die heater 40 may be a component of a box furnace (not shown). While the thermal management system 33 is shown in place and being used during the equilibration steps (32),(52),(60) of the multi-axis forging process show in FIGS. 2(*b*), (*d*), and (*f*), it will be recognized that the thermal management system 33 may or may not be in place during the press forging steps 28,46,56 depicted in FIGS. 2(*a*), (*c*), and (*e*).

An aspect of the present disclosure includes a non-limiting embodiment wherein one or more of the press forging steps along the three orthogonal axes of a workpiece are repeated until a total strain of at least 1.0 is achieved in the workpiece. The total strain is the total true strain. The phrase "true strain" is also known to a person skilled in the art as "logarithmic strain" or "effective strain". Referring to FIG. 2, this is exemplified by step (g), i.e., repeating (step 64) one or more of press forging steps (28),(46),(56) until a total strain of at least 1.0, or in the range of at least 1.0 up to less than 3.5 is achieved in the workpiece. It is further recognized that after the desired strain is achieved in any of the press forging steps (28) or (46) or (56) and further press forging is unnecessary, and the optional equilibration steps (La, allowing the internal region of the workpiece to cool to a temperature at or near the workpiece forging temperature (32) or (52) or (60) and heating the outer surface of the workpiece (34) or (54) or (62) to a temperature at or near the workpiece forging temperature) are not needed, the workpiece can simply be cooled to ambient temperature, in a non-limiting embodiment, by quenching in a liquid, or in another non-limiting embodiment, by air cooling or any faster rate of cooling.

It will be understood that in a non-limiting embodiment, the total strain is the total strain in the entire workpiece after multi-axis forging, as disclosed herein. In non-limiting embodiments according to the present disclosure, the total strain may comprise equal strains on each orthogonal axis, or the total strain may comprise different strains on one or more orthogonal axes.

According to a non-limiting embodiment, after beta annealing, a workpiece may be multi-axis forged at two different temperatures in the alpha-beta phase field. For example, referring to FIG. 3, repeating step (64) of FIG. 2 may include repeating one of more of steps (a)-(optional b), (c)-(optional d), and (e)-(optional f) at a first temperature in the alpha-beta phase field until a certain strain is achieved, and then repeating one or more of steps (a)-(optional b), (c)-(optional d), and (e)-(optional f) at a second temperature in the alpha-beta phase field until after a final press forging step (a), (b), or (c) (i.e., (28),(46), (56)) a total strain of at least 1.0, or in the range of at least 1.0 up to less than 3.5, is achieved in the workpiece. In a non-limiting embodiment, the second temperature in the alpha-beta phase field is lower than first temperature in the alpha-beta phase field. It is recognized that conducting the method so as to repeat one or more of steps (a)-(optional b), (c)-(optional d), and (e)-(optional f) at more than two MAF press forging temperatures is within the scope of the present disclosure as long as the temperatures are within the forging temperature range. It is also recognized that, in a non-limiting embodiment, the second temperature in the alpha-beta phase field is higher than the first temperature in the alpha-beta phase field.

In another non-limiting embodiment according to the present disclosure, different reductions are used for the A-axis hit, B-axis hit, and C-axis hit to provide equalized strain in all directions. Applying high strain rate MAF to introduce equalized strain in all directions results in less cracking of, and a more equiaxed alpha grain structure for, the workpiece. For example, non-equalized strain may be introduced into a cubic workpiece by starting with a 4-inch cube that is high strain rate forged on the A-axis to a height of 3.0 inches. This reduction on the A-axis causes the workpiece to swell along the B-axis and the C-axis. If a second reduction in the B-axis direction reduces the B-axis dimension to 3.0 inches, more strain is introduced in the workpiece on the B-axis than on the A-axis. Likewise, a subsequent hit in the C-axis direction to reduce the C-axis dimension to 3.0 inches would introduce more strain into the workpiece on the C-axis than on the A-axis or B-axis. As another example, to introduce equalized strain in all orthogonal directions, a 4-inch cubic workpiece is forged ("hit") on the A-axis to a height of 3.0 inches, rotated 90 degrees and hit on the B-axis to a height of 3.5 inches, and then rotated 90 degrees and hit on the C-axis to a height of 4.0 inches. This latter sequence will result in a cube having approximately 4 inch sides and including equalized strain in each orthogonal direction of the cube. A general equation for calculating reduction on each orthogonal axis of a cubic workpiece during high strain rate MAF is provided in Equation 1.

$$\text{strain} = -\ln(\text{spacer height}/\text{starting height}) \qquad \text{Equation 1:}$$

A general equation for calculating the total strain is provided by Equation 2:

$$\text{total strain} = \sum_{n}^{1} -\ln(\text{spacer height}/\text{starting height}) \qquad \text{Equation 2}$$

Different reductions can be performed by using spacers in the forging apparatus that provide different spacer heights, or by any alternate manner known to a person having ordinary skill in the art.

In a non-limiting embodiment according to the present disclosure, referring now to FIG. 5, and considering FIG. 3, a process (70) for the production of ultra-fine grain titanium alloy includes: beta annealing (71) a titanium alloy workpiece; cooling (72) the beta annealed workpiece 24 to a temperature below the beta transus temperature of the titanium alloy of the workpiece; heating (73) the workpiece 24 to a workpiece forging temperature within a workpiece forging temperature range that is within an alpha+beta phase field of the titanium alloy of the workpiece; and high strain rate MAF (74) the workpiece, wherein high strain rate MAF (74) includes press forging reductions to the orthogonal axes of the workpiece to different spacer heights. In a non-limiting embodiment of multi-axis forging (74) according to the present disclosure, the workpiece 24 is press forged (75) on the first orthogonal axis (A-axis) to a major reduction spacer height. The phrase "press forged . . . to major reduction spacer height", as used herein, refers to press forging the workpiece along an orthogonal axis to the desired final dimension of the workpiece along the specific orthogonal axis. Therefore, the term "major reduction spacer height" is defined as the spacer height used to attain the final dimension of the workpiece along each orthogonal axis. All press forging steps to major reduction spacer heights should occur using a strain rate sufficient to adiabatically heat an internal region of the workpiece.

After press forging (75) the workpiece 24 in the direction of the first orthogonal A-axis to a major reduction spacer height as shown in FIG. 3(*a*), the process (70) optionally further comprises allowing (step 76, indicated in FIG. 3(*b*)) an adiabatically heated internal region (not shown) of the workpiece to cool to a temperature at or near the workpiece forging temperature. Internal region cooling times may range, for example, from 5 seconds to 120 seconds, from 10 seconds to 60 seconds, or from 5 seconds up to 5 minutes, and a person having ordinary skill will recognize that required cooling times will be dependent upon the size, shape, and composition of the workpiece, as well as the characteristics of the environment surrounding the workpiece.

During the optional internal region cooling time period, an aspect of a thermal management system 33 according to non-limiting embodiments disclosed herein may comprise heating (step 77) an outer surface region 36 of the workpiece 24 to a temperature at or near the workpiece forging temperature. In this manner, the temperature of the workpiece 24 is maintained in a uniform or near uniform and substantially isothermal condition at or near the workpiece forging temperature prior to each high strain rate MAF hit. In certain non-limiting embodiments using the thermal management system 33 to heat the outer surface region 36, together with allowing the adiabatically heated internal region to cool for a specified internal region cooling time, the temperature of the workpiece returns to a substantially uniform temperature at or near the workpiece forging temperature intermediate each of the A, B, and C forging hits. In other non-limiting embodiments according to the present disclosure using the thermal management system 33 to heat the outer surface region 36, together with allowing the adiabatically heated internal region to cool for a specified internal region cooling time, the temperature of the workpiece returns to a substantially uniform temperature within the workpiece forging temperature range intermediate each of the A, B, and C forging hits.

In a non-limiting embodiment, heating (77) an outer surface region 36 of the workpiece 24 may be accomplished using one or more outer surface heating mechanisms 38 of the thermal management system 33. Examples of possible outer surface heating mechanisms 38 include, but are not limited to, flame heaters adapted for flame heating; induction heaters adapted for induction heating; and radiant heaters adapted for radiant heating of the workpiece 24. Other mechanisms and techniques for heating an outer surface region of the workpiece will be apparent to those having ordinary skill upon considering the present disclosure, and such mechanisms and techniques are within the scope of the present disclosure. A non-limiting embodiment of an outer surface region heating mechanism 38 may comprise a box furnace (not shown). A box furnace may be configured with various heating mechanisms to heat the outer surface region of the workpiece using, for example, one or more of flame heating mechanisms, radiant heating mechanisms, induction heating mechanisms, and/or any other suitable heating mechanism known now or hereafter to a person having ordinary skill in the art.

In another non-limiting embodiment, the temperature of the outer surface region 36 of the workpiece 24 may be heated (34) and maintained at or near the workpiece forging temperature and within the workpiece forging temperature range using one or more die heaters 40 of a thermal management system 33. Die heaters 40 may be used to maintain the dies 42 or the die press forging surfaces 44 of the dies at or near the workpiece forging temperature or at temperatures within the workpiece forging temperature range. In a non-limiting embodiment, the dies 42 of the thermal management system are heated to a temperature within a range that includes the workpiece forging temperature down to 100° F. (55.6° C.) below the workpiece forging temperature. Die heaters 40 may heat the dies 42 or the die press forging surface 44 by any suitable heating mechanism known now or hereafter by a person skilled in the art, including, but not limited to, flame heating mechanisms, radiant heating mechanisms, conduction heating mechanisms, and/or induction heating mechanisms. In a non-limiting embodiment, a die heater 40 may be a component of a box furnace (not shown). While the thermal management system 33 is shown in place and being used during the cooling steps of the multi-axis forging process, it is recognized that the thermal management system 33 may or may not be in place during the press forging steps.

In a non-limiting embodiment, after the press forging to a major reduction spacer height (75) on the A-axis (see FIG. 3), which is also referred to herein as reduction "A", and after the optional allowing (76) and heating (77) steps, if applied, subsequent press forgings to blocking reduction spacer heights, which may include optional heating and cooling steps, are applied on the B and C axes to "square-up" the workpiece. The phrase "press forging to a . . . blocking reduction spacer height", otherwise referred to herein as press forging to a first blocking reduction spacer height ((78),(87),(96)) and press forging to a second blocking reduction spacer ((81),(90),(99)), is defined as a press forging step that is used to reduce or "square-up" the bulging that occurs near the center of any face after press forging to major reduction spacer height. Bulging at or near the center of any face results in a triaxial stress state being introduced into the faces, which could result in cracking of the workpiece. The steps of press forging to a first reduction spacer height and press forging to a second blocking reduction spacer height, also referred to herein a first blocking reduction, second blocking reduction, or simply blocking reductions are employed to deform the bulged faces, so that the faces of the workpiece are flat or substantially flat before the next press forging to a major reduction spacer height along an orthogonal axis. The blocking reductions involve press forging to a spacer height that is greater than the spacer height used in each step of press forging to a major reduction spacer height. While the strain rate of all of the first and second blocking reductions disclosed herein may be sufficient to adiabatically heat an internal region of the workpiece, in a non-limiting embodiment, adiabatic heating during the first blocking and second blocking reductions may not occur because the total strain incurred in the first and second blocking reductions may not be sufficient to significantly adiabatically heat the workpiece. Because the blocking reductions are performed to spacer heights that are greater than those used in press forging to a major reduction spacer height, the strain added to the workpiece in a blocking reduction may not be enough to adiabatically heat an internal region of the workpiece. As will be seen, incorporation of the first and second blocking reductions in a high strain rate MAF process, in a non-limiting embodiment results in a forging sequence of at least one cycle consisting of: A-B-C-B-C-A-C, wherein A, B, and Ccomprise press forging to the major reduction spacer height, and wherein B, C, C, and A comprise press forging to first or second blocking reduction spacer heights; or in another non-limiting embodiment at least one cycle consisting of: A-B-C-B-C-A-C-A-B, wherein A, B, and C comprise press forging to the major reduction spacer height, and wherein B, C, C, A, A, and B comprise press forging to first or second blocking reduction spacer heights.

Referring again to FIGS. 3 and 5, in a non-limiting embodiment, after the step of press forging to a major reduction spacer height (75) on the first orthogonal axis (an A reduction), and, if applied, after the optional allowing (76) and heating (77) steps, as described above, the workpiece is press forged (78) on the B-axis to a first blocking reduction spacer height. While the strain rate of the first blocking reduction may be sufficient to adiabatically heat an internal region of the workpiece, in a non-limiting embodiment, adiabatic heating during the first blocking reduction may not occur because the strain incurred in the first blocking reduction may not be sufficient to significantly adiabatically heat the workpiece. Optionally, the adiabatically heated internal region of the workpiece is allowed (79) to cool to a temperature at or near the workpiece forging temperature, while the outer surface region of the workpiece is heated (80) to a temperature at or near the workpiece forging temperature. All cooling times and heating methods for the A reduction (75) disclosed hereinabove and in other embodiments of the present disclosure are applicable for steps (79) and (80) and to all optional subsequent steps of allowing the internal region of the workpiece to cool and heating the outer surface region of the workpiece.

The workpiece is next press forged (81) on the C-axis to a second blocking reduction spacer height that is greater than the major reduction spacer height. The first and second blocking reductions are applied to bring the workpiece back to substantially the pre-forging shape of the workpiece. While the strain rate of the second blocking reduction may be sufficient to adiabatically heat an internal region of the workpiece, in a non-limiting embodiment, adiabatic heating during the second blocking reduction may not occur because the strain incurred in the second blocking reduction may not be sufficient to significantly adiabatically heat the workpiece. Optionally, the adiabatically heated internal region of the workpiece is allowed (82) to cool to a temperature at or near the workpiece forging temperature, while the outer surface region of the workpiece is heated (83) to a temperature at or near the workpiece forging temperature.

The workpiece is next pressed forged to a major reduction spacer height (84) in the direction of the second orthogonal axis, or B-axis. Press forging to a major reduction spacer height on the B-axis (84) is referred to herein as a B reduction. After the B reduction (84), optionally, the adiabatically heated internal region of the workpiece is allowed (85) to cool to a temperature at or near the workpiece forging temperature, while the outer surface region of the workpiece is heated (86) to a temperature at or near the workpiece forging temperature.

The workpiece is next press forged (87) on the C-axis to a first blocking reduction spacer height that is greater than the major reduction spacer height. While the strain rate of the first blocking reduction may be sufficient to adiabatically heat an internal region of the workpiece, in a non-limiting embodiment, adiabatic heating during the first blocking reduction may not occur because the strain incurred in the first blocking reduction may not be sufficient to significantly adiabatically heat the workpiece. Optionally, the adiabatically heated internal region of the workpiece is allowed (88) to cool to a temperature at or near the workpiece forging temperature, while the outer surface region of the workpiece is heated (89) to a temperature at or near the workpiece forging temperature.

The workpiece is next press forged (90) on the A-axis to a second blocking reduction spacer height that is greater than the major reduction spacer height. The first and second blocking reductions are applied to bring the workpiece back to substantially the pre-forging shape of the workpiece. While the strain rate of the second blocking reduction may be sufficient to adiabatically heat an internal region of the workpiece, in a non-limiting embodiment, adiabatic heating during the second blocking reduction may not occur because the strain incurred in the second blocking reduction may not be sufficient to significantly adiabatically heat the workpiece. Optionally, the adiabatically heated internal region of the workpiece is allowed (91) to cool to a temperature at or near the workpiece forging temperature, while the outer surface region of the workpiece is heated (92) to a temperature at or near the workpiece forging temperature.

The workpiece is next press forged to a major reduction spacer height (93) in the direction of the third orthogonal axis, or C-axis. Press forging to the major reduction spacer height on the C-axis (93) is referred to herein as a C reduction. After the C reduction (93), optionally, the adiabatically heated internal region of the workpiece is allowed (94) to cool to a temperature at or near the workpiece forging temperature, while the outer surface region of the workpiece is heated (95) to a temperature at or near the workpiece forging temperature.

The workpiece is next press forged (96) on the A-axis to a first blocking reduction spacer height that is greater than the major reduction spacer height. While the strain rate of the first blocking reduction may be sufficient to adiabatically heat an internal region of the workpiece, in a non-limiting embodiment, adiabatic heating during the first blocking reduction may not occur because the strain incurred in the first blocking reduction may not be sufficient to significantly adiabatically heat the workpiece. Optionally, the adiabatically heated internal region of the workpiece is allowed (97) to cool to a temperature at or near the workpiece forging temperature, while the outer surface region of the workpiece is heated (98) to a temperature at or near the workpiece forging temperature.

The workpiece is next press forged (99) on the B-axis to a second blocking reduction spacer height that is greater than the major reduction spacer height. The first and second blocking reductions are applied to bring the workpiece back to substantially the pre-forging shape of the workpiece. While the strain rate of the second blocking reduction may be sufficient to adiabatically heat an internal region of the workpiece, in a non-limiting embodiment, adiabatic heating during the second blocking reduction may not occur because the strain incurred in the second blocking reduction may not be sufficient to significantly adiabatically heat the workpiece. Optionally, the adiabatically heated internal region of the workpiece is allowed (100) to cool to a temperature at or near the workpiece forging temperature, while the outer surface region of the workpiece is heated (101) to a temperature at or near the workpiece forging temperature.

Figure 5:
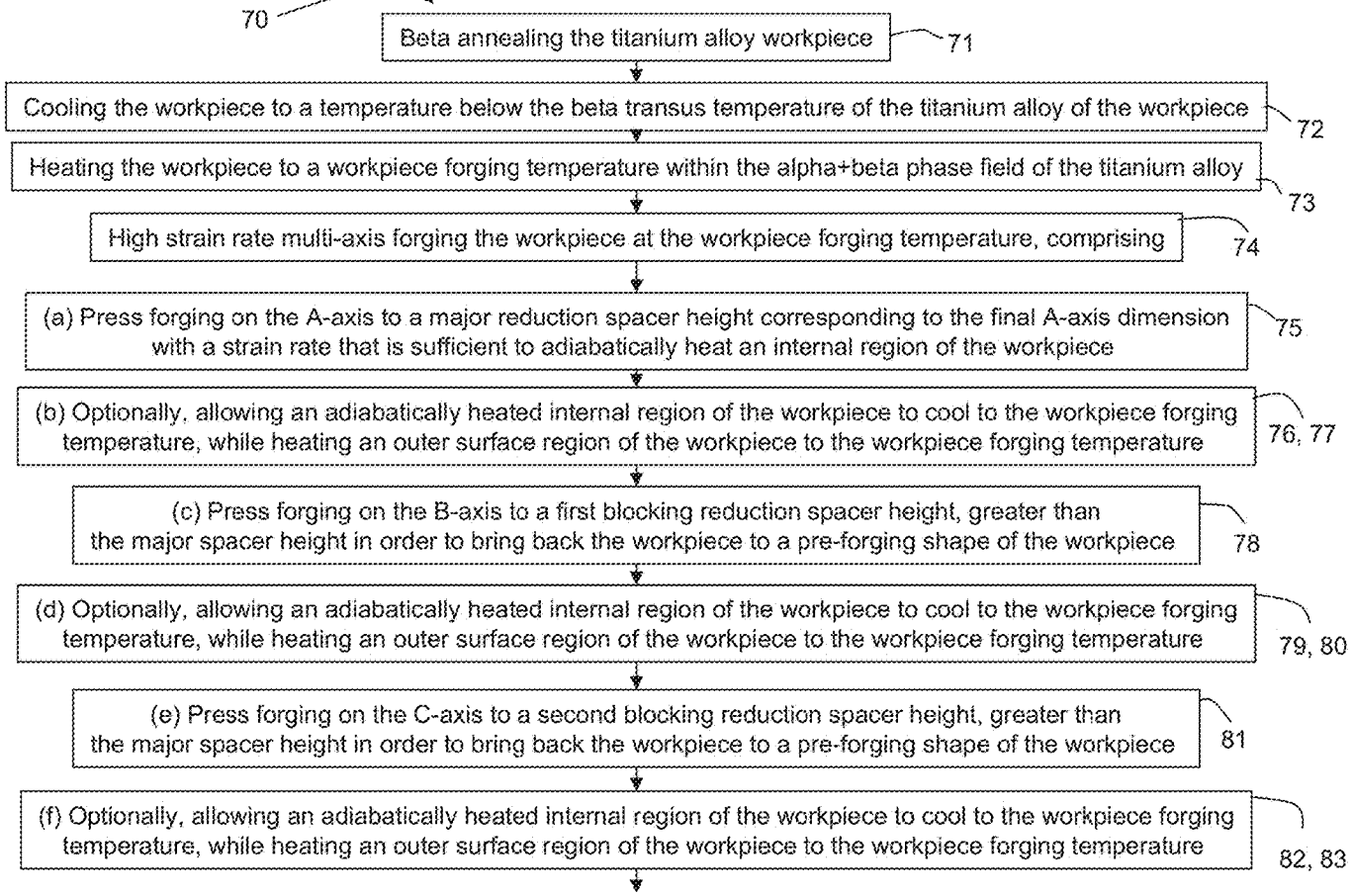
FIG. 5 is a flow chart listing steps of a non-limiting embodiment of a method for processing titanium alloys according to the present disclosure including major orthogonal reductions to the final desired dimension of the workpiece and first and second blocking reductions.
Figure 5:
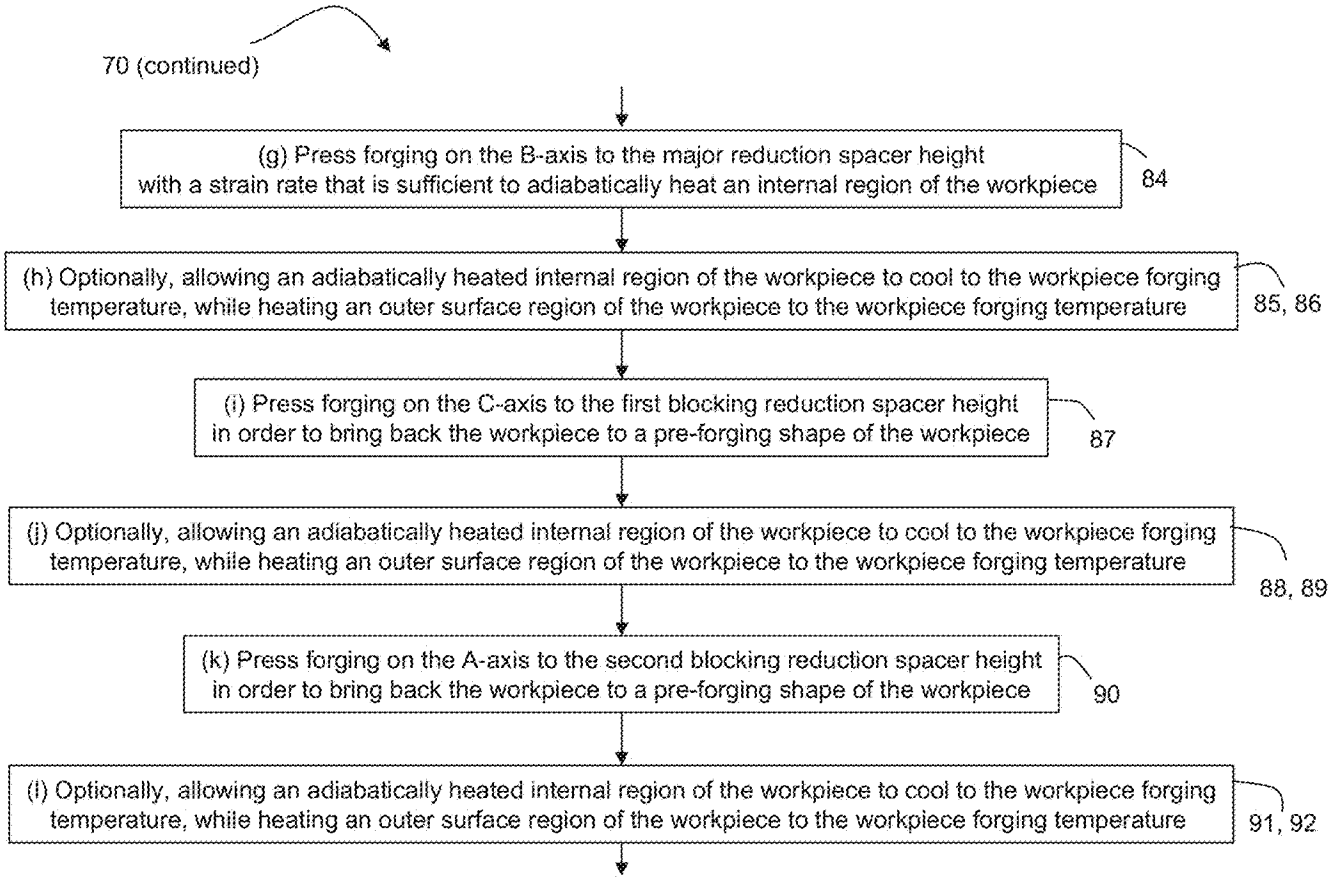
Figure 5:
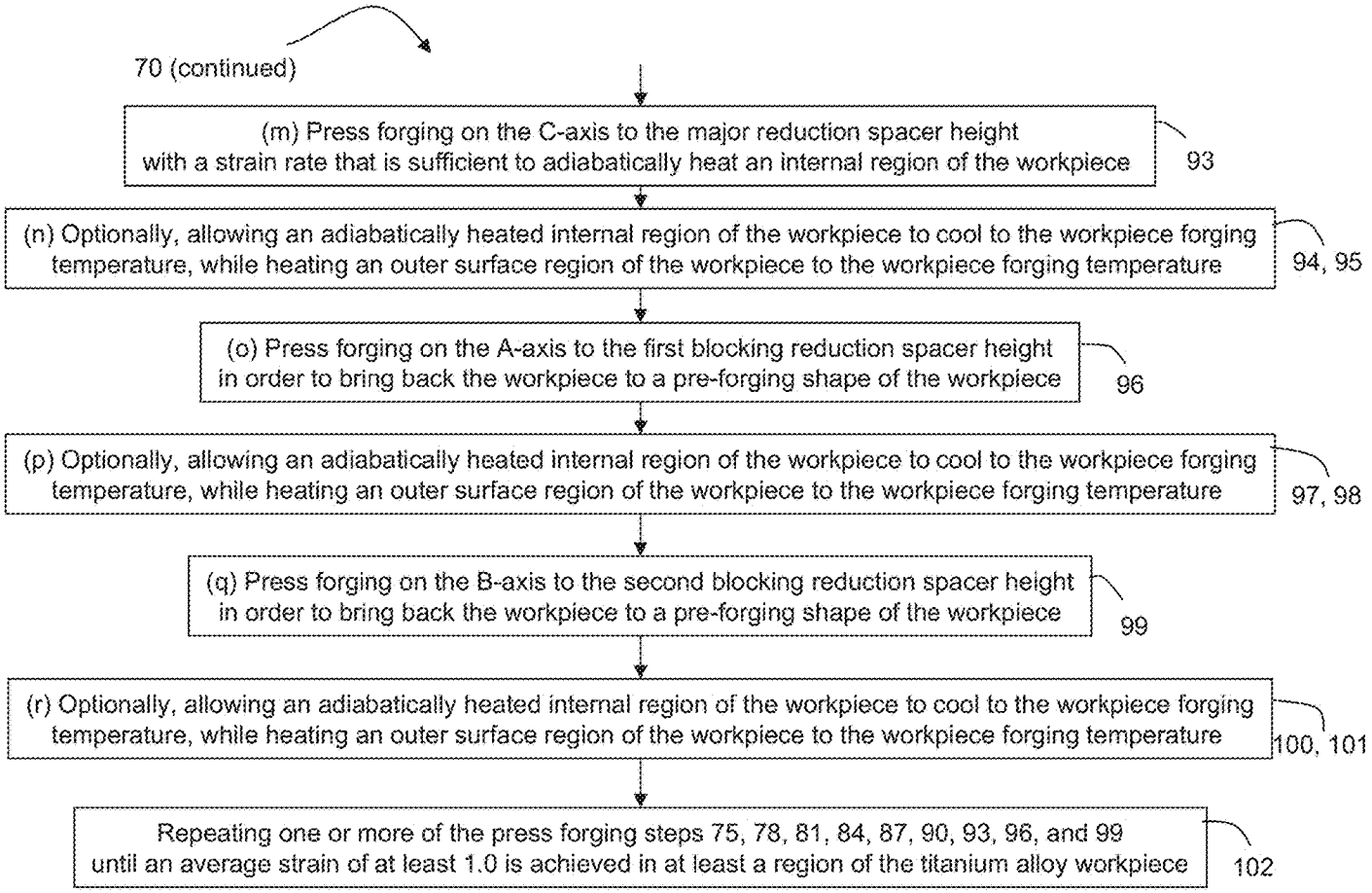

Referring to FIG. 5, in non-limiting embodiments, one or more of press forging steps (75), (78), (81), (84), (87), (90), (93), (96), and (99) are repeated (102) until a total strain of at least 1.0 is achieved the titanium alloy workpiece. In another non-limiting embodiment, one or more of press forging steps (75), (78), (81), (84), (87), (90), (93), (96), and (99) are repeated (102) until a total strain in a range of at least 1.0 up to less than 3.5 is achieved in the titanium alloy workpiece. It will be recognized that after achieving the desired strain of at least 1.0, or alternatively the desired strain in a range of at least 1.0 up to less than 3.5, in any of the press forging steps (75), (78), (81), (84), (87), (90), (93), (96), and (99), the optional intermediate equilibration steps (i.e., allowing the internal region of the workpiece to cool (76), (79), (82), (85), (88), (91), (94), (97), or (100), and heating the outer surface of the workpiece (77), (80), (83), (86), (89), (92), (95), (98), or (101)) are not needed, and the workpiece can be cooled to ambient temperature. In a non-limiting embodiment, cooling comprise liquid quenching, such as, for example, water quenching. In another non-limiting embodiment, cooling comprises cooling with a cooling rate of air cooling or faster.

The process described above includes a repeated sequence of press forging to a major reduction spacer height followed by press forging to first and second blocking reduction spacer heights. A forging sequence that represents one total MAF cycle as disclosed in the above-described non-limiting embodiment may be represented as A-B-C-B-C-A-C-A-B, wherein the reductions (hits) that are in bold and underlined are press forgings to a major reduction spacer height, and the reductions that are not in bold or underlined are first or second blocking reductions. It will be understood that all press forging reductions, including press forging to major reduction spacer heights and the first and second blocking reductions, of the MAF process according to the present disclosure are conducted with a high strain rate that is sufficient to adiabatically heat the internal region of the workpiece, e.g., and without limitation, a strain rate in the range of 0.2 $s^{-1}$ to 0.8 $s^{-1}$, or in the range of 0.2 $s^{-1}$ to 0.4 $s^{-1}$. It will also be understood that adiabatic heating may not substantially occur during the first and second blocking reductions due to the lower degree of deformation in these reductions, as compared to the major reductions. It also will be understood that, as optional steps, intermediate successive press forging reductions the adiabatically heated internal region of the workpiece is allowed to cool to a temperature at or near the workpiece forging temperature, and the outer surface of the workpiece is heated to a temperature at or near the workpiece forging temperature utilizing the thermal management system disclosed herein. It is believed that these optional steps may be more beneficial when the method is used to process larger sized workpieces. It is further understood that the A-B-C-B-C-A-C-A-B forging sequence embodiment described herein may be repeated in whole or in part until a total strain of at least 1.0, or in the range of at least 1.0 up to less than 3.5, is achieved in the workpiece.

Bulging in the workpiece results from a combination of surface die lock and the presence of hotter material near the center of the workpiece. As bulging increases, each face center is subjected to increasingly triaxial loads that can initiate cracking. In the A-B-C-B-C-A-C-A-B sequence, the use of blocking reductions intermediate each press forging to a major reduction spacer height reduces the tendency for crack formation in the workpiece. In a non-limiting embodiment, when the workpiece is in the shape of a cube, the first blocking reduction spacer height for a first blocking reduction may be to a spacer height that is 40-60% larger than the major reduction spacer height. In a non-limiting embodiment, when the workpiece is in the shape of a cube, the second blocking reduction spacer height for the second blocking reduction may be to a spacer height that is 15-30% larger than the major reduction spacer height. In another non-limiting embodiment, the first blocking reduction spacer height may be substantially equivalent to the second blocking reduction spacer height.

In non-limiting embodiments of thermally managed, high strain rate multi-axis forging according to the present disclosure, after a total strain of at least 1.0, or in the range of at least 1.0 up to less than 3.5, the workpiece comprises an average alpha particle grain size of 4 μm or less, which is considered to be an ultra-fine grain (UFG) size. In a non-limiting embodiment according to the present disclosure, applying a total strain of at least 1.0, or in the range of at least 1.0 up to less than 3.5, produces grains that are equiaxed.

In a non-limiting embodiment of a process according to the present disclosure comprising multi-axis forging and use of the optional thermal management system, the workpiece-press die interface is lubricated with lubricants known to those of ordinary skill, such as, but not limited to, graphite, glasses, and/or other known solid lubricants.

In certain non-limiting embodiments of methods according to the present disclosure, the workpiece comprises a titanium alloy selected from alpha+beta titanium alloys and metastable beta titanium alloys. In another non-limiting embodiment, the workpiece comprises an alpha+beta titanium alloy. In still another non-limiting embodiment, the workpiece comprises a metastable beta titanium alloy. In a non-limiting embodiment, a titanium alloy processed by the method according to the present disclosure comprises effective alpha phase precipitation and growth kinetics that are slower than those of Ti-6-4 alloy (UNS R56400), and such kinetics may be referred to herein as "slower alpha kinetics". In a non-limiting embodiment, slower alpha kinetics is achieved when the diffusivity of the slowest diffusing alloying species in the titanium alloy is slower than the diffusivity of aluminum in Ti-6-4 alloy at the beta transus temperature ($T_\beta$). For example, Ti-6-2-4-2 alloy exhibits slower alpha kinetics than Ti-6-4 alloy as a result of the presence of additional grain pinning elements, such as silicon, in the Ti-6-2-4-2 alloy. Also, Ti-6-2-4-6 alloy has slower alpha kinetics than Ti-6-4 alloy as a result of the presence of additional beta stabilizing alloy additions, such as higher molybdenum content than T-6-4 alloy. The result of slower alpha kinetics in these alloys is that beta annealing the Ti-6-2-4-6 and Ti-6-2-4-2 alloys prior to high strain rate MAF produces a relatively fine and stable alpha lath size and a fine beta-phase structure as compared with Ti-6-4 alloy and certain other titanium alloys exhibiting faster alpha phase precipitation and growth kinetics than Ti-6-2-4-6 and Ti-6-2-4-2 alloys. The phrase "slower alpha kinetics" is discussed in further detail earlier in the present disclosure. Exemplary titanium alloys that may be processed using embodiments of methods according to the present disclosure include, but are not limited to, Ti-6-2-4-2 alloy, Ti-6-2-4-6 alloy, ATI 425® alloy (Ti-4Al-2.5V alloy), Ti-6-6-2 alloy, and Ti-6Al-7Nb alloy.

In a non-limiting embodiment of the method according to the present disclosure, beta annealing comprises: heating the workpiece to a beta annealing temperature; holding the workpiece at the beta annealing temperature for an annealing time sufficient to form a 100% titanium beta phase microstructure in the workpiece; and cooling the workpiece directly to a temperature at or near the workpiece forging temperature. In certain non-limiting embodiments, the beta annealing temperature is in a temperature range of the beta transus temperature of the titanium alloy up to 300° F. (111° C.) above the beta transus temperature of the titanium alloy. Non-limiting embodiments include a beta annealing time from 5 minutes to 24 hours. A person skilled in the art, upon reading the present description, will understand that other beta annealing temperatures and beta annealing times are within the scope of embodiments of the present disclosure and that, for example, relatively large workpieces may require relatively higher beta annealing temperatures and/or longer beta annealing times to form a 100% beta phase titanium microstructure.

In certain non-limiting embodiments in which the workpiece is held at a beta annealing temperature to form a 100% beta phase microstructure, the workpiece may also be plastically deformed at a plastic deformation temperature in the beta phase field of the titanium alloy prior to cooling the workpiece to a temperature at or near the workpiece forging temperature or to ambient temperature. Plastic deformation of the workpiece may comprise at least one of drawing, upset forging, and high strain rate multi-axis forging the workpiece. In a non-limiting embodiment, plastic deformation in the beta phase region comprises upset forging the workpiece to a beta-upset strain in the range of 0.1 to 0.5. In certain non-limiting embodiments, the plastic deformation temperature is in a temperature range including the beta transus temperature of the titanium alloy up to 300° F. (111° C.) above the beta transus temperature of the titanium alloy.

Figure 6:
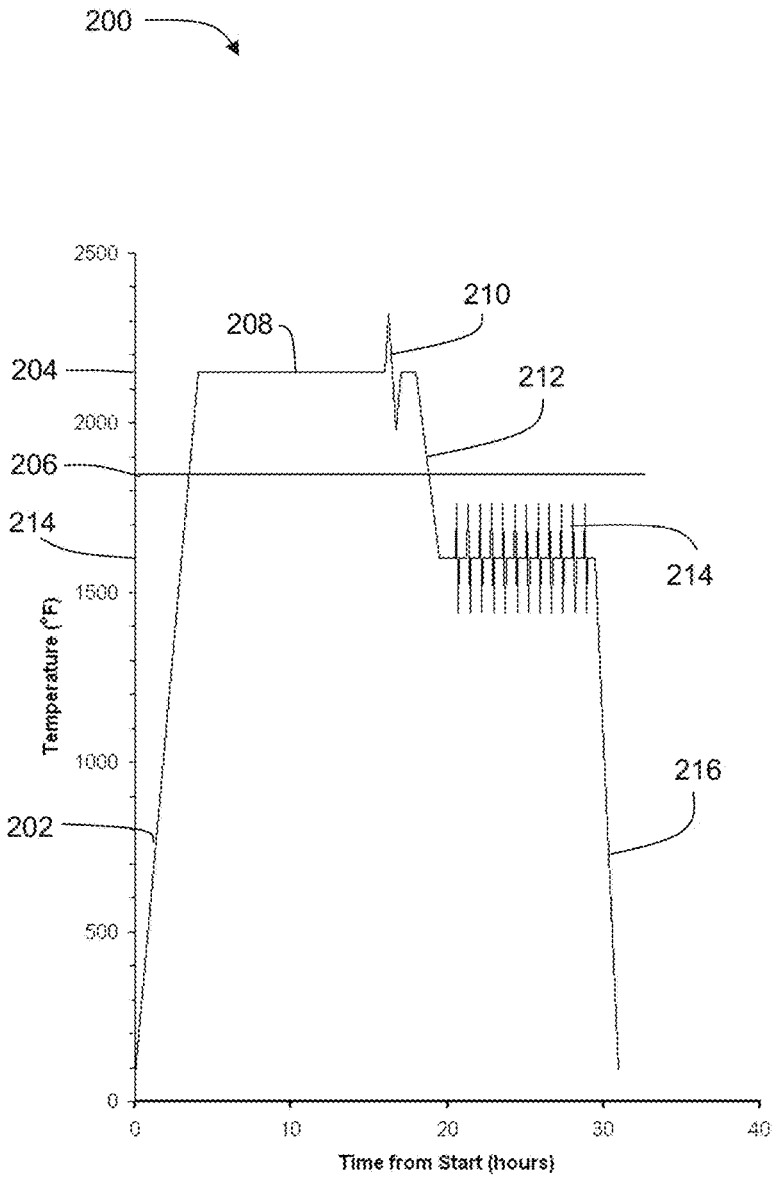
FIG. 6 is a temperature-time thermomechanical process chart for a non-limiting embodiment of a high strain rate multi-axis forging method according to the present disclosure.

FIG. 6 is a temperature-time thermomechanical process chart for a non-limiting method of plastically deforming the workpiece above the beta transus temperature and directly cooling to the workpiece forging temperature. In FIG. 6, a non-limiting method 200 comprises heating 202 a workpiece comprising a titanium alloy having alpha precipitation and growth kinetics that are slower than those of Ti-6-4 alloy, for example, to a beta annealing temperature 204 above the beta transus temperature 206 of the titanium alloy, and holding or "soaking" 208 the workpiece at the beta annealing temperature 204 to form an all beta titanium phase microstructure in the workpiece. In a non-limiting embodiment according to the present disclosure, after soaking 208, the workpiece may be plastically deformed 210. In a non-limiting embodiment, plastic deformation 210 comprises upset forging. In a non-limiting embodiment, plastic deformation 210 comprises upset forging to a true strain of 0.3. In a non-limiting embodiment, plastically deforming 210 comprises thermally managed high strain rate multi-axis forging (not shown in FIG. 6) at a beta annealing temperature.

Still referring to FIG. 6, after plastic deformation 210 in the beta phase field, in a non-limiting embodiment the workpiece is cooled 212 to a workpiece forging temperature 214 in the alpha+beta phase field of the titanium alloy. In a non-limiting embodiment, cooling 212 comprises air cooling or cooling at a rate faster than achieved through air cooling. In another non-limiting embodiment, cooling comprises liquid quenching, such as, but not limited to, water quenching. After cooling 212, the workpiece is high strain rate multi-axis forged 214 according to certain non-limiting embodiments of the present disclosure. In the non-limiting embodiment of FIG. 6, the workpiece is hit or press forged 12 times, i.e., the three orthogonal axes of the workpiece are non-sequentially press forged a total of 4 times each. In other words, referring to FIGS. 2 and 6, the cycle including steps (a)-(optional b), (c)-(optional d), and (e)-(optional f) is performed 4 times. In the non-limiting embodiment of FIG. 6, after a multi-axis forging sequence involving 12 hits, the total strain may be equal to, for example, at least 1.0, or may be in the range of at least 1.0 up to less than 3.5. After multi-axis forging 214, the workpiece is cooled 216 to ambient temperature. In a non-limiting embodiment, cooling 216 comprises air cooling or cooling at a rate faster than achieved through air cooling, but other forms of cooling, such as, but not limited to, fluid or liquid quenching are within the scope of embodiments disclosed herein.

Figure 7:
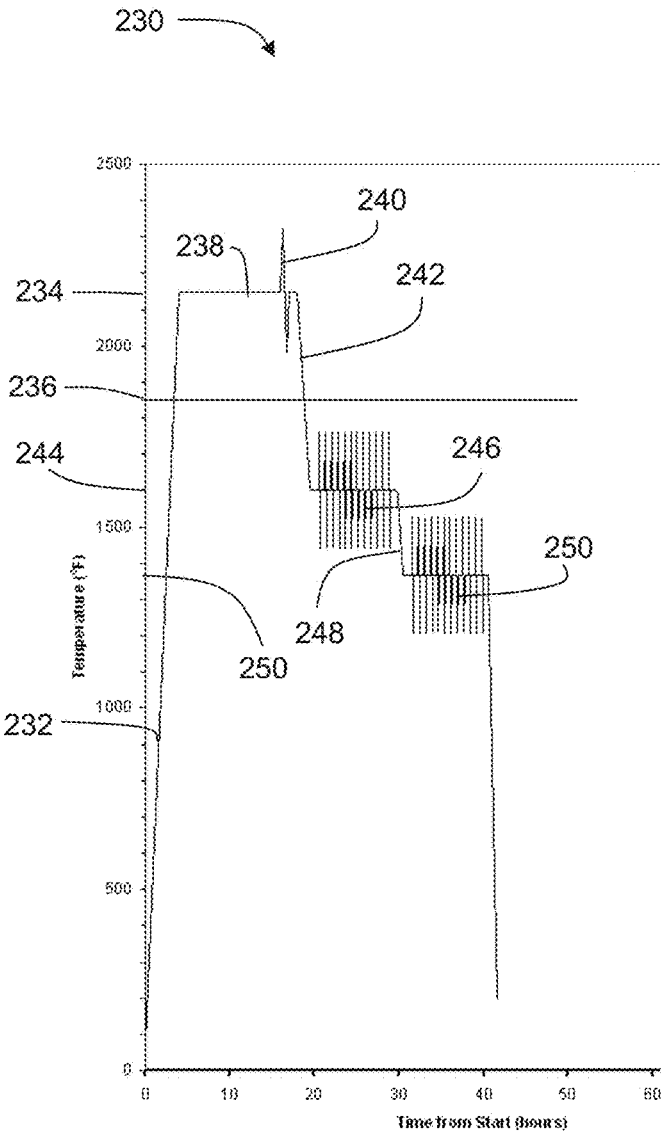
FIG. 7 is a temperature-time thermomechanical process chart for a non-limiting embodiment of a multi-temperature high strain rate multi-axis forging method according to the present disclosure.

A non-limiting aspect of the present disclosure includes high strain rate multi-axis forging at two temperatures in the alpha+beta phase field. FIG. 7 is a temperature-time thermomechanical process chart for a non-limiting method according to the present disclosure that comprises multi-axis forging the titanium alloy workpiece at a first workpiece forging temperature; optionally utilizing a non-limiting embodiment of the thermal management feature disclosed hereinabove; cooling to a second workpiece forging temperature in the alpha+beta phase; multi-axis forging the titanium alloy workpiece at the second workpiece forging temperature; and optionally utilizing a non-limiting embodiment of the thermal management feature disclosed herein.

In FIG. 7, a non-limiting method 230 according to the present disclosure comprises heating 232 the workpiece to a beta annealing temperature 234 above the beta transus temperature 236 of the alloy and holding or soaking 238 the workpiece at the beta annealing temperature 234 to form an all beta phase microstructure in the titanium alloy workpiece. After soaking 238, the workpiece may be plastically deformed 240. In a non-limiting embodiment, plastic deformation 240 comprises upset forging. In another non-limiting embodiment, plastic deformation 240 comprises upset forging to a strain of 0.3. In yet another non-limiting embodiment, plastically deforming 240 the workpiece comprises high strain multi-axis forging (not shown in FIG. 7) at a beta annealing temperature.

Still referring to FIG. 7, after plastic deformation 240 in the beta phase field, the workpiece is cooled 242 to a first workpiece forging temperature 244 in the alpha+beta phase field of the titanium alloy. In non-limiting embodiments, cooling 242 comprises one of air cooling and liquid quenching. After cooling 242, the workpiece is high strain rate multi-axis forged 246 at the first workpiece forging temperature, and optionally a thermal management system according to non-limiting embodiments disclosed herein is employed. In the non-limiting embodiment of FIG. 7, the workpiece is hit or press forged at the first workpiece forging temperature 12 times with 90° rotation between each hit, i.e., the three orthogonal axes of the workpiece are press forged 4 times each. In other words, referring to FIG. 2, the cycle including steps (a)-(optional b), (c)-(optional d), and (e)-(optional f) is performed 4 times. In the non-limiting embodiment of FIG. 7, after high strain rate multi-axis forging 246 the workpiece at the first workpiece forging temperature, the titanium alloy workpiece is cooled 248 to a second workpiece forging temperature 250 in the alpha+beta phase field. After cooling 248, the workpiece is high strain rate multi-axis forged 250 at the second workpiece forging temperature, and optionally a thermal management system according to non-limiting embodiments disclosed herein is employed. In the non-limiting embodiment of FIG. 7, the workpiece is hit or press forged at the second workpiece forging temperature a total of 12 times. It is recognized that the number of hits applied to the titanium alloy workpiece at the first and second workpiece forging temperatures can vary depending upon the desired true strain and desired final grain size, and that the number of hits that is appropriate can be determined without undue experimentation upon considering the present disclosure. After multi-axis forging 250 at the second workpiece forging temperature, the workpiece is cooled 252 to ambient temperature. In non-limiting embodiments, cooling 252 comprises one of air cooling and liquid quenching to ambient temperature.

In a non-limiting embodiment, the first workpiece forging temperature is in a first workpiece forging temperature range of more than 100° F. (55.6° C.) below the beta transus temperature of the titanium alloy to 500° F. (277.8° C.) below the beta transus temperature of the titanium alloy, i.e., the first workpiece forging temperature $T_1$ is in the range of $T_\beta-100°\ F.>T_1\geq T_\beta-500°\ F.$ In a non-limiting embodiment, the second workpiece forging temperature is in a second workpiece forging temperature range of more than 200° F. (277.8° C.) below the beta transus temperature of the titanium alloy to 700° F. (388.9° C.) below the beta transus temperature, i.e., the second workpiece forging temperature $T_2$ is in the range of $T_\beta-200°\ F.>T_2\geq T_\beta-700°\ F.$ In a non-limiting embodiment, the titanium alloy workpiece comprises Ti-6-2-4-2 alloy; the first workpiece temperature is 1650° F. (898.9° C.); and the second workpiece forging temperature is 1500° F. (815.6° C.).

Figure 8:
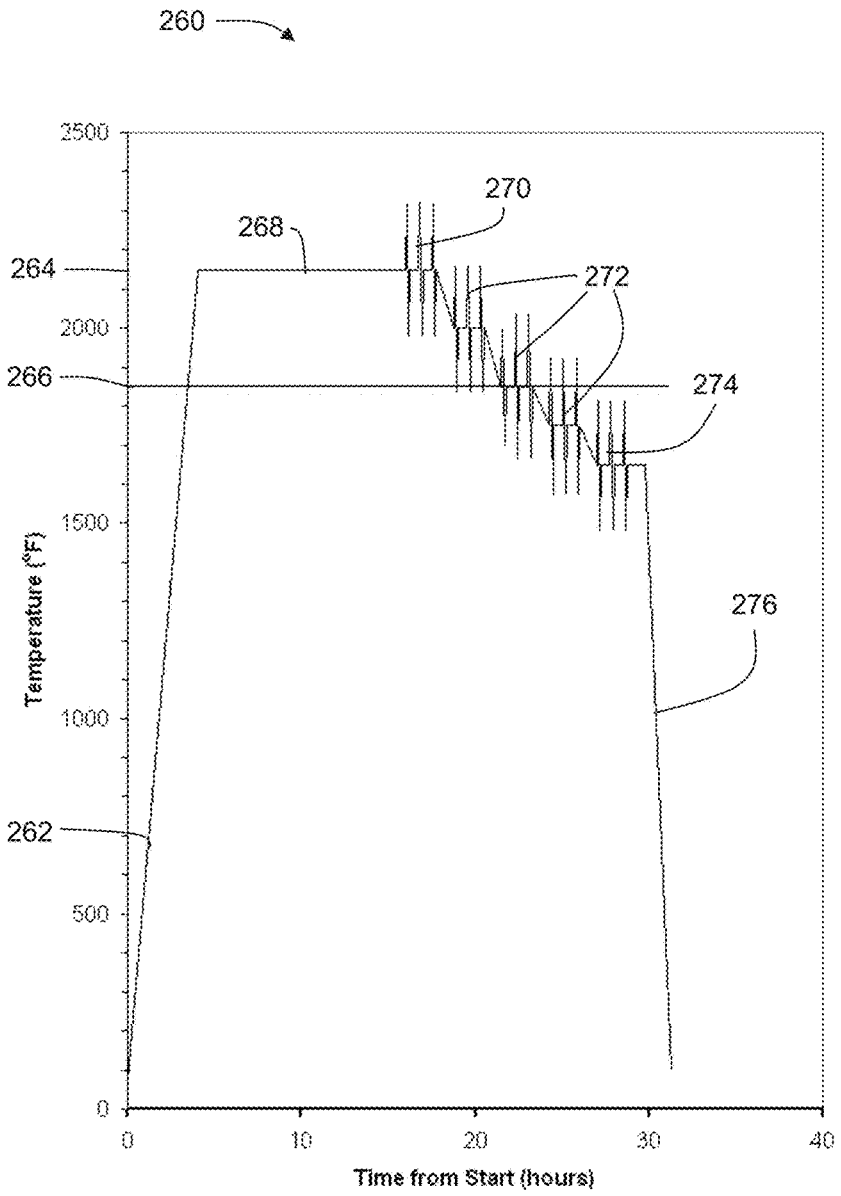
FIG. 8 is a temperature-time thermomechanical process chart for a non-limiting embodiment of a through beta transus high strain rate multi-axis forging method according the present disclosure.

FIG. 8 is a temperature-time thermomechanical process chart of a non-limiting method embodiment according to the present disclosure for plastically deforming a workpiece comprising a titanium alloy above the beta transus temperature and cooling the workpiece to the workpiece forging temperature, while simultaneously employing thermally managed high strain rate multi-axis forging on the workpiece according to non-limiting embodiments herein. In FIG. 8, a non-limiting method 260 of using thermally managed high strain rate multi-axis forging for grain refining of a titanium alloy comprises heating 262 the workpiece to a beta annealing temperature 264 above the beta transus temperature 266 of the titanium alloy and holding or soaking 268 the workpiece at the beta annealing temperature 264 to form an all beta phase microstructure in the workpiece. After soaking 268 the workpiece at the beta annealing temperature, the workpiece is plastically deformed 270. In a non-limiting embodiment, plastic deformation 270 may comprise thermally managed high strain rate multi-axis forging. In a non-limiting embodiment, the workpiece is repetitively high strain rate multi-axis forged 272 using the optional thermal management system as disclosed herein as the workpiece cools through the beta transus temperature. FIG. 8 shows three intermediate high strain rate multi-axis forging 272 steps, but it will be understood that there can be more or fewer intermediate high strain rate multi-axis forging 272 steps, as desired. The intermediate high strain rate multi-axis forging 272 steps are intermediate to the initial high strain rate multi-axis forging step 270 at the soaking temperature and the final high strain rate multi-axis forging step in the alpha+beta phase field 274 of the titanium alloy. While FIG. 8 shows one final high strain rate multi-axis forging step wherein the temperature of the workpiece remains entirely in the alpha+beta phase field, it will be understood on reading the present description that more than one multi-axis forging step could be performed in the alpha+beta phase field for further grain refinement. According to non-limiting embodiments of the present disclosure, at least one final high strain rate multi-axis forging step takes place entirely at temperatures in the alpha+beta phase field of the titanium alloy workpiece.

Because the multi-axis forging steps 270,272,274 take place as the temperature of the workpiece cools through the beta transus temperature of the titanium alloy, a method embodiment such as is shown in FIG. 8 is referred to herein as "through beta transus high strain rate multi-axis forging". In a non-limiting embodiment, the thermal management system (33 of FIG. 3) is used in through beta transus multi-axis forging to maintain the temperature of the workpiece at a uniform or substantially uniform temperature prior to each hit at each through beta transus forging temperature and, optionally, to slow the cooling rate. After final multi-axis forging 274 the workpiece forging temperature in the alpha+beta phase field, the workpiece is cooled 276 to ambient temperature. In a non-limiting embodiment, cooling 276 comprises air cooling.

Non-limiting embodiments of multi-axis forging using a thermal management system, as disclosed hereinabove, can be used to process titanium alloy workpieces having cross sections greater than 4 square inches using conventional forging press equipment, and the size of cube-shaped workpieces can be scaled to match the capabilities of an individual press. It has been determined that alpha lamellae or laths from the β-annealed structure break down easily to fine uniform alpha grains at workpiece forging temperatures disclosed in non-limiting embodiments herein. It has also been determined that decreasing the workpiece forging temperature decreases the alpha particle size (grain size).

While not wanting to be held to any particular theory, it is believed that grain refinement that occurs in non-limiting embodiments of thermally managed, high strain rate multi-axis forging according to the present disclosure occurs via meta-dynamic recrystallization. In the prior art slow strain rate multi-axis forging process, dynamic recrystallization occurs instantaneously during the application of strain to the material. It is believed that in high strain rate multi-axis forging according to the present disclosure, meta-dynamic recrystallization occurs at the end of each deformation or forging hit, while at least the internal region of the workpiece is hot from adiabatic heating. Residual adiabatic heat, internal region cooling times, and external surface region heating influence the extent of grain refinement in non-limiting methods of thermally managed, high strain rate multi-axis forging according to the present disclosure.

The present inventors have further developed alternate methods according to the present disclosure providing certain advantages relative to a process as described above including multi-axis forging and using a thermal management system and a cube-shaped workpiece comprising a titanium alloy. It is believed that one or more of (1) the cubical workpiece geometry used in certain embodiments of thermally managed multi-axis forging disclosed herein, (2) die chill (i.e., allowing the temperature of the dies to dip significantly below the workpiece forging temperature), and (3) use of high strain rates may disadvantageously concentrate strain within a core region of the workpiece.

The alternate methods according to the present disclosure can achieve generally uniform fine grain, very fine grain, or ultrafine grain size throughout a billet size titanium alloy workpiece. In other words, a workpiece processed by such alternate methods may include the desired grain size, such as an ultrafine grain microstructure, throughout the workpiece, and not only in a central region of the workpiece. Non-limiting embodiments of such alternate methods comprise "multiple upset and draw" steps performed on billets having cross-sections greater than 4 square inches. The multiple upset and draw steps are intended to impart uniform fine grain, very fine grain, or ultrafine grain microstructure throughout the workpiece, while preserving substantially the original dimensions of the workpiece. Because these alternate methods include Multiple Upset and Draw steps, they are referred to herein as embodiments of the "MUD" method. The MUD method includes severe plastic deformation and can produce uniform ultrafine grains in billet-size (e.g., 30 inch (76.2 cm) in length) titanium alloy workpieces. In non-limiting embodiments of the MUD method according to the present disclosure, strain rates used for the upset forging and draw forging steps are in the range of 0.001 $s^{-1}$ to 0.02 $s^{-1}$. In contrast, strain rates typically used for conventional open die upset and draw forging are in the range of 0.03 $s^{-1}$ to 0.1 $s^{-1}$. The strain rate for MUD is slow enough to prevent adiabatic heating in the workpiece in order to keep the forging temperature in control, yet the strain rate is acceptable for commercial practices.

Figure 9:
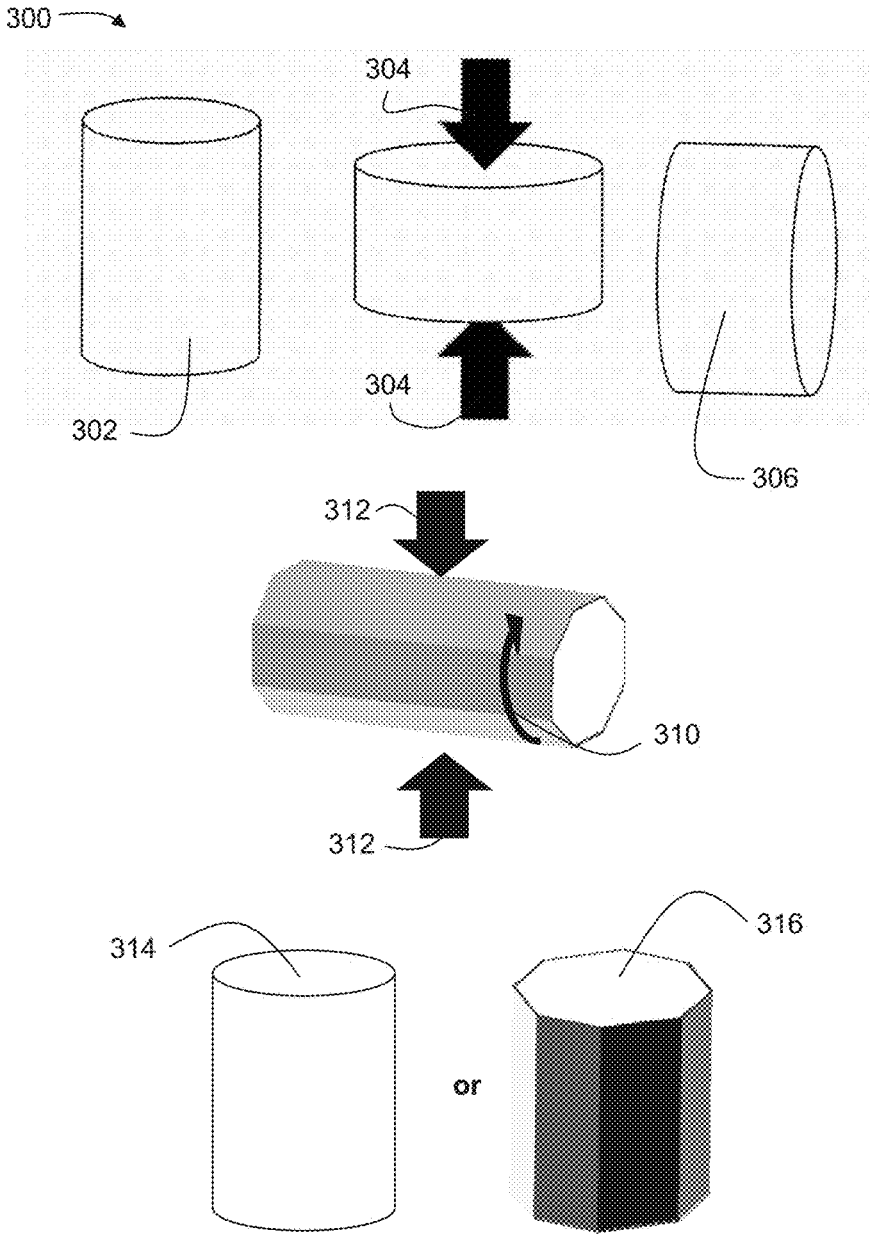
FIG. 9 is a schematic representation of aspects of a non-limiting embodiment of a multiple upset and draw method for grain size refinement according to the present disclosure.
Figure 10:
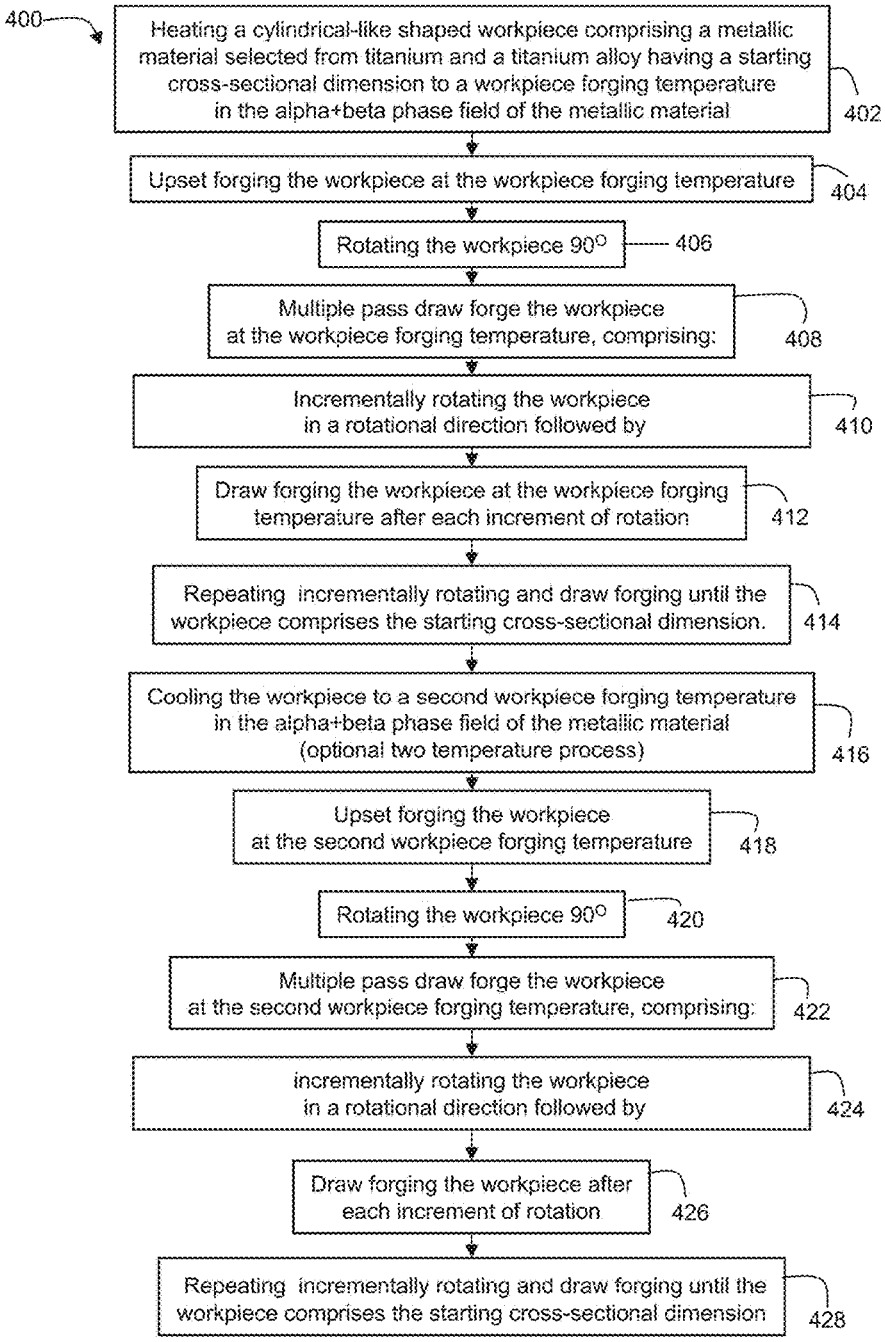
FIG. 10 is a flow chart listing steps of a non-limiting embodiment of a method for multiple upset and draw processing titanium alloys to refine grain size according to the present disclosure.

A schematic representation of non-limiting embodiments of the MUD method is provided in FIG. 9, and a flow chart of certain embodiments of the MUD method is provided in FIG. 10. Referring to FIGS. 9 and 10, a non-limiting method 300 for refining grains in a workpiece comprising a titanium alloy using multiple upset and draw forging steps comprises heating an elongate titanium alloy workpiece 302 to a workpiece forging temperature in the alpha+beta phase field of the titanium alloy. In a non-limiting embodiment, the shape of the elongate workpiece is a cylinder or a cylinder-like shape. In another non-limiting embodiment, the shape of the workpiece is an octagonal cylinder or a right octagon.

The elongate workpiece has a starting cross-sectional dimension. For example, in a non-limiting embodiment of the MUD method according to the present disclosure in which the starting workpiece is a cylinder, the starting cross-sectional dimension is the diameter of the cylinder. In a non-limiting embodiment of the MUD method according to the present disclosure in which the starting workpiece is an octagonal cylinder, the starting cross-sectional dimension is the diameter of the circumscribed circle of the octagonal cross-section, i.e., the diameter of the circle that passes through all the vertices of the octagonal cross-section.

When the elongate workpiece is at the workpiece forging temperature, the workpiece is upset forged 304. After upset forging 304, in a non-limiting embodiment, the workpiece is rotated 90 degrees to the orientation 306 and then is subjected to multiple pass draw forging 312. Actual rotation of the workpiece is optional, and the objective of the step is to dispose the workpiece into the correct orientation (refer to FIG. 9) relative to a forging device for subsequent multiple pass draw forging 312 steps.

Multiple pass draw forging comprises incrementally rotating (depicted by arrow 310) the workpiece in a rotational direction (indicated by the direction of arrow 310), followed by draw forging 312 the workpiece after each increment of rotation. In non-limiting embodiments, incrementally rotating 310 and draw forging 312 is repeated until the workpiece comprises the starting cross-sectional dimension. In a non-limiting embodiment, the upset forging and multiple pass draw forging steps are repeated until a total strain of at least 1.0 is achieved in the workpiece. Another non-limiting embodiment comprises repeating the heating, upset forging, and multiple pass draw forging steps until a total strain in the range of at least 1.0 up to less than 3.5 is achieved in the workpiece. In still another non-limiting embodiment, the heating, upset forging, and multiple pass draw forging steps are repeated until a total strain of at least 10 is achieved in the workpiece. It is anticipated that when a total strain of 10 is imparted to the MUD forging, an ultrafine grain alpha microstructure is produced, and that increasing the total strain imparted to the workpiece results in smaller average grain sizes.

An aspect of the present disclosure is to employ a strain rate during the upset and multiple pass drawing steps that is sufficient to result in severe plastic deformation of the titanium alloy workpiece, which, in non-limiting embodiments, further results in ultrafine grain size. In a non-limiting embodiment, a strain rate used in upset forging is in the range of 0.001 $s^{-1}$ to 0.003 $s^{-1}$. In another non-limiting embodiment, a strain rate used in the multiple pass draw forging steps is the range of 0.01 $s^{-1}$ to 0.02 $s^{-1}$. It was disclosed in the '538 Application that strain rates in these ranges do not result in adiabatic heating of the workpiece, which enables workpiece temperature control, and were found sufficient for an economically acceptable commercial practice.

In a non-limiting embodiment, after completion of the MUD method, the workpiece has substantially the original dimensions of the starting elongate article, such as, for example, cylinder 314 or octagonal cylinder 316. In another non-limiting embodiment, after completion of the MUD method, the workpiece has substantially the same cross-section as the starting workpiece. In a non-limiting embodiment, a single upset requires numerous draw hits and intermediate rotations to return the workpiece to a shape including the starting cross-section of the workpiece.

In a non-limiting embodiment of the MUD method wherein the workpiece is in the shape of a cylinder, for example, incrementally rotating and draw forging further comprises multiple steps of rotating the cylindrical workpiece in 15° increments and subsequently draw forging, until the cylindrical workpiece is rotated through 360° and is draw forged at each increment. In a non-limiting embodiment of the MUD method wherein the workpiece is in the shape of a cylinder, after each upset forge, twenty-four draw forging steps with intermediate incremental rotation between successive draw forging steps are employed to bring the workpiece to substantially its starting cross-sectional dimension. In another non-limiting embodiment, wherein the workpiece is in the shape of an octagonal cylinder, incrementally rotating and draw forging further comprises multiple steps of rotating the cylindrical workpiece in 45° increments and subsequently draw forging, until the cylindrical workpiece is rotated through 360° and is draw forged at each increment. In a non-limiting embodiment of the MUD method wherein the workpiece is in the shape of an octagonal cylinder, after each upset forge, eight forging steps separated by incremental rotation of the workpiece are employed to bring the workpiece substantially to its starting cross-sectional dimension. It was observed in non-limiting embodiments of the MUD method that manipulation of an octagonal cylinder by handling equipment was more precise than manipulation of a cylinder by handling equipment. It also was observed that manipulation of an octagonal cylinder by handling equipment in a non-limiting embodiment of a MUD method was more precise than manipulation of a cube-shaped workpiece using hand tongs in non-limiting embodiments of the thermally managed high strain rate MAF process disclosed herein. It will be recognized on considering the present description that other draw forging sequences, each including a number of draw forging steps and intermediate incremental rotations of a particular number of degrees, may be used for other cross-sectional billet shapes so that the final shape of the workpiece after draw forging is substantially the same as the starting shape of the workpiece prior to upset forging. Such other possible sequences may be determined by a person skilled in the art without undue experimentation and are included within the scope of the present disclosure.

In a non-limiting embodiment of the MUD method according to the present disclosure, a workpiece forging temperature comprises a temperature within a workpiece forging temperature range. In a non-limiting embodiment, the workpiece forging temperature is in a workpiece forging temperature range of 100° F. (55.6° C.) below the beta transus temperature ($T_\beta$) of the titanium alloy to 700° F. (388.9° C.) below the beta transus temperature of the titanium alloy. In still another non-limiting embodiment, the workpiece forging temperature is in a temperature range of 300° F. (166.7° C.) below the beta transus temperature of the titanium alloy to 625° F. (347° C.) below the beta transus temperature of the titanium alloy. In a non-limiting embodiment, the low end of a workpiece forging temperature range is a temperature in the alpha+beta phase field at which substantial damage does not occur to the surface of the workpiece during the forging hit, as may be determined without undue experimentation by a person having ordinary skill in the art.

In a non-limiting embodiment of the MUD method according to the present disclosure, the workpiece forging temperature range for a Ti-6-2-4-2 alloy, which has a beta transus temperature ($T_\beta$) of about 1820° F. (993.3° C.), may be, for example, from 1120° F. (604.4 C) to 1720° F. (937.8° C.), or in another embodiment may be from 1195° F. (646.1° C.) to 1520° F. (826.7° C.).

Non-limiting embodiments of the MUD method comprise multiple reheating steps. In a non-limiting embodiment, the titanium alloy workpiece is heated to the workpiece forging temperature after upset forging the titanium alloy workpiece. In another non-limiting embodiment, the titanium alloy workpiece is heated to the workpiece forging temperature prior to a draw forging step of the multiple pass draw forging. In another non-limiting embodiment, the workpiece is heated as needed to bring the actual workpiece temperature back to or near the workpiece forging temperature after an upset or draw forging step.

It was determined that embodiments of the MUD method impart redundant work or extreme deformation, also referred to as severe plastic deformation, which is aimed at creating ultrafine grains in a workpiece comprising a titanium alloy. Without intending to be bound to any particular theory of operation, it is believed that the round or octagonal cross sectional shape of cylindrical and octagonal cylindrical workpieces, respectively, distribute strain more evenly than workpieces of square or rectangular cross sectional shape across the cross-sectional area of the workpiece during a MUD method. The deleterious effect of friction between the workpiece and the forging die is also reduced by reducing the area of the workpiece in contact with the die.

In addition, it was also determined that decreasing the temperature during the MUD method reduces the final grain size to a size that is characteristic of the specific temperature being used. Referring to FIG. 10, in a non-limiting embodiment of a method 400 for refining the grain size of a workpiece, after processing the workpiece by the MUD method at the workpiece forging temperature, the temperature of the workpiece may be cooled 416 to a second workpiece forging temperature. In a non-limiting embodiment, after cooling the workpiece to the second workpiece forging temperature, the workpiece is upset forged at the second workpiece forging temperature 418. The workpiece is rotated 420 or otherwise oriented relative to the forging press for subsequent draw forging steps. The workpiece is multiple-step draw forged at the second workpiece forging temperature 422. Multiple-step draw forging at the second workpiece forging temperature 422 comprises incrementally rotating 424 the workpiece in a rotational direction (refer to FIG. 9) and draw forging at the second workpiece forging temperature 426 after each increment of rotation. In a non-limiting embodiment, the steps of upset, incrementally rotating 424, and draw forging are repeated 426 until the workpiece comprises the starting cross-sectional dimension. In another non-limiting embodiment, the steps of upset forging at the second workpiece temperature 418, rotating 420, and multiple step draw forging 422 are repeated until a total strain of at least 1.0, or in the range of 1.0 up to less than 3.5, or up to 10 or greater is achieved in the workpiece. It is recognized that the MUD method can be continued until any desired total strain is imparted to the titanium alloy workpiece.

In a non-limiting embodiment comprising a multi-temperature MUD method embodiment, the workpiece forging temperature, or a first workpiece forging temperature, is about 1600° F. (871.1° C.), and the second workpiece forging temperature is about 1500° F. (815.6° C.). Subsequent workpiece forging temperatures that are lower than the first and second workpiece forging temperatures, such as a third workpiece forging temperature, a fourth workpiece forging temperature, and so forth, are within the scope of non-limiting embodiments of the present disclosure.

As forging proceeds, grain refinement results in decreasing flow stress at a fixed temperature. It was determined that decreasing the forging temperature for sequential upset and draw steps keeps the flow stress constant and increases the rate of microstructural refinement. It is anticipated that in non-limiting embodiments of MUD according to the present disclosure, a total strain of at least 1.0, in a range of at least 1.0 up to less than 3.5, or up to 10 results in a uniform equiaxed alpha ultrafine grain microstructure in titanium alloy workpieces, and that the lower temperature of a two-temperature (or multi-temperature) MUD method can be determinative of the final grain size after a total strain of up to 10 is imparted to the MUD forging.

An aspect of the present disclosure includes the possibility that after processing a workpiece by the MUD method, subsequent deformation steps are performed without coarsening the refined grain size, as long as the temperature of the workpiece is not subsequently heated above the beta transus temperature of the titanium alloy. For example, in a non-limiting embodiment, a subsequent deformation practice after the MUD method may include draw forging, multiple draw forging, upset forging, or any combination of two or more of these forging techniques at temperatures in the alpha+beta phase field of the titanium alloy. In a non-limiting embodiment, subsequent deformation or forging steps include a combination of multiple pass draw forging, upset forging, and draw forging to reduce the starting cross-sectional dimension of the cylinder-like or other elongate workpiece to a fraction of the cross-sectional dimension, such as, for example, but not limited to, one-half of the cross-sectional dimension, one-quarter of the cross-sectional dimension, and so forth, while still maintaining a uniform fine grain, very fine grain, or ultrafine grain structure in the titanium alloy workpiece.

In a non-limiting embodiment of a MUD method, the workpiece comprises a titanium alloy selected from the group consisting of an alpha+beta titanium alloy and a metastable beta titanium alloy. In another non-limiting embodiment of a MUD method, the workpiece comprises an alpha+beta titanium alloy. In still another non-limiting embodiment of the multiple upset and draw process disclosed herein, the workpiece comprises a metastable beta titanium alloy. In a non-limiting embodiment of a MUD method, the workpiece is a titanium alloy selected from a Ti-6-2-4-2 alloy, a Ti-6-2-4-6 alloy, ATI 425® titanium alloy (Ti-4Al-2.5V), and a Ti-6-6-2 alloy.

Prior to heating the workpiece to the workpiece forging temperature in the alpha+beta phase field according to MUD embodiments of the present disclosure, in a non-limiting embodiment the workpiece may be heated to a beta annealing temperature, held at the beta annealing temperature for a beta annealing time sufficient to form a 100% beta phase titanium microstructure in the workpiece, and cooled to ambient temperature. In a non-limiting embodiment, the beta annealing temperature is in a beta annealing temperature range that includes the beta transus temperature of the titanium alloy up to 300° F. (111° C.) above the beta transus temperature of the titanium alloy. In a non-limiting embodiment, the beta annealing time is from 5 minutes to 24 hours.

In a non-limiting embodiment, the workpiece is a billet that is coated on all or certain surfaces with a lubricating coating that reduces friction between the workpiece and the forging dies. In a non-limiting embodiment, the lubricating coating is a solid lubricant such as, but not limited to, one of graphite and a glass lubricant. Other lubricating coatings known now or hereafter to a person having ordinary skill in the art are within the scope of the present disclosure. In addition, in a non-limiting embodiment of the MUD method using cylinder-like or other elongate-shaped workpieces, the contact area between the workpiece and the forging dies is small relative to the contact area in multi-axis forging of a cube-shaped workpiece. For example, with a 4 inch cube, two of the entire 4 inch by 4 inch faces of the cube is in contact with the die. With a 5 foot long billet, the billet length is larger than a typical 14 inch long die, and the reduced contact area results in reduced die friction and a more uniform titanium alloy workpiece microstructure and macrostructure.

Prior to heating the workpiece comprising a titanium alloy to the workpiece forging temperature in the alpha+beta phase field according to MUD embodiments of the present disclosure, in a non-limiting embodiment the workpiece is plastically deformed at a plastic deformation temperature in the beta phase field of the titanium alloy after being held at a beta annealing time sufficient to form 100% beta phase in the titanium alloy and prior to cooling the alloy to ambient temperature. In a non-limiting embodiment, the plastic deformation temperature is equivalent to the beta annealing temperature. In another non-limiting embodiment, the plastic deformation temperature is in a plastic deformation temperature range that includes the beta transus temperature of the titanium alloy up to 300° F. (111° C.) above the beta transus temperature of the titanium alloy.

In a non-limiting embodiment of the MUD method, plastically deforming the workpiece in the beta phase field of the titanium alloy comprises at least one of drawing, upset forging, and high strain rate multi-axis forging the titanium alloy workpiece. In another non-limiting embodiment, plastically deforming the workpiece in the beta phase field of the titanium alloy comprises multiple upset and draw forging according to non-limiting embodiments of the present disclosure, and wherein cooling the workpiece to a temperature at or near the workpiece forging temperature comprises air cooling. In still another non-limiting embodiment, plastically deforming the workpiece in the beta phase field of the titanium alloy comprises upset forging the workpiece to a 30-35% reduction in height or another dimension, such as length.

Another aspect of the MUD method of the present disclosure may include heating the forging dies during forging. A non-limiting embodiment comprises heating dies of a forge used to forge the workpiece to temperature in a temperature range bounded by the workpiece forging temperature down to 100° F. (55.6° C.) below the workpiece forging temperature.

In non-limiting embodiments of the MUD method according to the present disclosure, a method for production of ultra-fine grained titanium alloys includes: choosing a titanium alloy having slower alpha precipitation and growth kinetics than Ti-6-4 alloy; beta annealing the alloy to provide a fine and stable alpha lath structure; and high strain rate multi-axis forging the alloy, according to the present disclosure, to a total strain of at least 1.0, or in a range of at least 1.0 up to less than 3.5. The titanium alloy may be chosen from alpha+beta titanium alloys and metastable beta titanium alloys that provide a fine and stable alpha lath structure after beta annealing.

It is believed that the certain methods disclosed herein also may be applied to metals and metal alloys other than titanium alloys in order to reduce the grain size of workpieces of those alloys. Another aspect of this disclosure includes non-limiting embodiments of a method for high strain rate multi-step forging of metals and metal alloys. A non-limiting embodiment of the method comprises heating a workpiece comprising a metal or a metal alloy to a workpiece forging temperature. After heating, the workpiece is forged at the workpiece forging temperature at a strain rate sufficient to adiabatically heat an internal region of the workpiece. After forging, a waiting period is employed before the next forging step. During the waiting period, the temperature of the adiabatically heated internal region of the metal alloy workpiece is allowed to cool to the workpiece forging temperature, while at least a one surface region of the workpiece is heated to the workpiece forging temperature. The steps of forging the workpiece and then allowing the adiabatically heated internal region of the workpiece to equilibrate to the workpiece forging temperature while heating at least one surface region of the metal alloy workpiece to the workpiece forging temperature are repeated until a desired characteristic is obtained. In a non-limiting embodiment, forging comprises one or more of press forging, upset forging, draw forging, and roll forging. In another non-limiting embodiment, the metal alloy is selected from the group consisting of titanium alloys, zirconium and zirconium alloys, aluminum alloys, ferrous alloys, and superalloys. In still another non-limiting embodiment, the desired characteristic is one or more of an imparted strain, an average grain size, a shape, and a mechanical property. Mechanical properties include, but are not limited to, strength, ductility, fracture toughness, and hardness, The examples that follow are intended to further describe certain non-limiting embodiments, without restricting the scope of the present invention. Persons having ordinary skill in the art will appreciate that variations of the following examples are possible within the scope of the invention, which is defined solely by the claims.

Example 1

A bar of Ti-6-2-4-2 alloy was processed according to a commercial forging process, identified in the industry by specification number AMS 4976, which is typically used to process Ti-6-2-4-2 alloy. By reference to the AMS 4976 specification, those having ordinary skill understand the specifics of the process to achieve the mechanical properties and microstructure set out in that the specification. After processing, the alloy was metallographically prepared and the microstructure was evaluated microscopically. As shown in the micrograph of the prepared alloy included as FIG. 11(*a*), the microstructure includes alpha grains (the lighter colored regions in the image) that are on the order of 20 μm or larger.

Figure 11A:
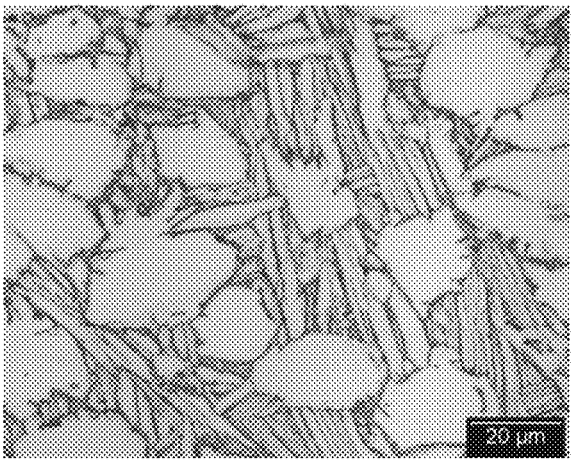
FIG. 11(*a*) is a micrograph of the microstructure of a commercially forged and processed Ti-6-2-4-2 alloy.
Figure 11B:
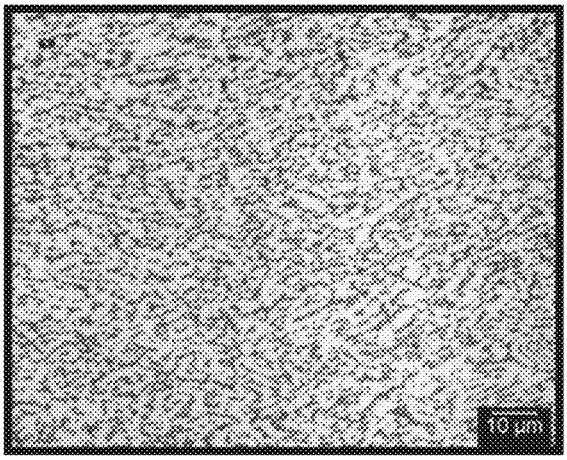

According to a non-limiting embodiment within the present disclosure, a 4.0 inch cube-shaped workpiece of Ti-6-2-4-2 alloy was beta annealed at 1950° F. (1066° C.) for 1 hour and then air cooled to ambient temperature. After cooling, the beta annealed cube-shaped workpiece was heated to a workpiece forging temperature of 1600° F. (871.1° C.) and forged using four hits of high strain rate MAF. The hits were to the following orthogonal axes, in the following sequence: A-B-C-A. The hits were to a spacer height of 3.25 inches, and the ram speed was 1 inch per second. There was no strain rate control on the press, but for the 4.0 inch cubes, this ram speed results in a minimum strain rate during pressing of 0.25 $s^{-1}$. The time between successive orthogonal hits was about 15 seconds. The total strain applied to the workpiece was 1.37. The microstructure of the Ti-6-2-4-2 alloy processed in this manner is depicted in the micrograph of FIG. 11(*b*). The majority of alpha particles (lighter colored areas) are on the order of 4 μm or less, which is substantially finer than the alpha grains produced by the commercial forging process discussed above and represented by the micrograph of FIG. 11(*a*).

Example 2

A bar of Ti-6-2-4-6 alloy was processed according to a commercial forging process typically used for T-6-2-4-6 alloy, i.e., according to specification AMS 4981. By reference to the AMS 4981 specification, those having ordinary skill understand the specifics of the process to achieve the mechanical properties and microstructure set out in that the specification. After processing, the alloy was metallographically prepared and the microstructure was evaluated microscopically. As shown in the micrograph of the prepared alloy shown in FIG. 12(*a*), the microstructure exhibits alpha grains (the lighter colored regions) that are on the order of 10 μm or larger.

Figure 12A:
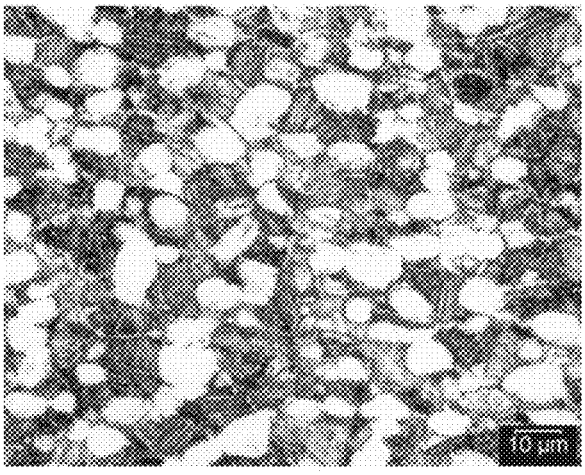
FIG. 12(*a*) is a micrograph that depicts the microstructure of a commercially forged and processed Ti-6-2-4-6 alloy.
Figure 12B:
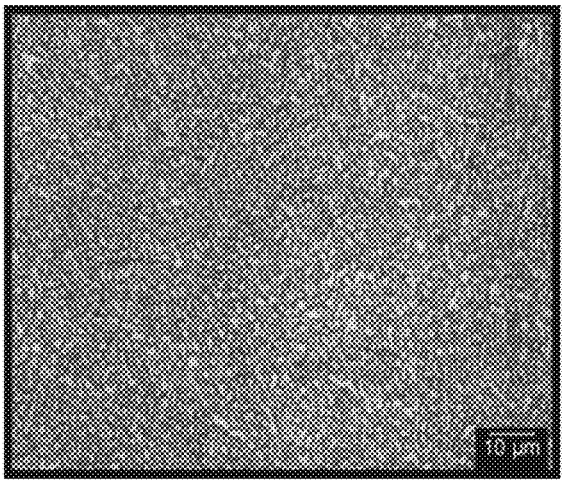

In a non-limiting embodiment according to the present disclosure, a 4.0 inch cube-shaped workpiece of Ti-6-2-4-6 alloy was beta annealed at 1870° F. (1066° C.) for 1 hour and then air cooled. After cooling, the beta annealed cube-shaped workpiece was heated to a workpiece forging temperature of 1500° F. (815.6° C.) and forged using four hits of high strain rate MAF. The hits were to the following orthogonal axes and followed the following sequence: A-B-C-A. The hits were to a spacer height of 3.25 inches, and the ram speed was 1 inch per second. There was no strain rate control on the press, but for the 4.0 inch cubes, this ram speed results in a minimum strain rate during pressing of 0.25 $s^{-1}$. The time between successive orthogonal hits was about 15 seconds. The total strain applied to the workpiece was 1.37. The microstructure of the alloy processed in this manner is depicted in the micrograph of FIG. 12(*b*). It is seen that the majority of alpha particles (lighter colored areas) are on the order of 4 μm or less, and in any case are much finer than the alpha grains produced by the commercial forging process discussed above and represented by the micrograph of FIG. 12(*a*).

Example 3

Figure 13:
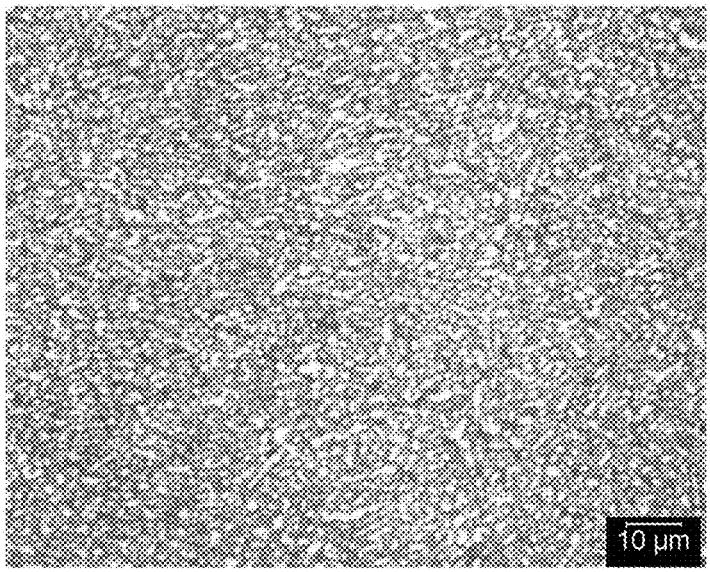
FIG. 13 is a micrograph of the microstructure of a Ti-6-2-4-6 alloy processed by the thermally managed high strain MAF embodiment described in Example 3 of the present disclosure.

In a non-limiting embodiment according to the present disclosure, a 4.0 inch cube-shaped workpiece of Ti-6-2-4-6 alloy was beta annealed at 1870° F. (1066° C.) for 1 hour and then air cooled. After cooling, the beta annealed cube-shaped workpiece was heated to a workpiece forging temperature of 1500° F. (815.6° C.) and forged using three hits of high strain rate MAF, one each on the A, the B, and the C axes (i.e., the hits were to the following orthogonal axes and in the following sequence: A-B-C). The hits were to a spacer height of 3.25 inches, and the ram speed was 1 inch per second. There was no strain rate control on the press, but for the 4.0 inch cubes, this ram speed results in a minimum strain rate during pressing of 0.25 $s^{-1}$. The time between successive hits was about 15 seconds. After the A-B-C cycle of hits, the workpiece was reheated to 1500° F. (815.6° C.) for 30 minutes. The cube was then high strain rate MAF with one hit each on the A, the B, and the C axes, i.e., the hits were to the following orthogonal axes and in the following sequence: A-B-C. The hits were to the same spacer height and used the same ram speed and time in between hits as used in the first A-B-C sequence of hits. After the second sequence of A-B-C hits, the workpiece was reheated to 1500° F. (815.6° C.) for 30 minutes. The cube was then high strain rate MAF with one hit at each of the A, the B, and the C axes, i.e., an A-B-C sequence. The hits were to the same spacer heights and used the same ram speed and time in between hits as in the first sequence of A-B-C hits. This embodiment of a high strain rate multi-axis forging process imparted a strain of 3.46. The microstructure of the alloy processed in this manner is depicted in the micrograph of FIG. 13. It is seen that the majority of alpha particles (lighter colored areas) are on the order of 4 μm or less. It is believed likely that the alpha particles are comprised of individual alpha grains and that each of the alpha grains has a grain size of 4 μm or less and is equiaxed in shape.

Example 4

In a non-limiting embodiment according to the present disclosure, a 4.0 inch cube-shaped workpiece of Ti-6-2-4-2 alloy was beta annealed at 1950° F. (1066° C.) for 1 hour and then air cooled. After cooling, the beta annealed cube-shaped workpiece was heated to a workpiece forging temperature of 1700° F. (926.7° C.) and held for 1 hour. Two high strain rate MAF cycles (2 sequences of three A-B-C hits, for a total of 6 hits) were employed at 1700° F. (926.7° C.). The time between successive hits was about 15 seconds. The forging sequence was: an A hit to a 3 inch stop; a B hit to a 3.5 inch stop; and a C hit to a 4.0 inch stop. This forging sequence provides an equal strain to all three orthogonal axes every three-hit MAF sequence. The ram speed was 1 inch per second. There was no strain rate control on the press, but for the 4.0 inch cubes, this ram speed results in a minimum strain rate during pressing of 0.25 $s^{-1}$. The total strain per cycle is less than forging to a 3.25 inch reduction in each direction, as in previous examples.

The workpiece was heated to 1650° F. (898.9° C.) and subjected to high strength MAF for three additional hits (i.e., one additional A-B-C high strain rate MAF cycle). The forging sequence was: an A hit to a 3 inch stop; a B hit to a 3.5 inch stop; and a C hit to a 4.0 inch stop. After forging, the total strain imparted to the workpiece was 2.59.

Figure 14:
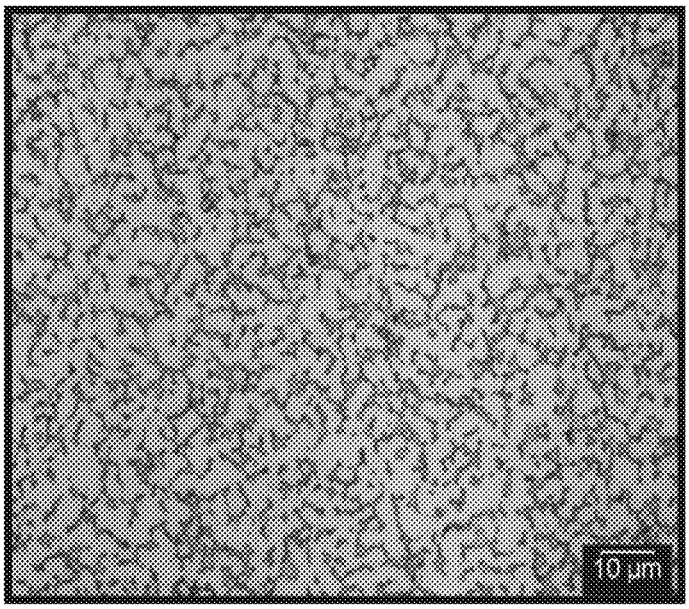
FIG. 14 is a micrograph of the microstructure of a Ti-6-2-4-2 alloy processed by the thermally managed high strain MAF embodiment described in Example 4 of the present disclosure, which applies equal strain on each axis.

The microstructure of the forged workpiece of Example 4 is depicted in the micrograph of FIG. 14. It is seen that the majority of alpha particles (lighter colored regions) are in a networked structure. It is believed likely that the alpha particles are comprised of individual alpha grains and that each of the alpha grains has a grain size of 4 μm or less and is equiaxed in shape.

Example 5

In a non-limiting embodiment according to the present disclosure, a 4.0 inch cube-shaped workpiece of Ti-6-2-4-2 alloy was beta annealed at 1950° F. (1066° C.) for 1 hour and then air cooled. After cooling, the beta annealed, cube-shaped workpiece was heated to a workpiece forging temperature of 1700° F. (926.7° C.) and held for 1 hour. MAF according to the present disclosure was employed to apply 6 press forgings to a major reduction spacer height (A, B, C, A, B, C) to the cube-shaped workpiece. In addition, between each press forging to a 3.25 inch major reduction spacer height, first and second blocking reductions were conducted on the other axes to "square up" the workpiece. The overall forging sequence used is as follows, wherein the bold and underlined hits are press forgings to the major reduction spacer height: A-B-C-B-C-A-C-A-B-A-B-C-B-C-A-C.

The forging sequence, including major, first blocking, and second blocking spacer heights (in inches) that were utilized are outlined in the table below. The ram speed was 1 inch per second. There was no strain rate control on the press, but for the 4.0 inch cubes, this ram speed results in a minimum strain rate during pressing of 0.25 $s^{-1}$. The time elapsed between hits was about 15 seconds. The total strain after thermally managed MAF according to this non-limiting embodiment was 2.37.

| | Axes and Spacer Heights (inches) | | |
|---|---|---|---|
| HIT | A | B | C |
| 1 | **3.25** | | |
| 2 | | 4.25 | |
| 3 | | | 4.25 |
| 4 | | **3.25** | |
| 5 | | | 4.75 |
| 6 | 4 | | |
| 7 | | | **3.25** |
| 8 | 4.75 | | |
| 9 | | 4 | |
| 10 | **3.25** | | |
| 11 | | 4.75 | |
| 12 | | | 4 |
| 13 | | **3.25** | |
| 14 | | | 4.75 |
| 15 | 4 | | |
| 16 | | | **3.25** |
| Total Strain | 2.37 | | |

Figure 15:
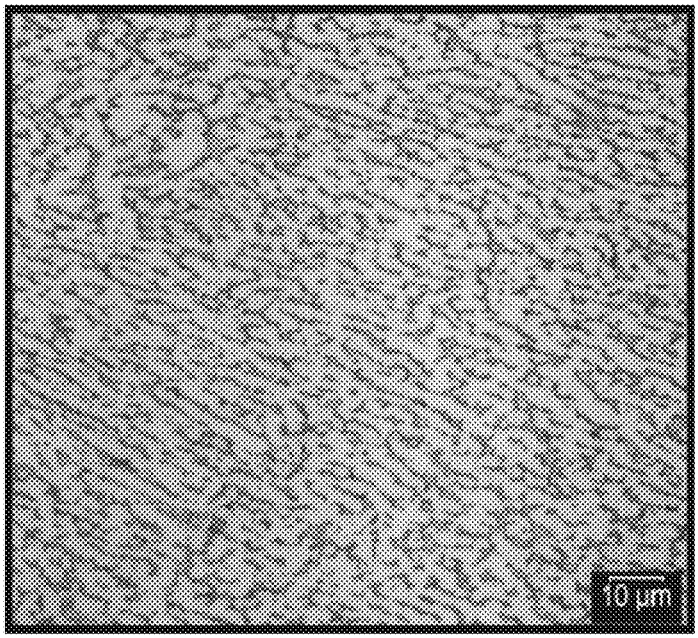
FIG. 15 is a micrograph of the microstructure of a Ti-6-2-4-2 alloy processed by the thermally managed high strain MAF embodiment, described in Example 5 of the present disclosure, wherein blocking reductions are used to minimize bulging of the workpiece that occurs after each major reduction.

The microstructure of the workpiece forged by the process described in this Example 5 is depicted in the micrograph of FIG. 15. It is seen that the majority of alpha particles (lighter colored regions) are elongated. It is believed likely that the alpha particles are comprised of individual alpha grains and that each of the alpha grains has a grain size of 4 μm or less and is equiaxed in shape.

Example 6

In a non-limiting embodiment according to the present disclosure, a 4.0 inch cube-shaped workpiece of Ti-6-2-4-2 alloy was beta annealed at 1950° F. (1066° C.) for 1 hour and then air cooled. Thermally managed high strain rate MAF, according to embodiments of the present disclosure, was performed on the workpiece, including 6 hits (2 A-B-C MAF cycles) at 1900° C., with 30 second holds between each hit. The ram speed was 1 inch per second. There was no strain rate control on the press, but for the 4.0 inch cubes, this ram speed results in a minimum strain rate during pressing of 0.25 $s^{-1}$. The sequence of 6 hits with intermediate holds was designed to heat the surface of the piece through the beta transus temperature during MAF, and this may therefore be referred to as a through transus high strain rate MAF. The process results in refining the surface structures and minimizing cracking during subsequent forging. The workpiece was then heated at 1650° F. (898.9° C.), i.e., below the beta transus temperature for 1 hour. MAF according to embodiments of the present disclosure was applied to the workpiece, including 6 hits (two A-B-C MAF cycles) with about 15 seconds between hits. The first three hits (the hits in the first A-B-C MAF cycle) were performed with a 3.5 inch spacer height, and the second 3 hits (the hits in the second A-B-C MAF cycle) were performed with a 3.25 inch spacer height. The workpiece was heated to 1650° F. and held for 30 minutes between the hits with the 3.5 inch spacer and the hits with the 3.25 inch spacer. The smaller reduction (i.e., larger spacer height) used for the first 3 hits was designed to inhibit cracking as the smaller reduction breaks up boundary structures that may lead to cracking. The workpiece was reheated to 1500° F. (815.6° C.) for 1 hour. MAF according to embodiments of the present disclosure was then applied using 3 A-B-C hits (one MAF cycle) to 3.25 inch reductions with 15 seconds in between each hit. This sequence of heavier reductions is designed to put additional work into the non-boundary structures. The ram speed for all hits described in Example 6 was 1 inch per second.

Figure 16A:
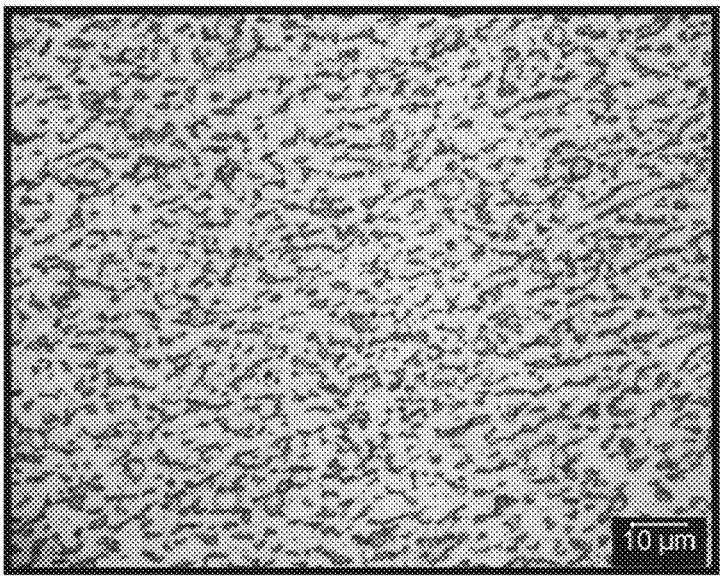
FIG. 16(*a*) is a micrograph of the microstructure of the center region of a Ti-6-2-4-2 alloy processed by the thermally managed high strain MAF embodiment utilizing through beta transus MAF that is described in Example 6 of the present disclosure.
Figure 16B:
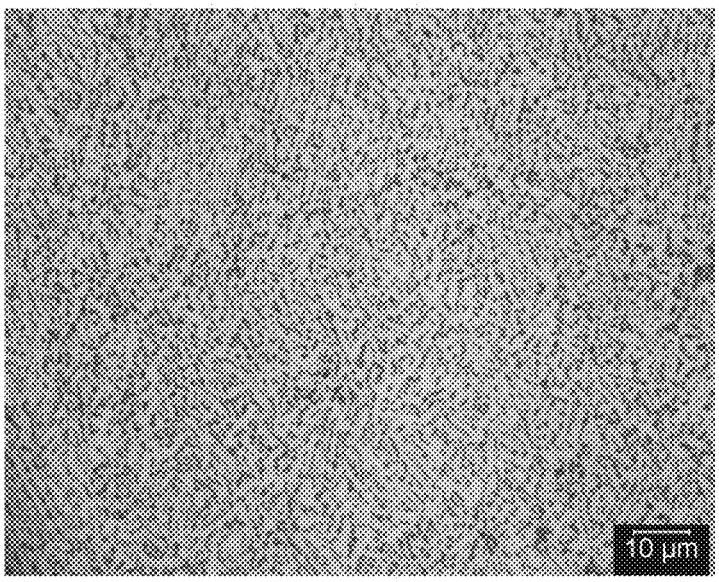

A total strain of 3.01 was imparted to the workpiece of Example 6. A representative micrograph from the center of the thermally managed MAF workpiece of Example 6 is shown in FIG. 16(*a*). A representative micrograph of the surface of the thermally managed MAF workpiece of Example 6 is presented in FIG. 16(*b*). The surface microstructure (FIG. 16(*b*)) is substantially refined and the majority of the particles and/or grains have a size of about 4 μm or less, which is an ultrafine grain microstructure. The center microstructure shown in FIG. 16(*a*) shows highly refined grains, and it is believed likely that the alpha particles are comprised of individual alpha grains and each of the alpha grains has a grain size of 4 μm or less and is equiaxed in shape.

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

We claim:

1. A method of processing a workpiece comprising a titanium alloy, the method comprising:

beta annealing the workpiece;

cooling the beta annealed workpiece to a temperature below a beta transus temperature of the titanium alloy; and forging the workpiece along a plurality of axes, wherein the forging the workpiece along a plurality of axes comprises press forging the workpiece in a forging temperature range along a first axis of the workpiece with a strain rate that adiabatically heats an internal region of the workpiece, press forging the workpiece in the forging temperature range along a second axis of the workpiece with a strain rate that adiabatically heats the internal region of the workpiece, press forging the workpiece in the forging temperature range along a third axis of the workpiece with a strain rate that adiabatically heats the internal region of the workpiece, wherein the first axis, the second axis, and the third axis are not the same or parallel, and repeating at least one of the press forgings, wherein the forging the workpiece along a plurality of axes results in a total true strain of at least 1.0 in the workpiece.

2. The method of claim 1, wherein the forging the workpiece along a plurality of axes results in a total true strain in the range of at least 1.0 up to less than 3.5 in the workpiece.

3. The method of claim 1, wherein a strain rate used in the forging the workpiece along a plurality of axes is in the range of 0.2 $s^{-1}$ to 0.8 $s^{-1}$.

4. The method of claim 1, wherein the workpiece comprises one of an alpha+beta titanium alloy and a metastable beta titanium alloy.

5. The method of claim 1, wherein the workpiece comprises an alpha+beta titanium alloy.

6. The method of claim 4 or 5, wherein the titanium alloy comprises at least one of grain pinning alloying additions and beta stabilizing content effective to decrease alpha phase precipitation and growth kinetics.

7. The method of claim 1, wherein the workpiece comprises a titanium alloy selected from Ti-6Al-2Sn-4Zr-6Mo alloy (UNS R56260), Ti-6Al-2Sn-4Zr-2Mo-0.08Si alloy (UNS R54620), Ti-4Al-2.5V alloy (UNS R54250), Ti-6Al-7Nb alloy (UNS R56700), and Ti-6Al-6V-2Sn alloy (UNS R56620).

8. The method of claim 1, wherein cooling the beta annealed workpiece comprises cooling the workpiece to ambient temperature.

9. The method of claim 1, wherein cooling the beta annealed workpiece comprises cooling the workpiece to a temperature at or near the workpiece forging temperature.

10. The method of claim 1, wherein beta annealing the workpiece comprises heating the workpiece at a beta annealing temperature in a range of the beta transus temperature of the titanium alloy up to 300° F. (167° C.) above the beta transus temperature of the titanium alloy.

11. The method of claim 1, wherein beta annealing the workpiece comprises heating the workpiece for a time within the range of 5 minutes to 24 hours.

12. The method of claim 1, further comprising, prior to cooling the beta annealed workpiece, plastically deforming the workpiece at temperatures within the beta phase field of the titanium alloy prior to cooling the beta annealed workpiece.

13. The method of claim 12, wherein plastically deforming the workpiece comprises at least one of drawing, upset forging, and high strain rate multi-axis forging the workpiece.

14. The method of claim 12, wherein plastically deforming the workpiece comprises deforming the workpiece at temperatures in the range of the beta transus temperature of the titanium alloy up to 300° F. (167° C.) above the beta transus temperature of the titanium alloy.

15. The method of claim 12, wherein plastically deforming the workpiece comprises high strain rate multi-axis forging the workpiece, and wherein cooling the workpiece comprises high strain rate multi-axis forging the workpiece as the workpiece cools to a temperature in the alpha+beta phase field of the titanium alloy.

16. The method of claim 12, wherein plastically deforming the workpiece comprises upset forging the workpiece to a beta-upset strain in the range of 0.1 to 0.5.

17. The method of claim 1, wherein the press forgings are conducted while the workpiece is at temperatures in a range of 100° F. (55.6° C.) below the beta transus temperature of the titanium alloy to 700° F. (388.9° C.) below the beta transus temperature of the titanium alloy.

18. The method of claim 1, further comprising, between successive press forgings, allowing the adiabatically heated internal region of the workpiece to cool to a temperature at which the next press forging is conducted.

19. The method of claim 18, wherein, between successive press forgings, the adiabatically heated internal region of the workpiece is cooled for a time in the range of 5 seconds to 120 seconds before the next press forging is conducted.

20. The method of claim 18, wherein dies of a forge used to press forge the workpiece are heated to a temperature no less than 100° F. (55.6° C.) below the temperature of the workpiece at which the workpiece is press forged.

21. The method of claim 1, wherein after a total true strain of at least 1.0 is achieved, the workpiece comprises an average alpha particle grain size in the range of 4 μm or less.

22. The method of claim 1, wherein the titanium alloy is Ti-6Al-2Sn-4Zr-2Mo-0.08Si alloy (UNS R54620) and the forging temperature range is 1120° F. (604.4° C.) to 1520° F. (826.7° C.).

23. The method of claim 1, wherein the titanium alloy is Ti-6Al-2Sn-4Zr-6Mo alloy (UNS R56260) and the forging temperature range is 1020° F. (548.9° C.) to 1620° F. (882.2° C.).

24. The method of claim 1, wherein the titanium alloy is Ti-4Al-2.5V alloy (UNS R54250) and the forging temperature range is 1080° F. (582.2° C.) to 1680° F. (915.6° C.).

25. The method of claim 1, wherein the titanium alloy is Ti-6Al-6V-2Sn alloy (UNS R56620) and the forging temperature range is 1035° F. (527.2° C.) to 1635° F. (890.6° C.).

26. The method of claim 1, wherein in each press forging a strain rate of the forging adiabatically heats an internal region of the workpiece by 100° F. (55.6° C.) to 300° F. (166.7° C.).

27. The method of claim 1, wherein:

the titanium alloy is Ti-6Al-2Sn-4Zr-2Mo-0.08Si alloy (UNS R54620);

the forging temperature range is 1120° F. (604.4° C.) to 1520° F. (826.7° C.); and each press forging is at a strain rate that adiabatically heats an internal region of the workpiece by 100° F. (55.6° C.) to 300° F. (166.7° C.).

28. The method of claim 27, wherein between successive press forgings, the adiabatically heated internal region of the workpiece is cooled for a time in the range of 5 seconds to 120 seconds before the next press forging is conducted.

29. The method of claim 1, wherein:

the titanium alloy is Ti-6Al-2Sn-4Zr-6Mo alloy (UNS R56260);

the forging temperature range is 1020° F. (548.9° C.) to 1620° F. (882.2° C.); and each press forging is at a strain rate that adiabatically heats an internal region of the workpiece by 100° F. (55.6° C.) to 300° F. (166.7° C.).

30. The method of claim 29, wherein between successive press forgings, the adiabatically heated internal region of the workpiece is cooled for a time in the range of 5 seconds to 120 seconds before the next press forging is conducted.

31. The method of claim 1, wherein:

the titanium alloy is Ti-4Al-2.5V alloy (UNS R54250);

the forging temperature range is 1080° F. (582.2° C.) to 1680° F. (915.6° C.); and each press forging is at a strain rate that adiabatically heats an internal region of the workpiece by 100° F. (55.6° C.) to 300° F. (166.7° C.).

32. The method of claim 31, wherein between successive press forgings, the adiabatically heated internal region of the workpiece is cooled for a time in the range of 5 seconds to 120 seconds before the next press forging is conducted.

33. The method of claim 31, wherein between successive press forgings, the adiabatically heated internal region of the workpiece is cooled for a time in the range of 5 seconds to 120 seconds before the next press forging is conducted.

34. The method of claim 1, wherein:

the titanium alloy is Ti-6Al-6V-2Sn alloy (UNS R56620);

the forging temperature range is 1035° F. (527.2° C.) to 1635° F. (890.6° C.); and each press forging is at a strain rate that adiabatically heats an internal region of the workpiece by 100° F. (55.6° C.) to 300° F. (166.7° C.).

* * * * *